US009463919B2

(12) United States Patent
Eini et al.

(10) Patent No.: US 9,463,919 B2
(45) **Date of Patent: *Oct. 11, 2016**

(54) APPARATUS AND METHOD FOR RELEASING A UNIT DOSE OF CONTENT FROM A CONTAINER

(71) Applicant: Foamix Pharmaceuticals Ltd., Rehovot (IL)

(72) Inventors: Meir Eini, Ness Ziona (IL); Tami Winitz, Ness Ziona (IL); David Schuz, Gimzu (IL)

(73) Assignee: Foamix Pharmaceuticals Ltd., Rehovot (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/634,208

(22) Filed: Feb. 27, 2015

(65) Prior Publication Data

US 2015/0239645 A1 Aug. 27, 2015

Related U.S. Application Data

(63) Continuation of application No. 13/809,669, filed as application No. PCT/IB2011/002336 on Jul. 12, 2011, now Pat. No. 8,978,936.

(60) Provisional application No. 61/363,577, filed on Jul. 12, 2010.

(51) Int. Cl.
*B65D 83/00* (2006.01)
*B65D 83/68* (2006.01)
(Continued)

(52) U.S. Cl.
CPC ..... *B65D 83/54* (2013.01); *B01F 3/04446* (2013.01); *B01F 5/0606* (2013.01);
(Continued)

(58) Field of Classification Search
CPC ..... B65D 83/14; B65D 83/16; B65D 83/40; B65D 83/48; B65D 83/68; B65D 83/201; B65D 83/202; B65D 83/205; B65D 83/54; B65D 83/206; B65D 83/207; B65D 83/525; B65D 83/546; B65D 83/682; B05C 17/00553; B05C 17/00516; B29B 7/7663; B29B 7/7678; B05B 11/3084; B05B 11/3081; B05B 7/08; B01F 3/04446; B01F 5/0606; B01F 5/0607; B01F 13/0022; B01F 15/0087
See application file for complete search history.

(56) References Cited

U.S. PATENT DOCUMENTS 1,159,250 A 11/1915 Moulton
1,666,684 A 4/1928 Carstens
(Continued)

FOREIGN PATENT DOCUMENTS

CA 2422244 9/2003
CH 639913 12/1983
(Continued)

OTHER PUBLICATIONS

U.S. Appl. No. 60/843,140, filed Sep. 8, 2006, Tamarkin.
(Continued)

*Primary Examiner* — Frederick C Nicolas
(74) *Attorney, Agent, or Firm* — Fish & Richardson P.C.

(57) ABSTRACT

A apparatus for delivering a predetermined quantity of content from a pressurized container includes a dispensing assembly which sits on the container and connects with an upper portion of a valve stem of the valve assembly, wherein the dispensing assembly includes a) an actuator cap having a discharge passage, which is open or obstructed and wherein the actuator cap acts as a metering chamber in combination with b) an adaptor which fits inside the cap and also snuggly engages the valve stem. The cap fits snuggly over the adjuster to define a metering chamber which depending on its position can close off the metered chamber or open it to the dispensing conduit\nozzle. When the cap is depressed it pushes down on the adjuster which depresses the valve. The chamber fills, but nothing is released until the upstroke.

26 Claims, 55 Drawing Sheets

(51) Int. Cl.

| | |
|---|---|
| ***B65D 83/54*** | (2006.01) |
| ***B65D 83/52*** | (2006.01) |
| ***B01F 3/04*** | (2006.01) |
| ***B01F 5/06*** | (2006.01) |
| ***B01F 13/00*** | (2006.01) |
| ***B01F 15/00*** | (2006.01) |
| *B65D 83/16* | (2006.01) |
| *B65D 83/14* | (2006.01) |
| *B65D 83/20* | (2006.01) |
| *B65D 83/40* | (2006.01) |
| *B65D 83/48* | (2006.01) |
| *B05B 7/08* | (2006.01) |

(52) U.S. Cl.

CPC ..... *B01F5/0607* (2013.01); *B01F 13/0022* (2013.01); *B01F 15/0087* (2013.01); *B65D 83/206* (2013.01); *B65D 83/207* (2013.01); *B65D 83/525* (2013.01); *B65D 83/546* (2013.01); *B65D 83/68* (2013.01); *B65D 83/682* (2013.01); *B05B 7/08* (2013.01); *B65D 83/14* (2013.01); *B65D 83/16* (2013.01); *B65D 83/201* (2013.01); *B65D 83/202* (2013.01); *B65D 83/205* (2013.01); *B65D 83/40* (2013.01); *B65D 83/48* (2013.01)

(56) References Cited

U.S. PATENT DOCUMENTS

| | | | |
|---|---|---|---|
| 2,767,712 | A | 10/1956 | Waterman |
| 3,142,420 | A | 7/1964 | Gawthrop |
| 3,154,075 | A | 10/1964 | Weckesser |
| 3,236,457 | A | 2/1966 | Kennedy et al. |
| 3,301,444 | A | 1/1967 | Wittke |
| 3,303,970 | A | 2/1967 | Breslau et al. |
| 3,377,004 | A | 4/1968 | Wittke |
| 3,401,849 | A | 9/1968 | Weber, III |
| 3,540,448 | A | 11/1970 | Sunnen |
| 3,559,890 | A | 2/1971 | Brooks et al. |
| 3,563,098 | A | 2/1971 | Weber, III |
| 3,667,461 | A | 6/1972 | Zamarra |
| 3,841,525 | A | 10/1974 | Siegel |
| 3,865,275 | A | 2/1975 | De Nunzio |
| 3,952,916 | A | 4/1976 | Phillips |
| 3,993,224 | A | 11/1976 | Harrison |
| 4,018,396 | A | 4/1977 | Shoemaker et al. |
| 4,019,657 | A | 4/1977 | Spitzer et al. |
| 4,187,963 | A | 2/1980 | Mascia |
| 4,226,344 | A | 10/1980 | Booth et al. |
| 4,309,995 | A | 1/1982 | Sacco |
| 4,325,939 | A | 4/1982 | Shah |
| 4,329,990 | A | 5/1982 | Sneider |
| 4,440,320 | A | 4/1984 | Wernicke |
| 4,603,812 | A | 8/1986 | Stoesser et al. |
| 4,620,646 | A | 11/1986 | Crapser |
| 4,738,396 | A | 4/1988 | Doi et al. |
| 4,792,062 | A | 12/1988 | Goncalves |
| 4,826,048 | A | 5/1989 | Skorka et al. |
| 4,902,281 | A | 2/1990 | Avoy |
| 4,993,496 | A | 2/1991 | Riedle et al. |
| 5,007,556 | A | 4/1991 | Lover |
| 5,013,297 | A | 5/1991 | Cattanach |
| 5,301,841 | A | 4/1994 | Fuchs |
| 5,344,051 | A | 9/1994 | Brown |
| 5,346,135 | A | 9/1994 | Vincent |
| 5,398,846 | A | 3/1995 | Corba et al. |
| 5,611,463 | A | 3/1997 | Favre |
| 5,613,623 | A | 3/1997 | Hildebrandt |
| 5,788,664 | A | 8/1998 | Scalise |
| 5,797,955 | A | 8/1998 | Walters |
| 5,865,347 | A | 2/1999 | Welschoff |
| 5,881,493 | A | 3/1999 | Restive |
| 5,951,544 | A | 9/1999 | Konwitz |
| 6,006,948 | A | 12/1999 | Auer |
| 6,068,105 | A | 5/2000 | Darwish |
| 6,116,466 | A | 9/2000 | Gueret |
| 6,186,367 | B1 | 2/2001 | Harrold |
| 6,189,810 | B1 | 2/2001 | Nerushai et al. |
| 6,190,365 | B1 | 2/2001 | Abbott et al. |
| 6,299,023 | B1 | 10/2001 | Arnone |
| 6,299,032 | B1 | 10/2001 | Hamilton |
| 6,308,863 | B1 | 10/2001 | Harman |
| 6,341,717 | B2 | 1/2002 | Auer |
| 6,364,854 | B1 | 4/2002 | Ferrer et al. |
| 6,544,562 | B2 | 4/2003 | Singh et al. |
| 6,672,483 | B1 | 1/2004 | Roy |
| 6,691,898 | B2 | 2/2004 | Hurray et al. |
| 6,722,532 | B2 | 4/2004 | Lasserre et al. |
| 6,834,778 | B2 | 12/2004 | Jinbo et al. |
| 6,843,390 | B1 | 1/2005 | Bristor |
| 6,968,982 | B1 | 11/2005 | Burns |
| RE38,964 | E | 1/2006 | Shillington |
| 7,021,499 | B2 | 4/2006 | Hansen et al. |
| 7,124,916 | B2 | 10/2006 | Groh et al. |
| 7,137,536 | B2 | 11/2006 | Walters et al. |
| 7,195,135 | B1 | 3/2007 | Garcia |
| 7,222,802 | B2 | 5/2007 | Sweeton |
| 7,226,230 | B2 | 6/2007 | Liberatore |
| 7,455,195 | B2 | 11/2008 | Mekata |
| 7,497,354 | B2 | 3/2009 | Decottignies et al. |
| 7,654,415 | B2 | 2/2010 | van der Heijden |
| 7,882,985 | B2 | 2/2011 | Ophardt |
| 8,978,936 | B2 | 3/2015 | Eini et al. |
| 2001/0027981 | A1 | 10/2001 | Yquel |
| 2002/0117516 | A1 | 8/2002 | Lasserre et al. |
| 2002/0153390 | A1 | 10/2002 | Vlodek |
| 2003/0194379 | A1 | 10/2003 | Brugger et al. |
| 2004/0072638 | A1 | 4/2004 | Enos et al. |
| 2004/0079361 | A1 | 4/2004 | Clayton et al. |
| 2004/0161447 | A1 | 8/2004 | Paul |
| 2004/0195276 | A1 | 10/2004 | Fuchs |
| 2005/0054991 | A1 | 3/2005 | Tobyn et al. |
| 2005/0079139 | A1 | 4/2005 | Jacques et al. |
| 2005/0085843 | A1 | 4/2005 | Opolski et al. |
| 2005/0196414 | A1 | 9/2005 | Dake et al. |
| 2005/0205086 | A1 | 9/2005 | Tamarkin et al. |
| 2005/0207837 | A1 | 9/2005 | Kosh et al. |
| 2005/0232869 | A1 | 10/2005 | Tamarkin et al. |
| 2005/0252995 | A1 | 11/2005 | Westphal et al. |
| 2005/0255048 | A1 | 11/2005 | Hirsh et al. |
| 2005/0258189 | A1 | 11/2005 | Peterson et al. |
| 2005/0268416 | A1 | 12/2005 | Sommers |
| 2005/0271596 | A1 | 12/2005 | Friedman et al. |
| 2005/0285912 | A1 | 12/2005 | Delametter et al. |
| 2006/0018937 | A1 | 1/2006 | Friedman et al. |
| 2006/0054634 | A1 | 3/2006 | Mekata |
| 2006/0108377 | A1 | 5/2006 | Glynn et al. |
| 2006/0114745 | A1 | 6/2006 | Ollmann et al. |
| 2006/0193789 | A1 | 8/2006 | Tamarkin et al. |
| 2006/0269485 | A1 | 11/2006 | Friedman et al. |
| 2006/0285912 | A1 | 12/2006 | Eini et al. |
| 2007/0009607 | A1 | 1/2007 | Jones |
| 2007/0020304 | A1 | 1/2007 | Tamarkin et al. |
| 2007/0069046 | A1 | 3/2007 | Eini et al. |
| 2007/0292355 | A1 | 12/2007 | Tamarkin et al. |
| 2011/0214671 | A1 | 9/2011 | London et al. |

FOREIGN PATENT DOCUMENTS

| | | |
|---|---|---|
| DE | 1 882 100 | 11/1963 |
| DE | 10009233 | 8/2000 |
| EP | 0 528 190 | 2/1993 |
| EP | 0 662 431 | 7/1995 |
| EP | 0 757 959 | 2/1997 |
| EP | 1 375 386 | 1/2004 |
| EP | 1 537 916 | 6/2005 |
| FR | 2 591 331 | 6/1987 |
| FR | 2 640 942 | 6/1990 |
| FR | 2 789 371 | 8/2000 |
| FR | 2 793 479 | 11/2000 |
| FR | 2 814 959 | 4/2002 |
| FR | 2 833 246 | 6/2003 |
| FR | 2 843 373 | 2/2004 |

(56) References Cited

FOREIGN PATENT DOCUMENTS

| | | |
|---|---|---|
| FR | 2 845 672 | 4/2004 |
| FR | 2 848 998 | 6/2004 |
| GB | 998 490 | 7/1965 |
| GB | 1 162 684 | 8/1969 |
| GB | 1 201 918 | 8/1970 |
| GB | 2 206 099 | 12/1988 |
| GB | 2 367 809 | 4/2002 |
| GB | 2 406 330 | 3/2005 |
| IL | 49491 | 9/1979 |
| JP | 57209666 | 6/1981 |
| JP | 62241701 | 10/1987 |
| JP | 2007/155667 | 6/1995 |
| JP | 09 084855 | 3/1997 |
| JP | 2010/332456 | 12/1998 |
| JP | 2006/036317 | 2/2006 |
| JP | 2006/103799 | 4/2006 |
| RU | 2277501 | 6/2006 |
| WO | WO 01/54679 | 8/2001 |
| WO | WO 01/85102 | 11/2001 |
| WO | WO 02/062324 | 8/2002 |
| WO | WO 03/000223 | 1/2003 |
| WO | WO 03/013984 | 2/2003 |
| WO | WO 03/070301 | 8/2003 |
| WO | WO 03/071995 | 9/2003 |
| WO | WO 03/097002 | 11/2003 |
| WO | WO 2004/037225 | 5/2004 |
| WO | WO 2005/011567 | 2/2005 |
| WO | WO 2005/018530 | 3/2005 |
| WO | WO 2005/102539 | 11/2005 |
| WO | WO 2008/041045 | 4/2008 |
| WO | WO 2012/007843 | 1/2012 |

OTHER PUBLICATIONS

U.S. Appl. No. 60/818,634, filed Jul. 5, 2006, Friedman.
U.S. Appl. No. 60/815,948, filed Jun. 23, 2006, Tamarkin.
U.S. Appl. No. 60/789,186, filed Apr. 4, 2006, Tamarkin.
International Preliminary Report on Patentability from PCT/IB2011/002336, dated Jan. 15, 2013, 13 pages.
International Search Report and Written Opinion in International Application No. PCT/IB11/02336, mailed Apr. 18, 2012, 3 pages.

APPARATUS AND METHOD FOR RELEASING A UNIT DOSE OF CONTENT FROM A CONTAINER

CROSS REFERENCE TO PRIOR APPLICATIONS

This application is a continuation application of U.S. application Ser. No. 13/809,669, filed Jan. 11, 2013, which is a US National Stage Application of PCT/IB2011/002336, filed Jul. 12, 2011, which claims the benefit of priority under 35 U.S.C. §119(e) to U.S. Provisional Application No. 61/363,577, filed Jul. 12, 2010; all of which are herein incorporated in their entirety by reference.

FIELD

The present invention relates to an apparatus, applicator and method for release of a measured content from a container. The present invention further relates to an apparatus, applicator and method for release of a measured content from multiple containers simultaneously with or without a mixer for mixing the content of the multiple containers. In particular, the present invention relates to an apparatus, applicator, and method, with or without a mixer for mixing the content of the multiple containers, for releasing a predetermined approximate quantity of content or "standard dose within the metes and bounds of the use intended from a container or from multiple containers simultaneously which is volume dependent. The present invention relates to the provision of a standard dose, which is repeatable and reliable within an acceptable or reasonable error margin for the proposed use. The present invention also relates to an apparatus that includes an actuator cap or cylinder whose internal free volume can define the volume of formulation to be dispensed which is movable on an adaptor having sealing properties.

BACKGROUND

Different containers have existed for many years and are used for a variety of products.

Methods of administering metered doses from a dosing device are known, however, most are directed to dispensing liquid forms, such as creams, lotions, and fluids.

Plungers with an internal chamber and springs have been used as metering devices.

Prior art foam metering devices have been described as inaccurate and imprecise and can be complex and expensive.

Methods and apparatuses for dispensing content from single and from multiple containers are known in the art. They can involve the use of complex and sophisticated devices that can add significantly to the cost of the intended product. Such disclosures also do not address the problems of dispensing a predetermined amount of content in a relatively simple and seepage free way from a container.

Methods for the volumetrically controlled dosing of foams have been described using a metering valve in which valve inlet and outlet passages control the flow of a fluid into a limited reservoir or confined space of a specific measure within the internal valve structure or within a narrow delivery passage known as a metering or dosing chamber. Such devices provide a limited chamber and are only capable of containing very small and fixed aliquots of material. Such devices can also be susceptible to undesirable dripping, seepage and the like through the discharge passage or past the operating parts. These metering valves also involve a relatively large number of components which have to be constructed with a high degree of accuracy. These metering valves can add substantially to the cost of the product and do not permit or facilitate quick and economic filling of the pressurized containers through the metering valves with the material which is later to be metered therefrom.

Some prior art foam metering devices use an external reservoir that first has to be filled and emptied, which is separate from the canister valve and from the actuator apparatus. Such devices require a special valve or a continuous valve and cannot be used with canisters with standard valves. Also the devices require a special elastic membrane or diaphragm. In some prior art metering devices a dispensing member moves within the reservoir.

Where the metering mechanism is provided within the internal valve structure, prevention of seepage or and leaking, which is so critical with regard to the internal valve, becomes more difficult as a more complex structure must be provided. Complexity leads to increased risk of malfunction. Also, malfunction of an internal valve structure requires discarding of the entire can together with unused aerosol formulation.

In some prior art devices, such as with metering aerosol buttons or actuator caps, if insufficient depressing force is applied, the discharge passage is not fully closed but the internal valve within the aerosol device is nevertheless "cracked" or partially opened, whereby a continuous flow of aerosol substance occurs, defeating the metering action. Thus, a disadvantage of these metering aerosol buttons or actuator caps is that a non-metered or continuous discharge can occur if inapplicable pressure is applied to the actuator button, which pressure is insufficient, for example, to fully shift all of the operative, relatively movable parts to the loading or filling position. A further disadvantage is that release only occurs whilst the actuator button is fully or almost fully depressed and removal of pressure may result in an incomplete dose.

In some prior art metering aerosol buttons or actuator caps, the exit of fluid is prevented by the depressive force of on operator pressing down on a diaphragm.

Some prior art metering valves can prevent fast filling of the containers since the filling substance must pass around the metering passages in the metering valve.

Methods of mixing doses from dual chamber devices are known, however, many are directed to mixing of doses prior to their expansion and release as a foam, for example where the doses are contained and mixed in narrow constraints and remain in a liquid phase.

SUMMARY

The disclosure provides a cap into which snuggly fits an adjuster to define a metering chamber which depending on its position can close off the metered chamber or open it to the dispensing conduit\nozzle. The adjuster fits on the canister valve. When the cap is depressed it pushes down on the adjuster which depresses the valve. The chamber fills but nothing is released till the upstroke.

In one aspect, an apparatus for delivering a predetermined quantity of content from a pressurized container includes

- a container capable of housing a pressurized content, the container comprising a valve assembly in fluid communication with the content; and
- a dispensing assembly which sits on the container and connects with an upper portion of a valve stem of the valve assembly, wherein the dispensing assembly includes a) an actuator cap having a discharge passage, which is open or obstructed and wherein the actuator cap acts as a metering chamber in combination with b) an adaptor which fits inside the cap and also snuggly engages the valve stem;

wherein the adaptor includes i) a hollow conduit (or discharge aperture) positioned at the center);

ii) a sealer ring which slightly extends from the external circumference of the adaptor which snugly engages the inner side wall of cap;

iii) a recess to accommodate the valve stem in tight frictional engagement; and iv) a ledge at the bottom of the adaptor, which provides a stop to the downward movement of the cap.

whereby the dispensing assembly upon application of a downward pressure moves from a non-actuated position to an actuated depressed position opening the valve assembly, wherein content is released into the metering chamber, and wherein the consequential release of pressure and or closing of the valve stem causes the dispensing assembly to resume a non-actuated position and a standard content to be discharged.

In one or more embodiments, the dispensing assembly is an actuator assembly.

In any of the preceding embodiments, the dispensing assembly further includes an enclosure unit and a dispensing unit and the movable elements are the dispensing unit and actuator assembly and wherein the cap may be integrated into the dispensing unit.

In any of the preceding embodiments, the cap includes a) a top wall which is pressed down during actuation; b) a hollow defined by an inner side cylindrical wall dimensioned to closely approximate the diameter of an outer side cylindrical wall of the adaptor, said hollow functioning as a metering chamber and c) a discharge passage through the bottom peripheral side wall for releasing content.

In any of the preceding embodiments, the adaptor includes a) discharge aperture positioned at the center of its top wall allowing discharge of content there through upon actuation into the metering chamber; b) a sealer ring which slightly extends from the circumference of the adaptor and functions as a gas-tight sealer and snugly engages the inner side wall of cap thus preventing undesired leakage of substance between the slideable parts upon actuation; c) an annular valve-stem-engaging recess defined by a inner cylindrical wall which is dimensioned to closely approximate the diameter of the valve stem, thereby permitting tight frictional engagement there between; and d) a ledge at the bottom of the adaptor which is a thickened edge portion extending circumferentially, which provides a stop to the downward movement of the cap and wherein the resistance offered by such adaptor to downward pressure is relatively small, especially as compared with the opposing action of the internal valve spring thereby ensuring the closure of the discharge passage by the adaptor prior to any downward movement of the valve stem.

In any of the preceding embodiments, where in the non-actuated position, the internal valve is closed and the valve stem and actuator assembly disposed thereon are raised, the sealing ring is below the discharge passage and the discharge passage is only partially obstructed by the top of the adaptor, thereby in communication with the atmosphere and where in the actuated position, the valve is open to fluid flow, the valve stem and actuator assembly disposed thereon are depressed and the discharge passage is closed and obstructed by adaptor top and sealing ring is positioned above the discharge passage.

In any of the preceding embodiments, the apparatus further includes a locking mechanism for proper positioning of the dispensing unit on the enclosure unit including a first and second engageable surfaces which are unlocked and disengaged prior to initial use and are locked in both actuated and non-actuated positions, wherein in an actuated position said surfaces are disengaged and in a non-actuated position, upon release of content, said surfaces are engaged.

In any of the preceding embodiments, the dispensing unit includes a) a dispensing end which terminates with a discharge nozzle for release of materials from container; b) a dispensing conduit housed within a protective conduit housing which is aligned with a cap discharge passage; c) mounting pins which are located at the dispensing end of the dispensing unit and are configured to fit slots on the sides of enclosure unit; d) finger engageable indentation for actuation of the dispensing assembly e) a notch beneath the finger engageable indentation, with a protruding bottom flat first surface for engaging a second surface on the enclosure unit together forming a locking mechanism for proper positioning of the dispensing unit on the enclosure unit.

In any of the preceding embodiments, the enclosure unit is sized to accommodate the dispensing unit; comprising: a) a flat bottom surface which rests on top of the container and sized about the size of the container top comprising a hole to accommodate the actuator assembly b) peripheral wall which includes at its bottom one or more support braces which attach on the top portion of the neck of container and which extends below the lower edge of the brace and includes a circumferential rib that secures the enclosure unit to neck of the container; c) mounting arms terminating with slots for receiving mounting pins of the dispensing unit; d) at least one resilient edge positioned on the bottom surface of the enclosure unit having a second protruding top flat surface for engaging a first bottom flat surface of the dispensing unit together providing a locking mechanism for proper positioning of the dispensing unit on the enclosure unit.

In another aspect, an apparatus for accurately delivering a predetermined quantity of content from a pressurized container includes:

a container capable of housing a pressurized content, the container comprising a valve in fluid communication with the content;

a dispensing assembly comprising an actuator assembly, a dispensing unit and an enclosure unit;

the actuator assembly, comprising an adaptor and a cap disposed thereon, the cap having a metering chamber, said chamber being capable of effecting and storing a standard quantity of the formulation upon downward pressure and dispensed upon termination of pressure;

the enclosure unit having mounting arms terminating with slots pivotally engaging mounting pins of the dispensing unit for securing the dispensing unit to the container;

the dispensing unit wherein the cap is integrated therein, comprising a conduit in fluid communication with a cap discharge passage and the conduit terminating with a nozzle which allows a standard quantity of the formulation to be dispensed with each actuation;

wherein the actuator assembly is capable of movement between a non-actuated position to a actuated position, wherein according to the non-actuated position the internal valve is closed, the valve stem and actuator assembly disposed thereon are raised, and the discharge passage is open partially obstructed by adaptor top and sealing ring is below the discharge passage thereby in communication with the atmosphere and wherein the actuated position, the valve is open to fluid flow, the valve stem and actuator assembly disposed thereon are depressed and the discharge passage is closed and obstructed by adaptor top and the sealing ring is above the discharge passage.

In another aspect, an apparatus for accurately delivering a predetermined quantity of content from at least two pressurized containers includes:

at least two containers capable of housing different or identical pressurized content, the containers each comprising a valve in fluid communication with its respective content, the containers are disposed side by side or at an angle to each other;

a multiple dispensing assembly comprising: a) at least two actuator assemblies, b) a multiple chamber dispensing unit and c) a multiple chamber enclosure unit each actuator assembly comprising an adaptor and a cap disposed thereon, the cap is integrated within the dispensing unit, wherein the cap includes: a) a top wall which is pressed down during actuation; b) a hollow defined by an inner side cylindrical wall dimensioned to closely approximate the diameter of an outer side cylindrical wall of the adaptor, said hollow functioning as a metering chamber and c) a discharge passage through the bottom peripheral side wall for releasing content, wherein the adaptor includes a) discharge aperture positioned about at the center of its top wall allowing discharge of content there through upon actuation into the metering chamber; b) a sealer ring which slightly extends from the circumference of the adaptor and functions as a gas-tight sealer and snugly engages the inner side wall of cap thus preventing undesired leakage of substance between the slideable parts upon actuation; c) an annular valve-stem-engaging recess defined by a inner cylindrical wall which is dimensioned to closely approximate the diameter of the valve stem, thereby permitting tight frictional engagement there between; and d) a ledge at the bottom of the adaptor which is a thickened edge portion extending circumferentially, which provides a stop to the downward movement of the cap and wherein the resistance offered by such adaptor to downward pressure is relatively small, especially as compared with the opposing action of the internal valve spring thereby ensuring the closure of the discharge passage by the adaptor prior to any downward movement of the valve stem, the multiple or dual chamber dispensing unit comprising a) at least two dispensing conduits in fluid communication with the cap discharge passages and terminating with at least two nozzles for dispensing of materials from each container; b) a body encompassing the conduits; c) finger engageable hollow protrusion which connects the two caps for simultaneous actuation of the dispensing assembly; d) a hollow beneath the finger engageable protrusion, with a protruding bottom flat first surface for engaging a second surface on the enclosure unit together forming a locking mechanism for proper positioning of the dual dispensing unit on the dual enclosure unit and e) optionally mounting pins which are located at the dispensing end of the dispensing unit and are configured to fit slots on the sides of enclosure unit; the multiple chamber enclosure unit securing the multiple chambers dispensing assembly to the containers, wherein the enclosure unit is sized to accommodate the dispensing unit; including, a) a flat bottom surface which rests on top of the containers and sized about the size of the containers' top comprising two holes to accommodate the actuator assemblies, b) peripheral wall, which includes at its bottom one or more support braces which attach on the top portion of the neck of each container and which extends below the lower edge of the brace and includes a circumferential rib that secures the dual enclosure unit to necks of the container; c) mounting arms terminating with slots for receiving mounting pins of the dispensing unit or lever; d) at least one resilient edge positioned on the bottom surface of the enclosure unit having a second protruding top flat surface for engaging a first bottom flat surface of the dispensing unit together providing a locking mechanism for proper positioning of the dispensing unit on the enclosure unit and optionally e) a handle and f) lever having mounting pins which fit into slots in the enclosure unit for depressing an engageable finger protrusion to push down the dispensing assembly and obtain a standard dose of content;

wherein the dual dispensing assembly is capable of movement between a non-actuated position to a actuated position, where according to the non-actuated position, each valve stem is raised, each internal valve is closed and each discharge passage is open and in communication with the atmosphere and according to the actuated position, each valve stem is depressed, each valve is open to fluid flow, and each discharge passage is closed;

and wherein the non-actuated position, the internal valve is closed the valve stem and actuator assembly disposed thereon are raised, the sealing ring is below the discharge passage and the discharge passage is only partially obstructed by the top of the adaptor, thereby in communication with the atmosphere and where in the actuated position, the valve is open to fluid flow, the valve stem and actuator assembly disposed thereon are depressed and the discharge passage is closed and obstructed by adaptor top and sealing ring is positioned above the discharge passage.

In any of the preceding embodiments, the apparatus further includes a paddle mixer unit attached to the nozzles of the multiple dispensing unit in order to facilitate the mixing of simultaneously expelled content from two or more chambers, said mixer comprising a) a series of alternating curved surfaces or paddles or angled dove tailing blades; b) an outlet from which the mixed content is expelled; and c) at least two inlets in a diameter suitable for snuggly receiving nozzles of the multiple dispensing unit d) a body encompassing the paddles.

In any of the preceding embodiments, the apparatus further includes a maze mixer unit attached to the nozzles of the multiple dispensing unit in order to facilitate the mixing of simultaneously expelled content from two or more chambers, said mixer comprising a) a maze or series of alternating straight or curved surfaces or angled dove tailing blades combined with cylinder or posts which facilitate improved mixing; b) an outlet from which the mixed content is expelled; and c) at least two inlets of a size suitable for snuggly receiving nuzzles of the multiple dispensing unit d) a short body encompassing the maze.

In any of the preceding embodiments, the apparatus further includes a split nozzle attached to the nozzles of the multiple dispensing unit for dispensing at least two contents (the same or different) at least at two different locations.

In any of the preceding embodiments, the metering chamber is dynamically adjustable comprising a topless cap and adjusting device comprising an adjustable screw with a base comprising a washer having a sealing ring attached thereto, wherein the size of the chamber may be varied according to location of the base within the cap.

In any of the preceding embodiments, the metering chamber is dynamically adjustable comprising a topless cap and adjusting device comprising an adjustable screw with a base comprising a washer having a sealing ring attached thereto, wherein the size of the chamber may be varied according to location of the base within the cap.

In any of the preceding embodiments, the metering chamber is dynamically adjustable comprising a topless cap and adjusting device comprising an adjustable screw with a base comprising a washer having a sealing ring attached thereto, wherein the size of the chamber may be varied according to location of the base within the cap.

In another aspect, a method for delivering a predetermined quantity of content from the apparatus describe above is provided. The method includes applying a downward pressure on the dispensing assembly, and then releasing pressure to allow a single unit content to be discharged.

In any of the preceding embodiments, the dispensing assembly is actuated multiple times to allow multiple standard doses to be discharged.

In any of the preceding embodiments, the method for delivering a predetermined quantity of content from the above-described apparatus includes applying a downward pressure on the dispensing assembly, and then releasing pressure to allow a single unit content to be discharged from each container.

In any of the preceding embodiments, the dispensing assembly is actuated multiple times to allow multiple standard doses to be discharged.

In any of the preceding embodiments, the method further includes the following steps:

a) according to a first step, applying finger pressure on the top of the cap causing it to shift downward on the adaptor resulting in the discharge passage of the cap to be blocked by the top side wall of the adaptor and sealing ring;
b) according to a second step, applying further downward finger pressure results in the lower edge portion of the cap engaging the lower ledge of the adaptor causing the adaptor to shift downward on the valve stem causing the internal valve to open.
c) according to a third step, opening of the valve thereby causing the contents to pass upward through the valve stem and out the top wall aperture of the adaptor into the metering chamber which is obstructed by the sealer ring and side wall of adaptor, the cap constituting in effect a slide valve element.
d) according to a fourth step removing finger pressure from the cap resulting in the internal return valve spring and the pressurized content to return the parts of the actuator assembly to non-actuated position where the metering chamber is in communication with the outside atmosphere because, the adaptor, including the sealer ring, is positioned below the discharge passage allowing the pressurized contents of the metering chamber to issue from the discharge passage as a standard discharge.

In any of the preceding embodiments, the dispensing unit includes an outer surface that covers the actuator cap; a dispensing conduit in the dispensing unit in fluid communication with the metering chamber of the actuator cap; and a discharge nozzle at an end of the dispensing conduit distal to the metering chamber.

In any of the preceding embodiments, the actuator cap is integral with the dispensing unit.

In any of the preceding embodiments, the apparatus further includes a tubular conduit extending from and in fluid communication with the discharge nozzle.

In any of the preceding embodiments, the dispensing unit further comprises an engagement mechanism for securing the dispensing unit to the enclosure unit.

In any of the preceding embodiments, the engagement mechanism comprises a raised or depressed feature complementary to an element on the enclosure unit for engagement and securing the dispensing unit to the enclosure unit.

In any of the preceding embodiments, the engagement mechanism comprises at least two substantially vertically aligned slots within an external peripheral wall of the dispensing unit.

In any of the preceding embodiments, the slots further comprise a notch for engaging with a rail of the enclosure unit.

In any of the preceding embodiments, the engagement mechanism comprising an integral relationship between the dispensing unit and the enclosure unit.

In any of the preceding embodiments, the enclosure unit includes a lower surface that surrounds and engages with the neck of the container; and side walls extending from the lower surface towards the dispensing unit, wherein the side wall comprise a complementary engagement mechanism for engagement and securing the dispensing unit to the enclosure unit.

In any of the preceding embodiments, the complementary engagement mechanism comprises a complementary raised or depressed feature on the internal surface of the enclosure unit side wall.

In any of the preceding embodiments, the dispensing unit further includes a dose adjuster, the dose adjuster comprising a lower surface of a dimension selected to snugly engage the inner side wall of the metering chamber along its entire perimeter and upper shaft capable of being adjustably vertically positioned within the metering chamber.

In any of the preceding embodiments, the metering chamber comprises an interior lip and the upper shaft of the dose adjuster is threaded and in threaded engagement with the interior lip to provide adjustable vertical positioning.

The apparatus can further include a lock to secure the threaded upper shaft in a selected vertical position.

In any of the preceding embodiments, the dispensing assembly is configured to house a plurality of actuator cap adaptor assemblies.

In any of the preceding embodiments, the dispensing unit comprises a plurality of actuator cap/adaptor assemblies in fluid communication at each metering chamber through a T-joint, each said plurality of actuator cap/adaptor assemblies capable of engagement with the stem valve of a different container.

In any of the preceding embodiments, the hollow conduit of the adaptor is centrally located.

The present invention overcomes several challenges in the field of controlled content delivery from canisters.

Aerosol valves commonly used in the industry are continuous valves that keep delivering content from canisters as long as the actuator is pressed. In order to deliver controlled doses, the common approach is to use proprietary valves when the dose control is operated inside the valve. There are many drawbacks to this approach, which is very costly and requires from manufacturers to use proprietary equipment in order to crimp these valves on canisters and fill these canisters with contents. In some embodiments, the present invention provides a solution for delivering controlled dose on canisters equipped with standard continuous valves, by operating the dose control within the actuator which is equipped with a metering chamber. In some embodiments of the present invention, the volume of the metering chamber fixes the amount of content delivered. A mechanism is provided for closing the dispensing conduit during the filing of the metering chamber by contents, and for opening the dispensing conduit when the valve is closed in order to release the contents from the metering chamber. The use of standard continuous valves in the present invention enables a reduction of production costs, and a full compatibility with commonly used industrial equipments.

When the dose control is operated within the actuator, one has to accommodate with the presence of pressurized to highly pressurized contents into the actuator, which is a situation rarely found in the actuator's industry. Some of the challenges involved in the presence of pressurized contents in the actuator are the risks of leakage and the risk of disconnection of the actuator from the valve, which is even more likely to occur when a large dose of content is to be delivered. In some embodiments, the present invention provides an actuator design that accommodates with pressurized contents, and provides a smooth delivery without leakage. This is inter alia achieved by providing appropriate ratios between the actuator metering chamber volume and the discharge passage diameter and snuggly fitting resiliently sealed movable parts. Other challenges include minimizing or avoiding dead space, avoiding or minimizing contents remaining in the metering chamber after expulsion, and adapting the apparatus for use with different formulations. In the case of foamable formulations the expansion volume of the resultant foam can vary from formulation to formulation and this in turn can result in a different standard volume dose of foam for an identical metering chamber volume.

In a multiple chamber apparatus, in addition to the challenges detailed above, there is a need to provide a simultaneous delivery from each canister, and a proper mixing of the contents. In some embodiments, the present invention allows an actuator design that enables the simultaneous opening of the valve of each canister, and the mixing of the content by a mixer in order to provide a smooth and homogeneous delivery from the multiple containers. In other embodiments the contents can be released in parallel unmixed. In either case one of the challenges is to ensure that for each canister a standard volume is released. So for example canister 1 is attached to a dispensing assembly 1 that provides a metering chamber volume V1 and canister 2 is attached to a dispensing assembly 2 that provides a metering chamber volume V2. Depending on the intended standard dosage to be delivered for each formulation in each canister V1 can be the same or different from V2. If V1 and V2 are the same and they are to be mixed it is a challenge to ensure that the pressure in both systems is maintained at a similar level and to avoid a greater discharge of canister 1 content compared to canister 2 content or vita versa. If intentionally say V2 is half of V1 then another challenge is to ensure that the volume of V1 that is released and mixes with V2 remains and is maintained at a ratio of 2:1 during release.

BRIEF DESCRIPTION OF THE DRAWINGS

The invention is described with reference to the drawings, which are presented for the purpose of illustration only and is not intended to be limiting of the invention. Unless otherwise indicated, elements are indicated by the same number in all drawings. In one or more embodiments.

DETAILED DESCRIPTION

Figure 1A:
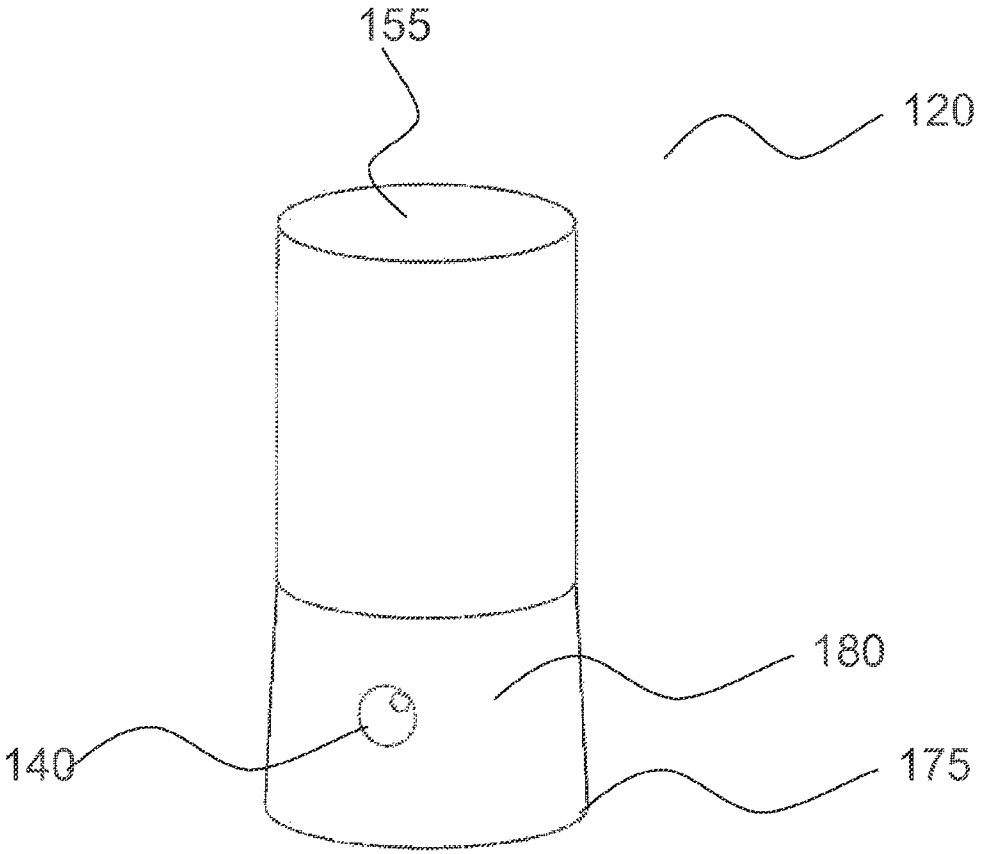
FIG. 1A provides a perspective view of a cap.

An apparatus for providing a standard dose is provided. The apparatus can be simple and include a dispensing assembly and a valved-canister or container. The dispensing assembly is designed to provide a reliable standard dose of content from the container. The valved-canister or container may be a standard valve and or container or it can be a specialized valve or container. The ability to use the dispensing assembly with a standard valve and container makes the apparatus economically attractive. Thus, in one or more embodiments there is provided a standard dose dispensing assembly for accurately delivering a predetermined amount (volume and/or weight) of a content, for example, in the form of a foam, cream, gel, lotion, spray, or other flowable fluid from a container or canister. According to one or more embodiments the dispensing assembly is permanently affixed onto a container or a canister. The dispensing assembly can be in a disengaged or engaged state. According to one or more embodiments the dispensing assembly is reusable. According to one or more embodiments the dispensing assembly is disposable. According to one or more embodiments the dispensing assembly may be attachable to a variety of canisters differing in shape or size or both. The amount of dose released is dependent on the available internal volume of the metering chamber or cylinder.

For delivery of creams or lotions or gels or mousses or foams and the like a patient is generally left to his own devices to choose an amount to be applied to an area to be treated. By providing a standard dose a pharmaceutical company can provide appropriate guidelines to a doctor who in turn can give clear guidance to a patient specifying how many standard doses to apply and when, which should lead to improved use of the medicine and better compliance. Accurate dosing is possible but apart from cumbersome syringe like systems metered dose systems are expensive and would substantially increase the cost making the treatment un-affordable to health care systems. The device and its various embodiments presented herein make it possible to provide a standard dose that is repeatable within reasonable limits which can be affordable. By standard dose is meant e.g. a certain volume or weight that can be provided within certain reasonable limits of accuracy and or repeatability. It is hoped that by providing the device described herein an agreed standard can be set for topical application in the pharmaceutical and cosmetic industry to enable the prescription of a standard dose. The dose may not need to be precise but only to fall within certain standard ranges, which may for example, in the future be set by health care agencies such as the FDA. Various standard doses may be envisaged. For example, standards that conform to a volume dose of say 0.1 cc; 0.5 cc 1 cc etc., plus or minus and authorized standard deviation of say 20% or less. Standard dose may also mean in the alternative a "unit dose" or "metered dose" or "controlled dose". In some embodiments the term controlled dose includes a standard dose that can be controlled for example by providing a device with an adjustable means for changing the standard dose. In some embodiments, by unit dose is meant a single standard dose. In some embodiments by metered dose is meant a measured standard dose, for example, it could be an intended measured volume dose of say, as a non limiting example 0.1 cc; 0.5 cc; or 1 cc; etc., within certain limits such as a standard deviation of say 20% or 18% or 15% or 12% or 10% or 8% or 5% or 3% or 2% or less or a measured weight of say, as a non limiting example 0.01 gm; 0.05 gm; or 0.1 gm; etc. within certain limits, such as aforesaid. In one or more embodiments the device and its various embodiments is adapted to provide a standard dose.

In one or more embodiments a novel dispensing assembly, comprising an actuator assembly, is provided for use with a valved container or canister. The actuator assembly is simple in construction, has relatively few parts, and provides an easy to use, safe and reliable metering discharge. In one or more embodiments the dispensing assembly can be used with single canisters and in one or more embodiments the dispensing assembly is a multi-canister assembly for use with two or more canisters simultaneously or in synchronization.

In one or more simple embodiments the dispensing assembly includes an actuator assembly, which in turn is made of an actuator cap (hereinafter "cap or cylinder") and an adaptor, which are described in detail below. In one or more embodiments the cap is a separate unit. In one or more other embodiments the cap is an integral part of the dispensing unit. Inside the cap is an internal volume that includes a metering chamber. In a simple embodiment the adaptor of the actuator assembly is carried by the upper or external portion of a standard valve stem. A recess in the base of the adaptor is adapted to fit snugly on the upper or external portion of the valve stem in a frictional engagement. By attaching the dispensing assembly to a valved-canister, a standard non-metered dose dispenser or applicator is readily and inexpensively converted into a standard dose dispenser or applicator.

In one or more other embodiments, described later in detail, the dispensing assembly can include an actuator assembly, a dispensing unit and an enclosure unit.

The apparatus as indicated above includes two main components; a) the valved-container, such as, a canister in which is stored a formulation and having a conventional or standard valve comprising a stem with an internal valve assembly; b) the dispensing assembly comprising an actuator assembly. The actuator assembly is connected to the valved-canister. In simple terms, when operated, the actuator assembly causes the valve of the valved-container to open and release a measure of content into a metering chamber. In other words when the actuator cap is depressed the stem is in turn depressed or shifted downwards to initiate a discharge of the substance or content of the container into the metering chamber. Upon release of the actuator (for example, by release of pressure by the operator) the valve closes and the content of the metering chamber can be released into and through a discharge passage when a space opens between the metering chamber and the discharge passage. So a single actuation of the apparatus can releases a single unit or standard dose of the formulation. The formulation may be a cosmetic formulation or a pharmaceutical formulation. In the latter case it will include one or more active agents which may be a drug or medication. In one or more embodiments the formulation contains one or more excipients. The excipients can for example add to the stability or look and feel of the formulation. In one or more embodiments the canister will include propellant to expel the dose through the apparatus. The propellant may be separate or part of the formulation or both. In one or more embodiments the formulation may include a propellant. In one or more embodiments the propellant is liquefied gas propellant. In one or more embodiments the formulation is a foamable formulation, which when expelled forms a foam. The above outline mechanism is now described below in detail with reference to the figures.

As shown in FIGS. 1A-F in an embodiment the actuator assembly is made of two components: (i) an actuator cap and (ii) an adaptor. The cap is disposed on the adaptor and the adaptor snuggly engages the valve stem. In one or more embodiments the cap is a separate unit. In one or more other embodiments it is an integral part of the dispensing unit.

Figure 2A:
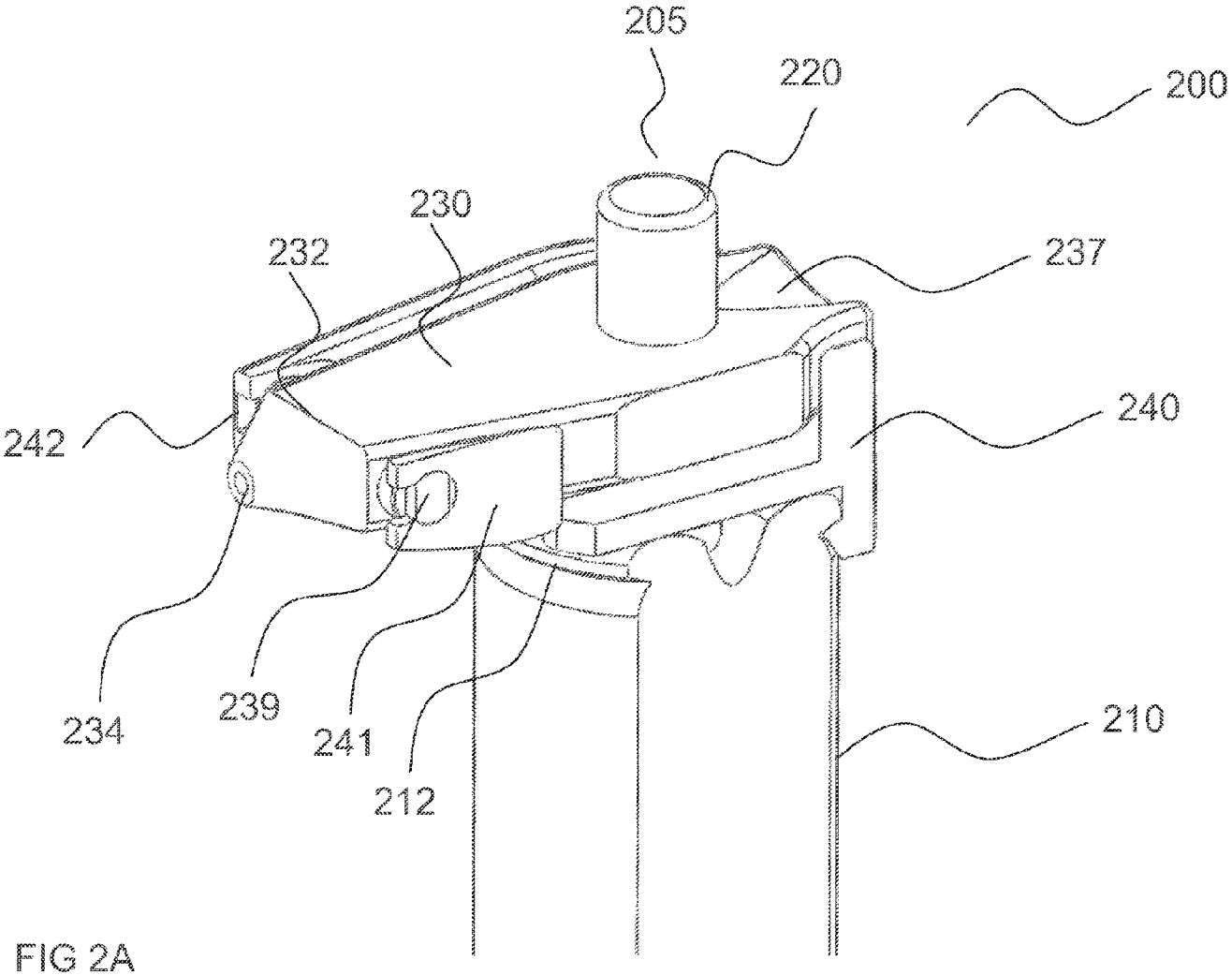
FIG. 2A is a perspective view of the dispensing assembly disposed on a container that is capable of including a content, including an actuator assembly having an integrated cap within a dispensing unit pivotally hinged onto an enclosure unit in an engaged non-actuated state.

As shown in FIG. 2A, according to one or more other embodiments the dispensing assembly may include in addition to the actuator assembly (i) a dispensing unit which allows a standard quantity of the formulation to be dispensed with each actuation; and (ii) an enclosure unit securing the dispensing unit to the container.

Various embodiments described operate according to a general principle of operation, with the exception of the first time the apparatus is taken up (initial pre-use state) and it must first be locked into an operational position. The user depresses the actuator cap or a finger engageable indentation or protrusion (see FIG. 1 and or FIGS. 2 and or 4 respectively), which causes a cap to vertically slide down on the adaptor until it reaches the ledge 170 (see FIG. 1D) of the adaptor and then depresses the adaptor which is snugly disposed on a valve stem causing an internal valve to move from a closed position (see, e.g., FIGS. 8 and also 3C) to an open position (not shown) where the valve stem 832 is below the inner gasket 836 (see also, e.g., FIG. 3B). In the closed position, the open channel formed by valve stem is blocked and the contents of container are isolated from the exterior. In the open position, the valve and stem are unobstructed to provide fluid communication with the container interior, allowing contents of container to be dispensed from the container through the valve stem 832. In order to terminate the flow of formulation, it is merely necessary to release the valve stem permitting it to automatically move upwardly and return into the non-dispensing position where it is held by the force of the valve assembly internal spring or resilient means (not shown). The manner by which this occurs is well known in prior art structures.

Actuator cap (referred hereinafter also as a cap or cylinder) is shown in perspective, and cross-sectional views in FIGS. 1A-C, respectively. Cap 120 includes a top surface or wall 155 that is used according to a first and simplest embodiment of the invention by the user for actuation of the dispensing assembly. The top surface is shown as flat but it can also be rounded (concave or convex). The cap 120 further includes a discharge passage 140 which is an aperture at the bottom of the peripheral cylinder side wall 180 (FIG. 1A). The size of the discharge passage should big enough to allow efficient or quick dispensing of the content however it cannot exceed a size which will extend beyond or rupture the sealer ring (or sealing ring) of the adaptor as detailed below.

The discharge passage is a narrow tubular channel. In one or more embodiments it may terminate with round orifices, as a wider cone or a widening conical form with round orifices at one end (140) and a narrower cone or a narrowing conical form at the other end (110). According to a further embodiment the passage is entirely conically shaped with the narrow tip (110) of the cone, which is in contact with the sealer ring of the adaptor, being positioned at the inner end to provide minimal friction with the sealer ring without substantially reducing the rate of discharge and to enable a smaller ring to be used (FIG. 1B). In an embodiment the tip 110 of the cone is also rounded in order to minimize friction with the sealer ring (FIG. 1C).

The design parameters of the discharge passage may vary depending on the nature of the composition to be expelled.

For foamable formulations where propellant is part of the formulation content the passage in design should ideally be narrow enough so that the formulation remains fluid to prevent the content from expanding into a foam in the passage and for example, thus avoiding air or bubble or content blocks and yet wide enough to effect a discharge of the unit dose within seconds of actuation. The radius of the discharge passage may be as large as say 1 mm and as small as 0.025 mm. The radius of the discharge passage may vary, for example, between about 0.8 mm and about 0.05 mm, between about 0.6 mm and about 0.1 mm or between about 0.5 mm and about 0.2 mm. In an embodiment the radius is about 0.025 mm, is about 0.033 mm, is about 0.05 mm, is about 0.067 mm, is about 0.1 mm, is about 0.15 mm, is about 0.2 mm, is about 0.3 mm, is about 0.4 mm, is about 0.5 mm, is about 0.6 mm, is about 0.7 mm, is about 0.8 mm, is about 0.9 mm, is about 1 mm. The size and the shape of the passage aperture will determine the rate and the shape of the content to be dispensed. In one or more embodiments, the ratio between the diameter of the discharge passage and the volume of the metering chamber of the actuator is selected in order to provide an efficient or smooth delivery. If said ratio is too small, the delivery of the contents from the metering chamber can be retarded, which prevents the pressure in the metering chamber from dropping and may cause leakage of disconnection of the apparatus from the valve. If said ratio is too large, then ring 185 might block the discharge passage which will prevent smooth and efficient operation of the device. In one or more embodiments, the ratio between the diameter of the discharge passage and the volume of the metering chamber may be as large as say 1:500,000 and as small as 1:1. In one or more embodiments, said ratio is about 1:80,000. In one or more embodiments, the ratio between the diameter of the discharge passage and the volume of the metering chamber may be, for example, smaller than about 1:500,000, smaller than about 1:250,000, smaller than about 1:100,000, smaller than about 1:10,000, smaller than about 1:1,000, smaller than about 1:100, smaller than about 1:50, smaller than about 1:25, smaller than about 1:10, smaller than about 1:5, smaller than about 1:2, or may be greater than about 1:2, greater than about 1:5, greater than about 1:10, greater than about 1:100, greater than about 1:1000, greater than about 1:10,000, greater than about 1:100,000, greater than about 1:250,000, greater than about 1:500,000 or can be between any of the figures mentioned above. It is understood that said ratio is calculated when the diameter of the discharge passage and the volume of the metering chamber are expressed in similar units. For example, for a diameter of the discharge passage of 1 mm and a volume of the metering chamber of 160 mm3, said ratio will be 1:160.

Figure 1B:
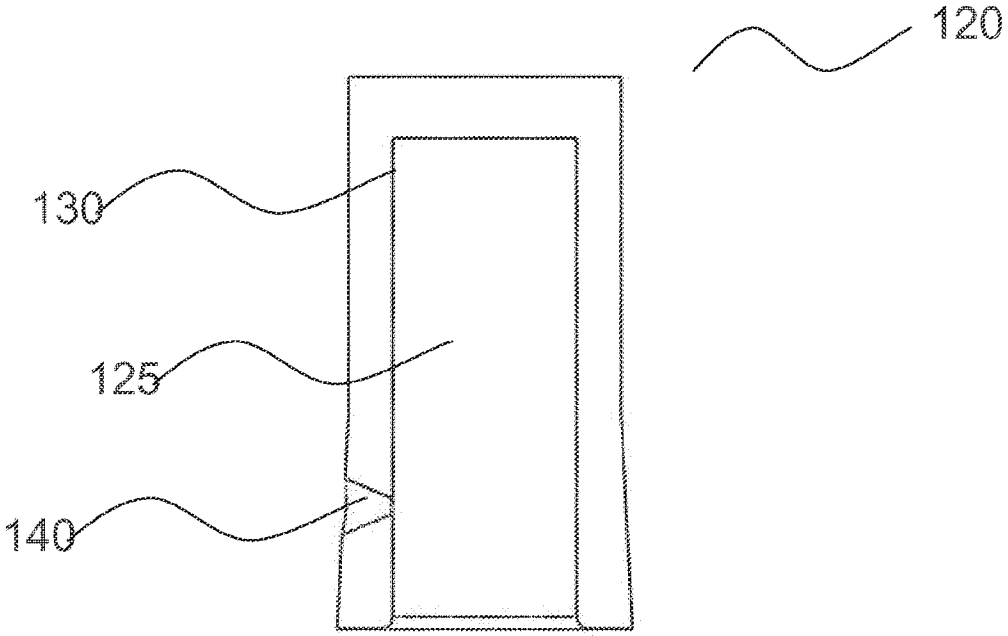
FIG. 1B provides a side view of a cap.
Figure 1C:
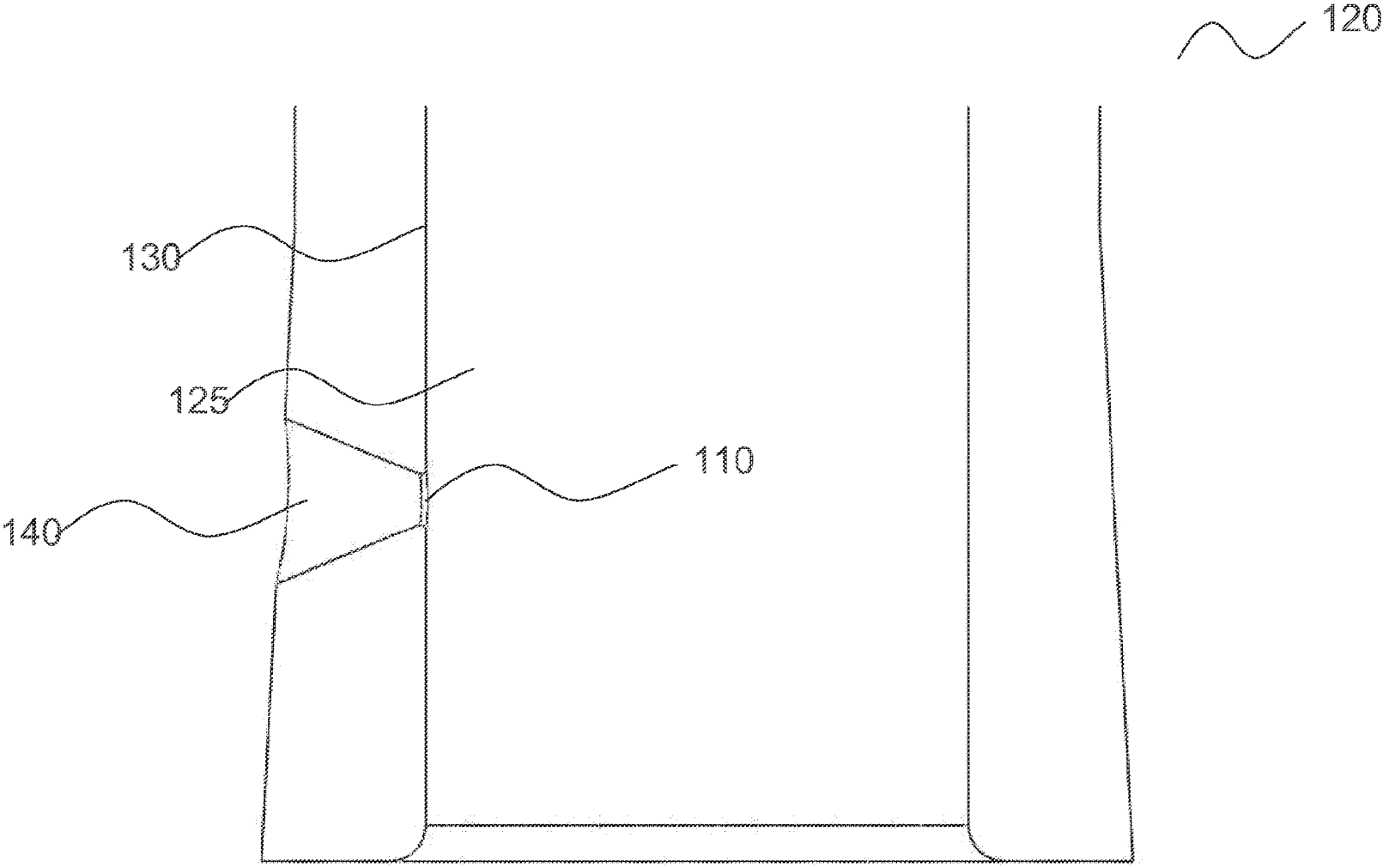
FIG. 1C provides an enlarged view of the discharge passage.

As shown in FIG. 1B, the cap 120 includes an metering chamber 125 which is a cylinder shaped hollow defined by an inner side cylindrical wall 130. The cap inner diameter should be larger than the adapter at its widest diameter (excluding the sealer ring and the ledge towards the bottom of the adaptor) at the outer side wall 135. In an embodiment the side cylindrical wall is dimensioned to closely approximate the diameter of the outer side cylindrical wall 135 of the adaptor 115. Nevertheless, the fit of the sealer ring 185 inside the cap is on the one hand, such that it is in a sealed resilient or frictional contact with the inside of the cap at the point of contact and on the other hand, still allows the adaptor to move up or down in relation to the inside wall of the cap. In other words, the cap 120 is so arranged as to constitute a slide valve member, said cap 120 being movable on or in relation to the adaptor. During a non-actuated state the cap is in a raised position and moves to a depressed position upon actuation.

Figure 1D:
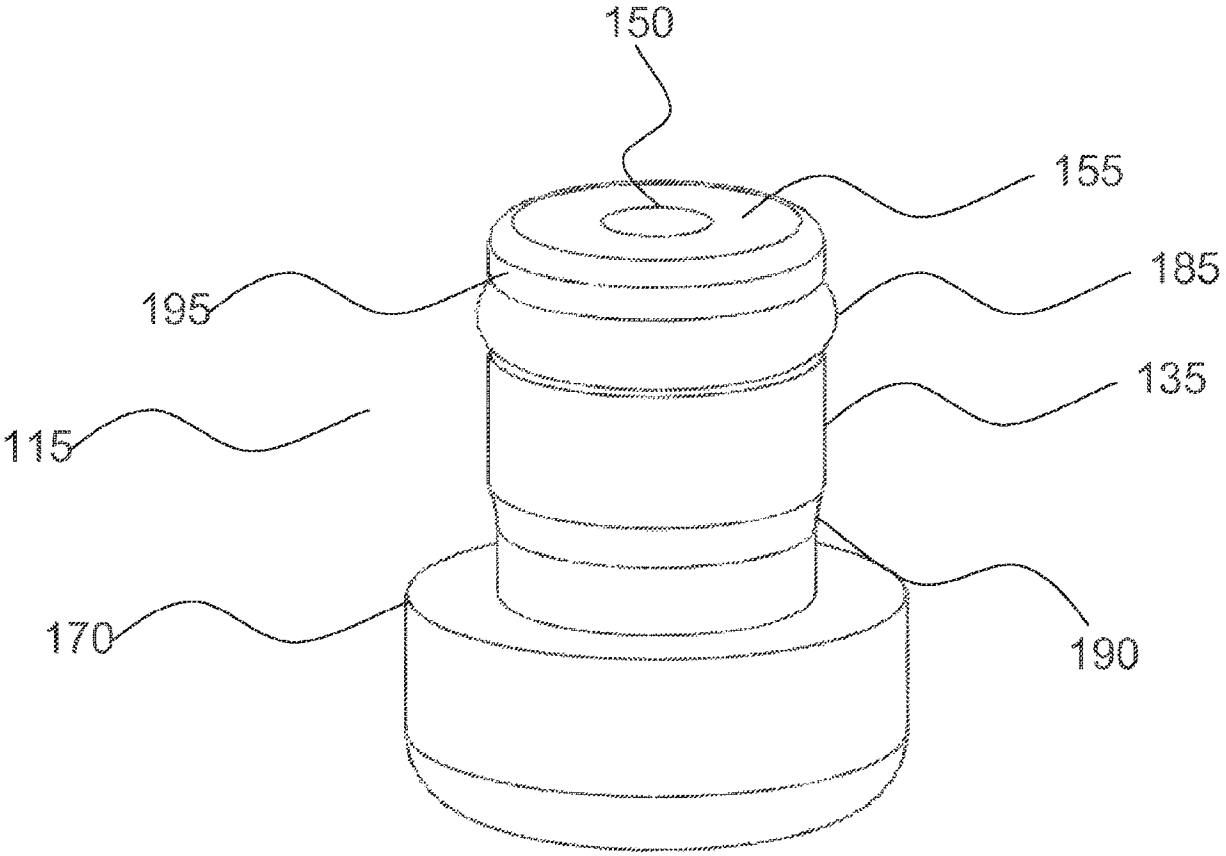
FIG. 1D provides a perspective view of an adaptor.
Figure 1E:
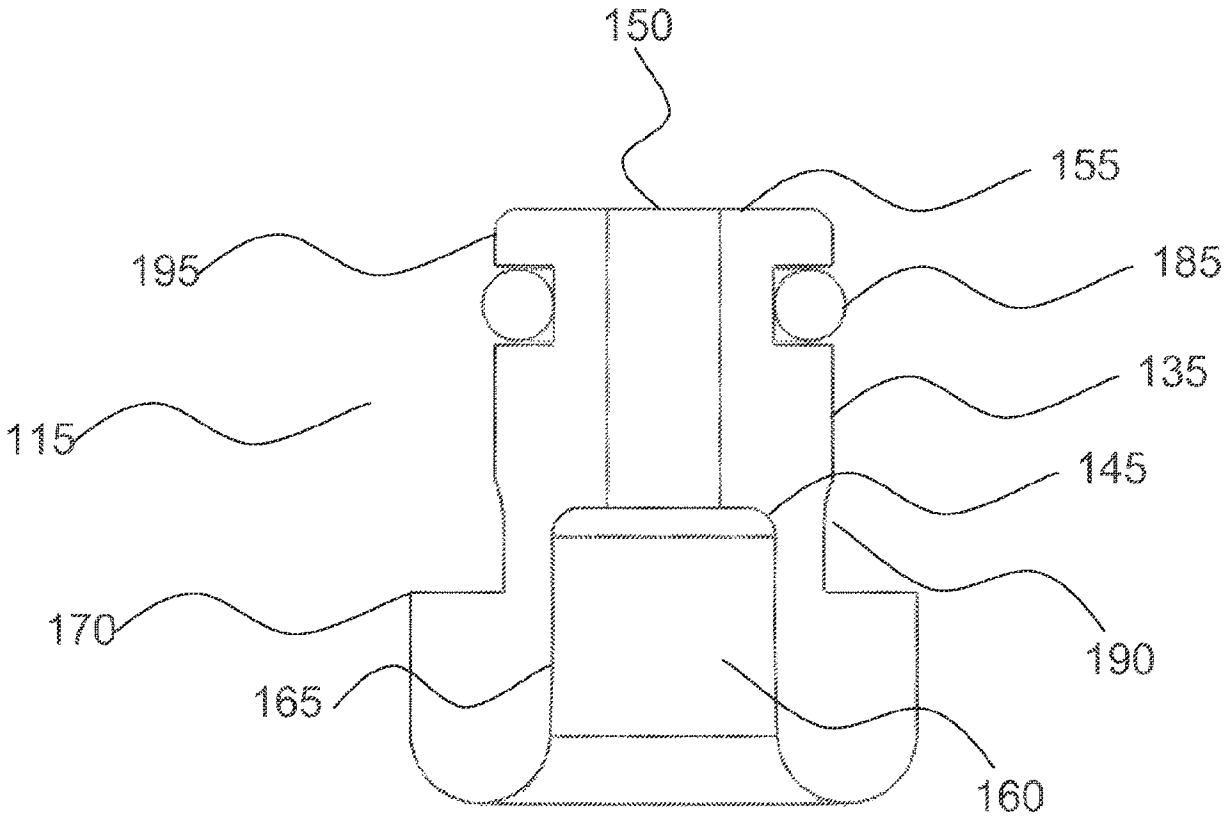
FIG. 1E provides a vertical cross sectional view of an adaptor.

As depicted in FIG. 1D-E, the adaptor includes a discharge aperture 150 positioned along the axis of the adapter at about the center of the top wall 155 of the adaptor, which allows discharge of content upon actuation of the inner valve through the discharge aperture into the metering chamber 125 (FIG. 1B). The adaptor includes a sealer ring 185 which slightly or sufficiently extends beyond from the circumference of the adaptor and functions as a gas-tight sealer. In an embodiment the sealer ring is an elastic and resilient material. In an embodiment it is composed of a low friction material such a silicone based material to facilitate easy and smooth movement of the adapter within the cap whilst maintaining a resilient seal. It snugly engages the inner side wall of cap and prevents undesired leakage of substance between the slideable parts upon actuation when the discharge passage is closed off by the adaptor as in FIG. 3B. According to one embodiment the sealer ring protrudes about 0.1 mm from the circumference of the adaptor. According to other embodiments the sealer ring protrudes about 0.12 mm, about 0.14 mm, about 0.16 mm, about 0.18 mm or about 0.2 mm from the diameter of the adaptor. According to still other embodiments the sealer ring protrudes about 0.08 mm, about 0.06 mm, about 0.04 mm, about 0.02 mm or about 0.01 mm from the diameter of the adaptor.

The sealer ring is made of a material which is elastic yet sticky in order to provide a resilience or friction and sealing affect but is capable of withstanding repeated use and movement without loss of the scaling effect. It may have a semi-rigid but flexible structure, and may be made of a flexible, resiliently yieldable material. Non limiting examples include, such as, rubber, polytetrafluoroethylene (PTFE), expanded-PTFE (ePTFE), polyurethane, silicone, or other appropriate polymeric material. The material selected should be chosen so that it is inert with the content of the container and is not susceptible to breakdown or leaching into or out of the ring. According to one preferred embodiment the sealer ring is made of medical silicone which is especially flexible, low friction yet resistant to wear and tear. In one embodiment, it may be made from a super elastic, shape memory material such as Nitinol alloy which can be collapsed to a smaller diameter when the narrow section of the cap slides over it and spring back to a large diameter adequate for sealing the cap's wider cross-section.

The sealer ring may be of a variety of shapes and sizes provided that it is compatible with the size of diameter of the tip of the inner discharge passage and is capable of completely obstructing it upon actuation and partly obstructing it in a non-actuated stated allowing release of content. The diameter of the sealer ring correlates with the size of the inner tip of the passage thus, the larger the inner passage the larger the diameter of the sealer ring should be. In any case, the diameter of the sealer ring must be at least the size of the diameter of the inner discharge passage. According to one embodiment the cross section of the sealer ring describes an eclipse shaped to provide minimal contact with the inner wall of the cap and especially discharge passage thus, reducing friction and allowing easier motion of the cap.

Figure 3A:
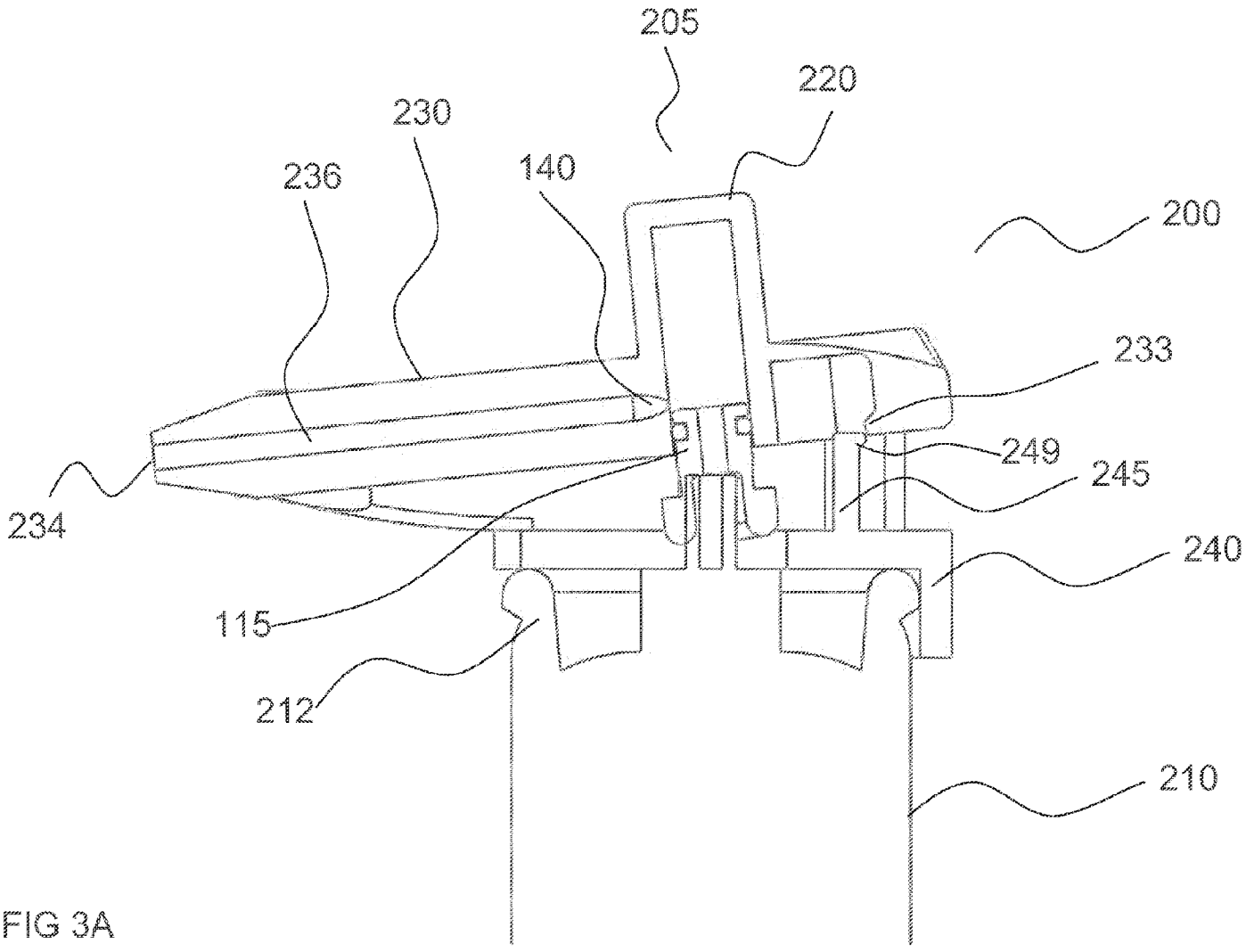
FIG. 3A provides a vertical cross sectional view of a dispensing assembly disposed on a container that is capable of including a content (not shown) including an actuator assembly having an integrated cap within a dispensing unit in a pre-use, initial, unlocked, disengaged, non-actuated state disposed on a container that is capable of including a content (not shown).
Figure 3B:
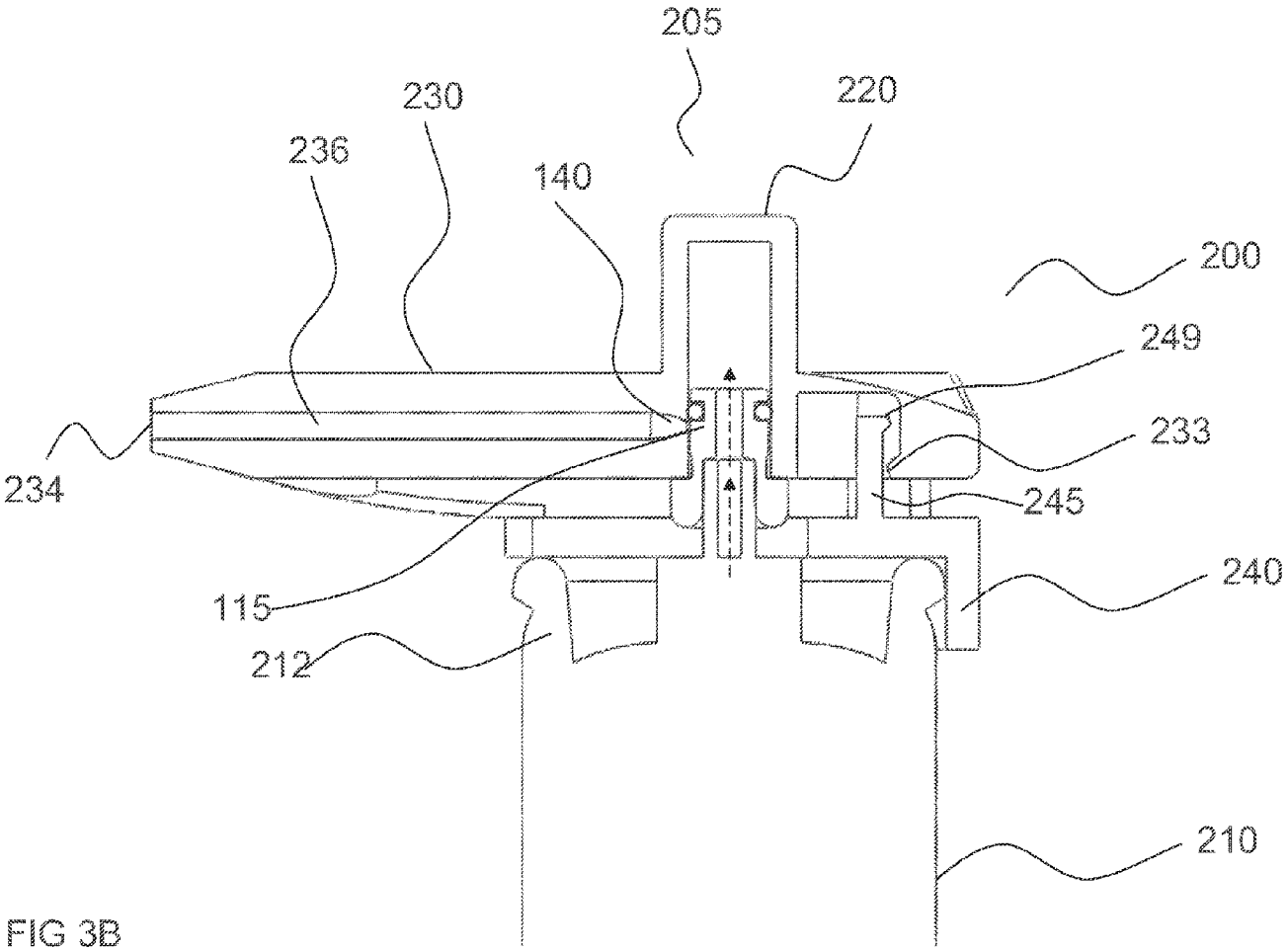
FIG. 3B provides a vertical cross sectional view of the dispensing assembly disposed on a container that is capable of including a content (not shown) including an actuator assembly having an integrated cap within a dispensing unit in a locked actuated state where content is released from container and stored in the metering chamber.
Figure 3C:
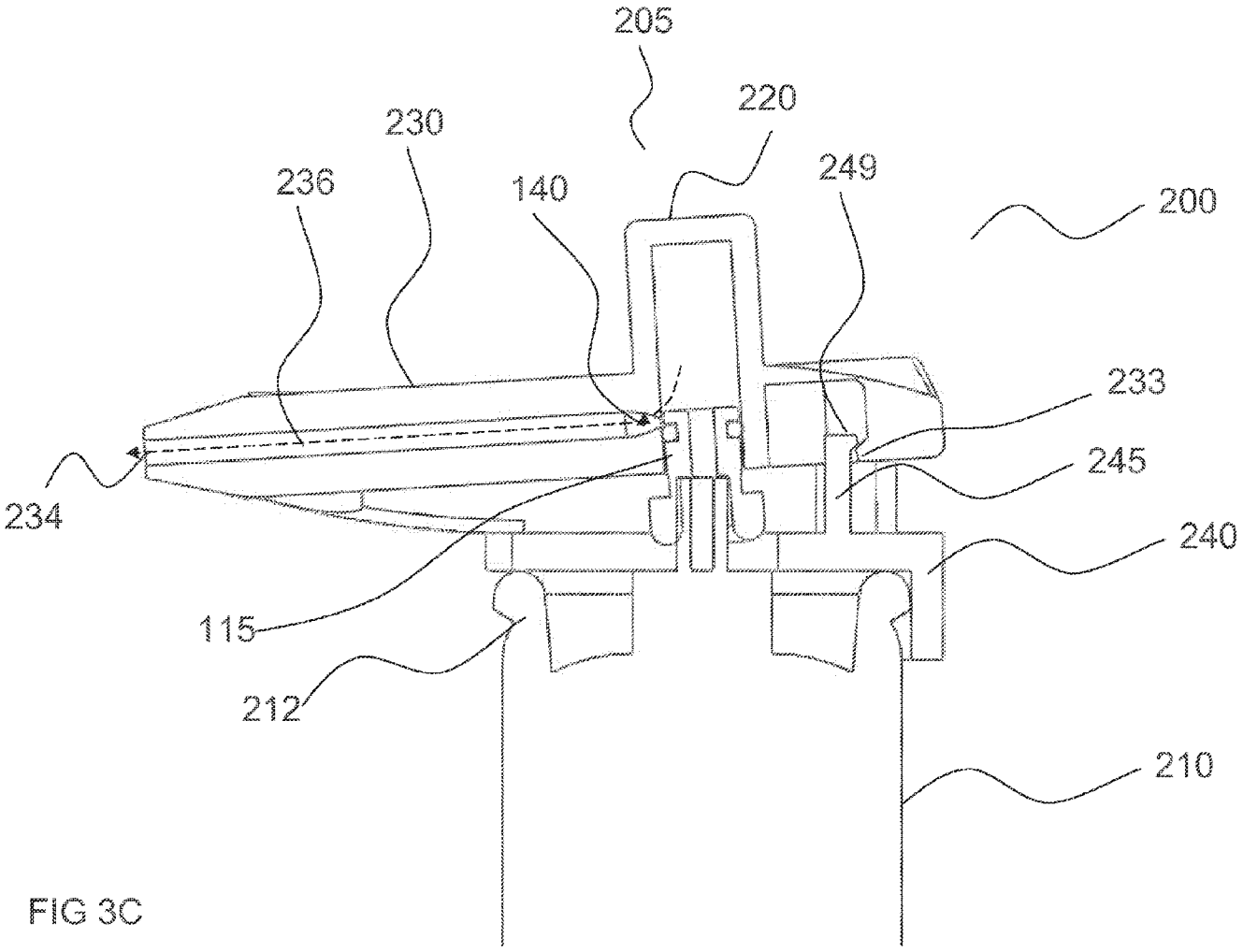
FIG. 3C provides a vertical cross sectional view of the dispensing assembly disposed on a container that is capable of including a content (not shown) including an actuator assembly in a locked, post-actuated, non-actuated state where content is released from metering chamber through a narrow space/passage formed between the top side surface of the adaptor and the inner wall of the cap into and through the discharge passage and passing out of the dispensing unit.

In an initial disengaged pre-use state, prior to any actuation, the adaptor, specifically the sealer ring 185 of the adaptor, is positioned below the discharge passage 140 and both the cap and the adaptor are in the raised position free of all external force such as finger pressure, etc. For such position, the discharge passage is unobstructed and the metering chamber has communication with the outside atmosphere via the discharge passage (FIG. 3A). Once an external force, such as finger pressure, is applied on the actuator the cap pushes down the adaptor so that the discharge passage 140 is now below the sealer ring of the adaptor, and is completely obstructed by the effect of the sealer ring and by the top side surface wall of the adaptor 195 as will be further explained in detail below (FIG. 3B). Once the finger pressure is released the cap and adaptor slide up due to pressure generated by propellant and the adaptor, including its sealer ring 185, is then positioned below the discharge passage. The adaptor is designed so that in this position, the metering chamber has communication with the outside atmosphere via a narrow space formed between the top side surface wall (195) of the adaptor and the inner side cylinder wall 130 of the cap to connect with the tip 110 of the discharge passage (FIG. 3C)

As shown in FIG. 1E, the adaptor further includes a valve-stem-engaging recess 160 defined by a inner cylindrical wall 165 which is dimensioned to closely approximate the diameter of the valve stem (not shown), thereby permitting tight frictional engagement there between. In one or more embodiments in order to tightly engage the valve stem but still allow motion, the edges of the inner top wall 145 of the recess are rounded to fix proper positioning over the top corners of the valve stem at single points of contact. The middle section of the outer side wall of the adaptor is slightly inwardly indented or narrowed. In other words the adaptor is provided with a narrow waist 190. According to one embodiment the indentation is about 0.1 mm, thereby permitting tight frictional engagement between sealer ring and the cap but still allowing the cap to move freely on the adaptor upon application of force. In other embodiments smaller and or larger indentations are possible. According to certain embodiments the indentation is about 0.12 mm, about 0.14 mm, about 0.16 mm, about 0.18 mm or about 0.2 mm from the diameter of the adaptor. According to still other embodiments the indentation is about 0.08 mm, about 0.06 mm, about 0.04 mm, about 0.02 mm or about 0.01 mm from the diameter of the adaptor.

At the bottom of the adaptor a thickened edge portion (or flange) extends circumferentially beyond the diameters of the outer and top side walls of the adaptor, to create a large-diameter rim or ledge 170 which provides a stop to the downward movement of the cap and ensures a complete closure of the discharge passage prior to depression of the valve stem is effected, as will be explained in more detail below. (FIG. 3B).

The adapter according to one embodiment can be seen in FIG. 1D. In modified embodiments it can be seen in FIGS. e.g. 10A, 10B, 11A, 11C, 12A and 12B as 115. The adapter is basically the same whether single canister, adjustable dose, or dual chamber as can be seen from the figures. In the dual chamber device the adapter is usually smaller than in the single canister format so that the metering chamber of each dual chamber adapter can say produce approximately half the volume of that of the single canister assembly so that he final standard dose of the single unit or of the dual chamber is about the same. For example if the output of each metering chamber in the dual arrangement is 0.5 cc the total output will be about 1 cc foam. In the case of the single chamber assembly the adjuster/chamber output will be designed (by having a larger adapter and metering chamber) to produce a standard volume of foam of say 1 cc.

Finger or other suitable pressure applied on the top of the cap as illustrated in FIG. 3B will shift it downward on the adaptor so that the discharge passage of the cap will be sealed off from the metering chamber by the sealing ring. Further downward finger pressure will result in the lower edge portion 175 of the cap engaging the lower ledge 170 of the adaptor which will now be depressed and shift downward the valve stem causing the internal valve to open. Contents may now pass upward through the valve stem and out the discharge aperture of the adaptor into the metering chamber. Such substance may not escape from the metering chamber at this time, however, because the cap discharge passage is still sealed off from the metering chamber by the sealer ring and obstructed by the side wall of adaptor, the former constituting in effect a slide valve element.

After the parts have attained the position shown in FIG. 3B, whereby the metering chamber is loaded with a standard dose of content, once the finger pressure is removed from the cap the internal valve spring (not shown) will close and the pressurized content of the metering chamber will return the parts of the actuator assembly to the FIG. 3C position. For non pressurized content in one or more embodiments a resilient means, for example on or beneath the ledge 170 will be needed to achieve this. In this position, the metering chamber will have communication with the outside atmosphere because, the sealer ring, is positioned below the discharge passage allowing the pressurized contents of the metering chamber to pass through a narrow space formed between the top side surface 190 of the adaptor and the inner side cylinder wall 130 of the cap into and through the discharge passage 140 and then issue from the discharge passage as a standard discharge.

The adaptor has an annular recess 160 which tightly engages the standard valve stem which is usually equipped with an annular protuberance to permit secure locking and resilient or frictional engagement between the adaptor and the valve stem. It will be noted that the adaptor encloses the peripheral portions of the side wall of the valve stem 832 which is non-yielding or non-flexible. This, together with the sealing ring, provide the adaptor with an effective sealing of a quality which allows it to be used interchangeably with a range of different actuator assemblies with different sized and types of metering chambers thereon.

It should also be noted that the combined resistances of the adaptor against the cap to downward movement is, less than the resistance offered by the internal valve spring. As a consequence, at such time that the actuator cap is depressed, as for example by applying finger pressure in the manner illustrated in FIG. 3B, the metering chamber will be closed and sealed off from the discharge passage by the adaptor prior to any downward movement of the valve stem. Thus, closure of the cap discharge passage is effected before opening of the valve. In consequence it is virtually impossible to effect a continuous discharge of substance by say weak or ineffective actuator use thereby solving and overcoming one of the disadvantages of the prior art. Instead a positive and reasonably reproducible metering action is effected within the metes and bounds of the intended use even in the hands of an inexperienced or novice operator.

Once, the metering chamber is sealed off the valve is opened, allowing substance from the canister to fill the metering chamber. Upon removal of finger pressure from the cap, the valve will first close, preventing further egress of substance from the container. Thereafter, the metering chamber and adaptor will both resume their initial uplifted position and the chamber will be allowed to communicate with the discharge passage via a narrow space formed between the top side surface of the adaptor 180 and the inner side cylinder wall 130 of the cap into and through the discharge passage. When this occurs the trapped substance in the chamber and in the hollow portion of the valve stem will issue forth from discharge passage. Subject to the nature of the formulation in general terms if the content includes propellant say about 3% to about 50% it can emerge as a foam. If the content includes higher amounts of propellant say even 95% it can emerge as a spray. If the content is expelled by propellant pressure acting on a bag inside a canister and not in the formulation itself additional means are needed to cause the cap and adapter to return upwards to an uplifted position and when the chamber will be allowed to communicate with the discharge passage via a narrow space formed between the top side surface of the adaptor 195 and the inner side cylinder wall 130 of the cap into and through the discharge passage. The content may be expelled as a, cream, gel, lotion or any other flowable substance that can pass through the space and discharge passage (FIG. 3C).

In one or more embodiments the metering chamber may include a resilient means mounted at the top of the metering chamber and attached to a thin horizontally displaced plate of a smaller diameter than the chamber. In an embodiment the plates diameter is close to the metering chamber inner wall diameter but not close enough to touch the inner wall. In the resting state the resilient means pushes the plate to just above the level of the discharge conduit. Upon actuation of the device assembly (by downward stroke) the pressurized content enters the metering chamber and pushes the plate to the roof of the chamber. The resilient means is selected to be readily displaced by the propellant pressure. On the return stroke or upper stroke of the actuating assembly the discharge conduit is open to the chamber and the pressurized content is released. During the release the plate is displaced downwards by the resilient means and helps to clear or clean the chamber of content. In one or more embodiments there is provided a metered chamber cleaning means. In this way, where needed, the chamber can be kept generally free of content thereby preventing a gradual reduction of metering volume over a period of use because of a possible build up non cleared content in the chamber.

The adaptor and cap resume a biased outwardly position mainly due to the liquid or propellant pressure. This is advantageous as return springs can lose their resiliency, and diaphragms can become brittle and ineffective with age or reuse. Furthermore, in the absence of a return spring, the actuator assembly is compliant with different types of standard canisters, whereas prior art actuators are not usable with return springs having resistance which is higher than the internal valve spring. In one or more embodiments where a return spring can be used on or under ledge 170 it is not at any time in contact with the formulation.

The actuator assembly may be readily snapped or slipped in place on the valve stem. A space between the cap and the adaptor permits the slight vertical movement of the former. It will be understood that the few or minimal components making up the metering actuator assembly may be economically fabricated as plastic moldings or other such or similar readily reproducible material. The cap and adaptor may be readily fabricated in simple mold thereby avoiding any complicated or difficult-to-mold shapes. The cap and adaptor can be molded of a rigid plastic or polyethylene or the like being of a suitable composition that will not react with the formulation or of an appropriate metal.

Figure 2B:
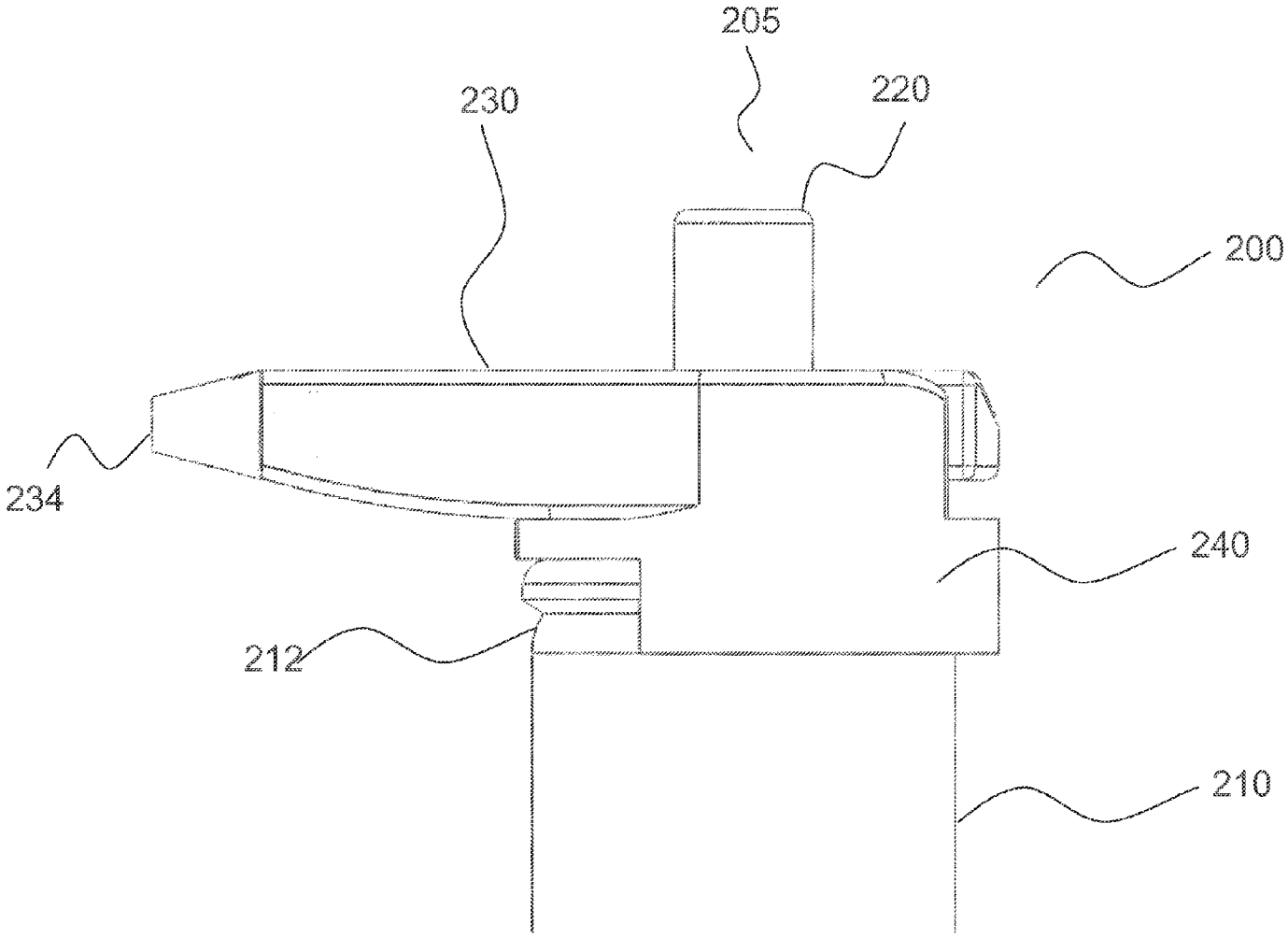
FIG. 2B is a side view of the dispensing assembly disposed on a container that is capable of including a content including an actuator assembly having an integrated cap within a dispensing unit pivotally hinged onto an enclosure unit in an engaged non-actuated state.

A further embodiment of a dispensing assembly 200 is shown in perspective view and side views in FIGS. 2A and 2B, respectively wherein the actuator cap is integrated within and is part of a dispensing unit. The cap can be molded as one unit together with the dispensing unit. According to a different embodiment, the cap can be attachable to the dispensing unit having a slight conical structure where the diameter of the bottom edge of the cap is slightly larger than the top surface of the cap and the diameter of the hole within the dispensing unit.

In operation, the user employs a finger, e.g., a thumb or forefinger on an engageable finger indentation 237, to push down the dispensing unit including actuator assembly indirectly and obtain a standard dose of content instead of directly pressing down on the cap as described earlier. Upon release of the finger the dispensing unit returns to its original position and dispensing ceases.

As shown in FIG. 2A and FIG. 2B the dispensing assembly is disposed on valved-container 210 that is capable of including a content and internal valve assembly (not shown). The dispensing assembly may be readily snapped in place on the container neck portion 212. The dispensing assembly is disposed in flow communication with one end of a container that includes pressurized content. A valve (not shown) is located at one end of the container. The dispensing assembly comprising (i) an actuator assembly 205 which allows a standard quantity of the formulation to be effected and stored upon downward pressure and dispensed upon termination of pressure, (ii) a dispensing unit 230 which allows a standard quantity of the formulation to be dispensed with each actuation; (iii) an enclosure unit 240 securing the dispensing unit to the container. FIG. 2A is a perspective view of the apparatus, wherein a part of the support brace 246 and part of the mounting arms 241 of the enclosure unit have been removed for the sake of clarity to illustrate the positioning of the dispensing unit within the enclosure unit. FIG. 2B is a side view of the apparatus, wherein the support brace of the enclosure unit is shown and mounting arms of the enclosure unit have been removed for the sake of clarity to illustrate the positioning of the dispensing unit within the enclosure unit.

Figure 2C:
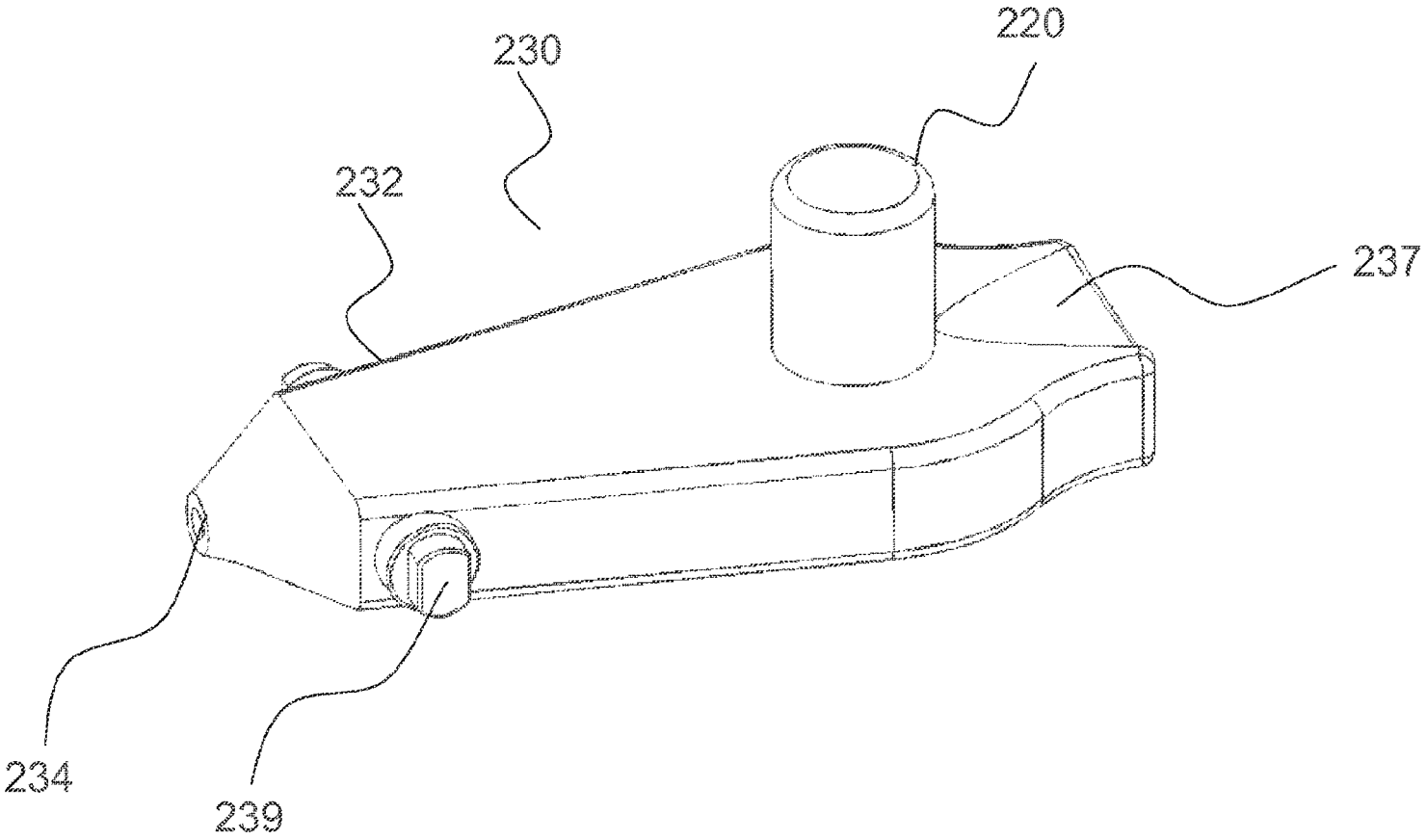
FIG. 2C provides a perspective view of the dispensing unit having an integrated cap.
Figure 2D:
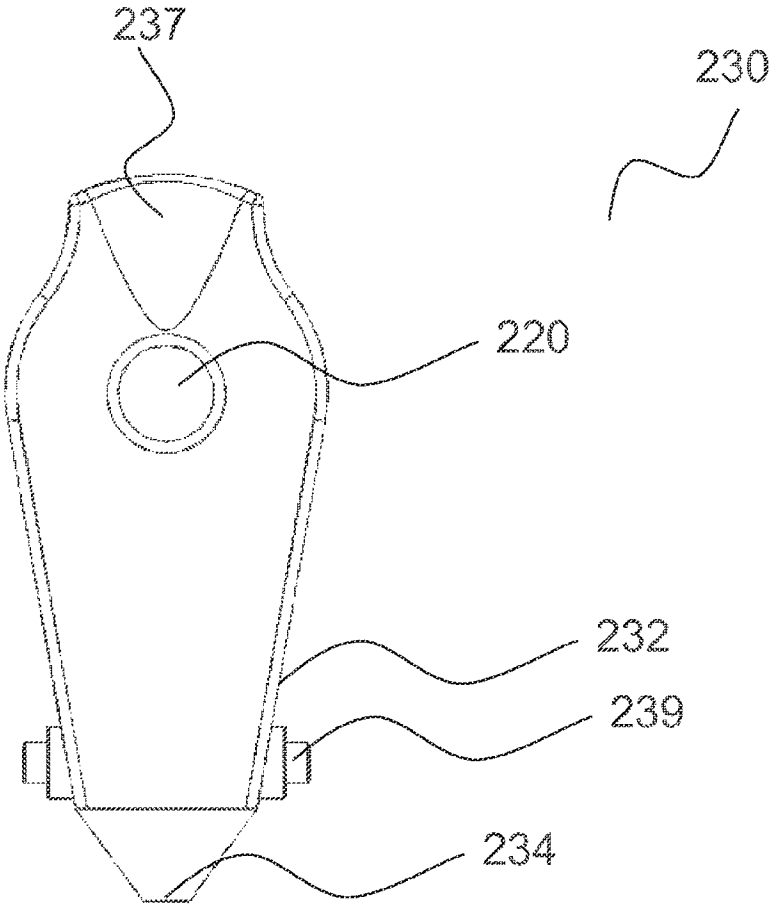
FIG. 2D provides a top view of the dispensing unit having an integrated cap.
Figure 2E:
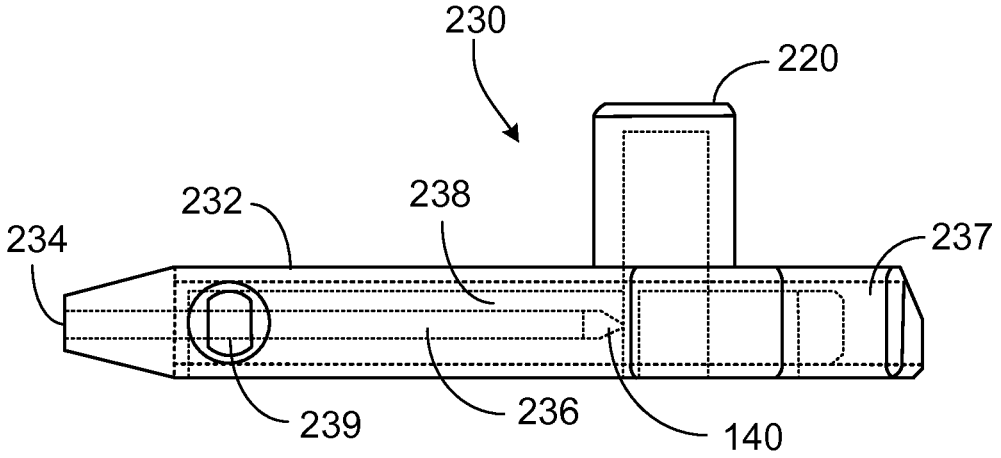
FIG. 2E provides a side and faint outline cross sectional view of the dispensing unit having an integrated cap.

As shown in FIG. 2C and FIG. 2D the dispensing unit 230 includes an integrated cap 220 which can extend beyond the contour surface of the dispensing unit and forms an integral part thereof. The dispensing unit 230 includes a dispensing end 232 which terminates with a discharge nozzle 234. A dispensing conduit 236 (FIG. 2E) is housed within a protective rectangular or tubular conduit housing 238 and is aligned with the discharge passage 140 of the cap for release of materials from container to valve stem, to the discharge passage 140, through the dispensing conduit and out through a nozzle 234. The discharge conduit 236 is in constant flow communication with the discharge passage 140 of the cap 220 and the atmosphere. The conduit may have different diameters. In one or more embodiments the distal end diameter of the conduit may be wider than the proximal diameter. This may be helpful for foamable formulations to allow some expansion of the foam. The shape and size of the diameter of the conduit can influence or control the rate of release and the spread of the formulation depending also on the formulation and expulsion method. (FIG. 2E).

Figure 2F:
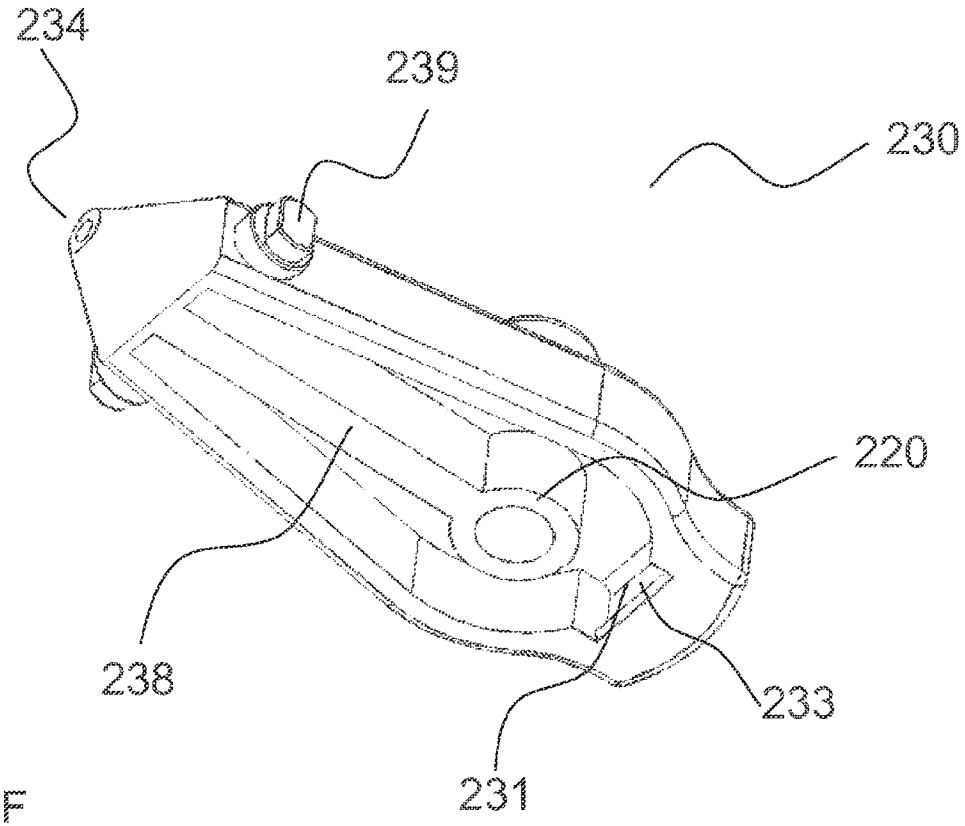
FIG. 2F provides an underneath prospective view of the dispensing unit having an integrated cap.
Figure 2G:
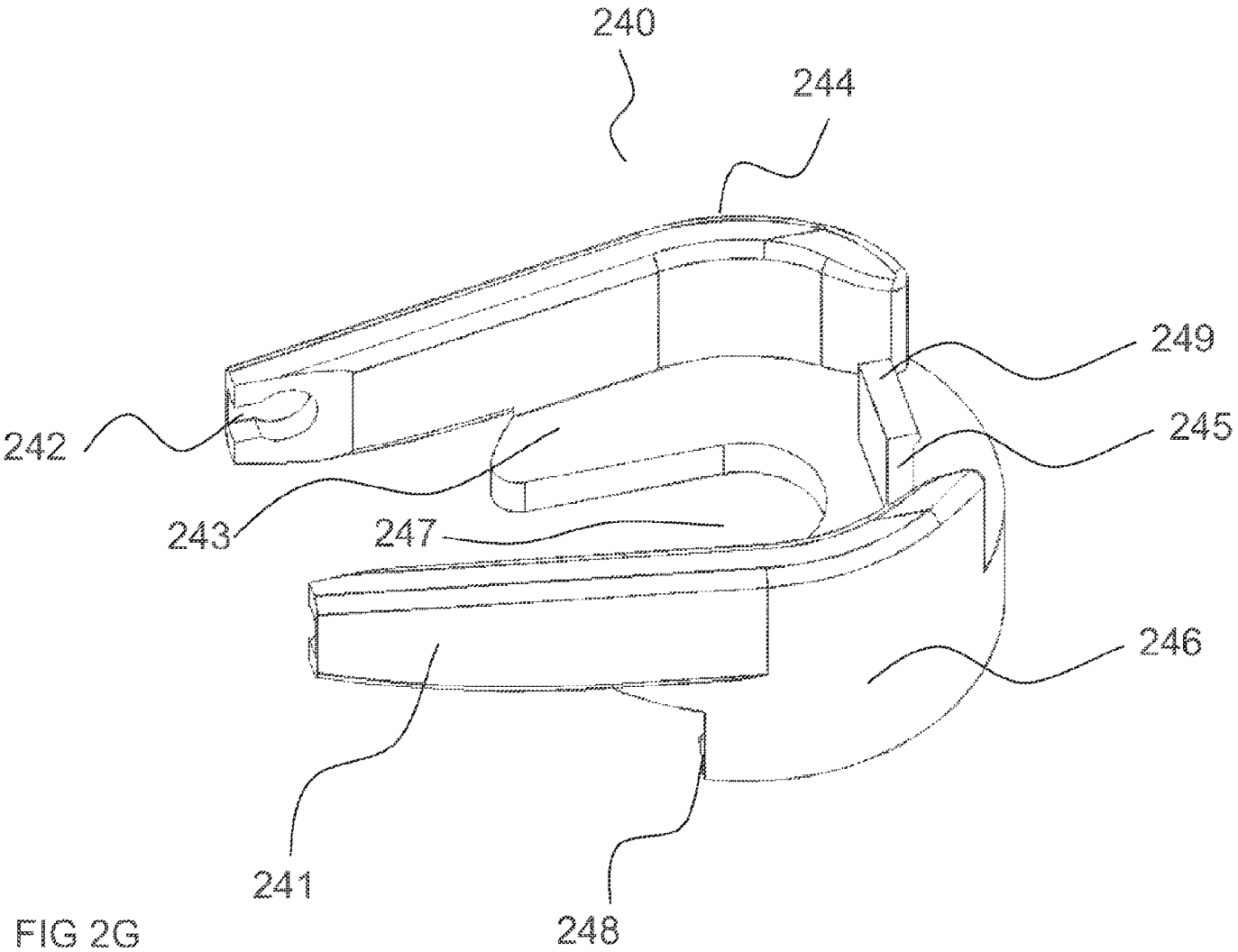
FIG. 2G provides a prospective view of the enclosure unit.

The dispensing unit can be substantially flat and parallel with the top of the cap. As shown in FIG. 2F, in one or more embodiments the bottom side (apart from the integral cap) can be hollow in order to be more cost effective and contains the conduit housing and the bottom edge of the cap. It may also have a notch 231, on the wall underneath the finger engageable indentation 237, with a first surface being a protruding bottom flat surface 233 for engaging or interlocking with a second surface being a protruding top flat surface 249 of at least one resilient edge 245 positioned on the surface 243 of the enclosure unit 240 (FIG. 2G). The engagement of the first and second surfaces provide a locking mechanism for proper positioning of the dispensing unit on the enclosure unit, actuated and post actuated states. It further provides a stop and a resistance to the internal valve spring so that the dispensing unit returns to its proper position in non-actuated state and does not pop off (FIG. 3C). According to a further embodiment the position of the locking mechanism in a non engaged situation (FIG. 3A) can act as an indicator to advise the operator that the apparatus has not yet been used. According to a different embodiment the dispensing unit can be made of two matching top and bottom parts. According to a preferred embodiment the dispensing unit is molded as one integral unit to avoid potential leaks and misalignment.

The dispensing unit has a finger engageable indentation 237 which when depressed causes the entire dispensing unit including the actuator assembly to move downwards on the valve stem resulting in the opening of the valve to permit a predetermined amount of content to be released from the container into the cap metering chamber (FIG. 3B). In one or more embodiments the indentation 237 is slightly tilted downwards and can have a slanted appearance to provide comfort and ease of handling to the user and also to provide eye appeal.

Figure 2H:
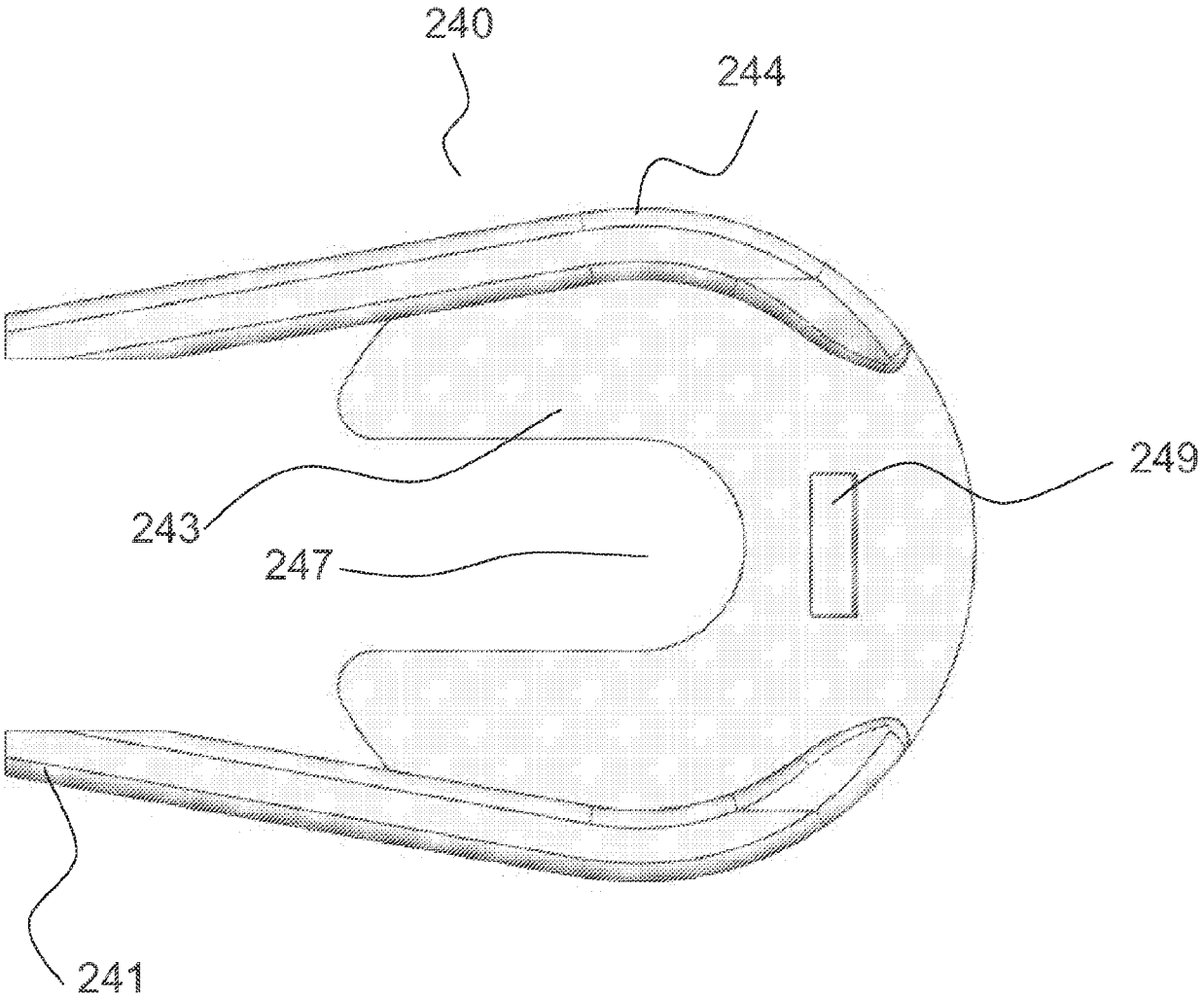
FIG. 2H provides a top view of the enclosure unit.
Figure 2I:
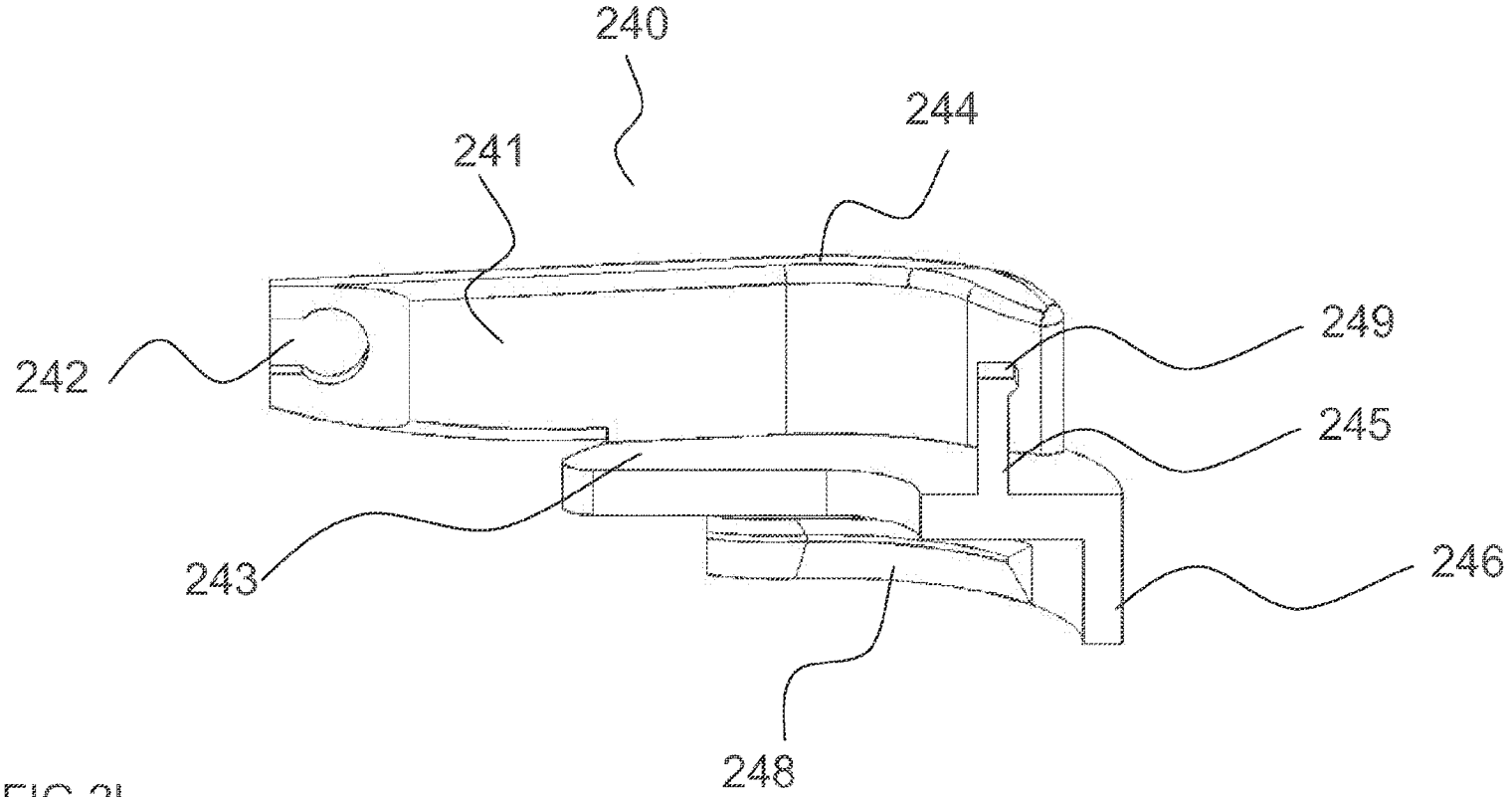
FIG. 2I provides a perspective vertical cross sectional view of the enclosure unit.

As shown in FIG. 2A FIG. 2B and FIGS. 2G-I, the dispensing unit is secured onto the container via an enclosure unit 240. The enclosure unit can be any general geometry; however it typically has curvature to provide comfort and ease of handling to the user and also to provide eye appeal. The enclosure unit encompasses the dispensing unit hence it has a peripheral wall 244 which is shaped to contain the dispensing unit (FIG. 2G). The enclosure unit consists of flat bottom surface 243 which rests on top of the container and sized about the size of the container top. The flat bottom surface 243 has a hole 247 to accommodate the actuator assembly (FIG. 2H). A resilient edge 245 is positioned on the bottom surface 243 having a protruding top surface 249 which engages with the bottom protruding surface 233 of the dispensing unit as described above. The enclosure unit includes mounting arms 241 which terminate with slots 242 or according to a further embodiment includes apertures at locations on either side of dispensing unit for receiving mounting pins 239 of the dispensing unit. The bottom of the peripheral wall 244 of the enclosure unit can include one or more support braces 246. The lower edge of the brace 246 is configured to attach on the top portion of the neck 212 of container 210. The brace 246 can include a circumferential rib 248 that secures the enclosure unit to neck of the container (FIG. 2I). Ribs can be located at regular or random intervals along the inner circumference of the brace as are needed.

As illustrated in FIG. 3, the dispensing unit is pivotally coupled to the enclosure unit to allow movement of the actuator assembly together with the dispensing unit on the valve stem. At initial disengaged non actuated position (unlocked) the dispensing unit is in angle to the enclosure unit (FIG. 3A). The height of the resilient edge 245 will affect said angle, with the higher the edge the larger the angle. Upon initial actuation the two surfaces of the locking mechanism move from a first disengaged (unlocked) state (FIG. 3A) to a second disengaged (locked) state (FIG. 3B). During this time the angle between the dispensing unit and enclosure unit decreases until it is approximately eliminated. Once pressure is released the dispensing unit moves up until the two surfaces are engaged in a third (locked) state and the dispensing unit is at an angle to the enclosure unit (FIG. 3C) albeit at a lesser angle than in the first state (FIG. 3A).

This pivoting motion between actuated (FIG. 3B) and non actuated state (FIG. 3C) is enabled by mounting pins 239 which are located at both sides of the dispensing end 232 of the dispensing unit. The mounting pins are configured to fit slots 242 within the end of mounting arms 241 of the enclosure unit (FIG. 2A, 2C). This assists proper positioning, support and anchorage of the dispensing unit within the enclosure unit in both actuated and non-actuated state as well as good leverage to actuate the apparatus. The dispensing unit may have a shorter or longer dispensing end depending on the leverage desired provided that the position of the mounting pins and length of the mounting arms are accordingly properly adjusted. The mounting pins and slots may positioned closer to the dispensing end or further away from the dispensing end and this will affect the angle of and leverage available between the enclosure and the dispensing unit once it is non-actuated state (FIG. 3C). For example, the closer the mounting pins and slots are to the dispensing end the larger the angle between the enclosure and the dispensing unit and the greater leverage available.

The user depresses the indentation 237 in the dispensing unit, which cause the integrated cap to vertically slide down on the adaptor and depress the ledge of an adaptor which is disposed on a valve stem causing an internal valve 832 to move from a closed position (see FIG. 8 and e.g., FIG. 3C) to an open position (not shown) (see, e.g., FIG. 3B). In the closed position, the channel formed by valve stem is blocked and the contents of container are isolated from the exterior. In the open position, the valve and stem are unobstructed to provide fluid communication with the container interior, allowing contents of container to be dispensed from the container through the valve stem.

In an initial disengaged pre-use state, prior to any actuation, the adaptor, specifically the sealer ring 185 of the adaptor, is positioned below the discharge passage 140 and both the cap and the adaptor are in the raised position free of all external force such as finger pressure, etc. As such, the discharge passage is unobstructed and the metering chamber will have communication with the outside atmosphere via the discharge passage (FIG. 3A). Once external force, such as finger pressure, is applied the cap pushes down the adaptor so that the discharge passage 140 is below the sealer ring of the adaptor, and is sealed off from the metering chamber and may also be obstructed by the side wall of the adaptor. Once the pressure is released the cap and adaptor slide up and the adaptor, including its sealer ring 185, is positioned below the discharge passage. As such, the metering chamber will have communication with the outside atmosphere via a narrow space formed between the top side surface of the adaptor and the inner side cylinder wall and through to the discharge passage (FIG. 3C).

The apparatus can also be adapted for use with dual (FIG. 4) or multiple containers using a dual (FIGS. 4A-D) or multiple dispensing assemblies comprising two or more containers and parallel dispensing units. Further in one or more embodiments a mixer unit (FIG. 7) can be connectively attached to the nozzles or if the nozzles are removable, inserted into hollows left after their removal. When the mixer unit is attached to the dual or multiple dispensing unit it facilitates mixing of simultaneously expelled contents from two or more chambers. Alternatively a split nozzle unit is attached to the nozzles of the dual or multiple dispensing unit for dispensing at least two contents (the same or different) at least at two different locations (e. g. two eyes, two nostrils etc.) (FIG. 6).

As shown in dual chamber apparatus FIGS. 4(A-D), two compressed gas containers 210 are disposed side by side, each for one foamable content, which can be the same or different, wherein both compressed gas containers are each provided with a valve; both valves are actuable in common by dual dispensing assembly 400. The dual dispensing assembly 400 includes two actuator assemblies 405, wherein according to a preferred embodiment, both caps are integrated within a dual dispensing unit 430 which is disposed on a dual enclosure unit 440.

Figure 4A:
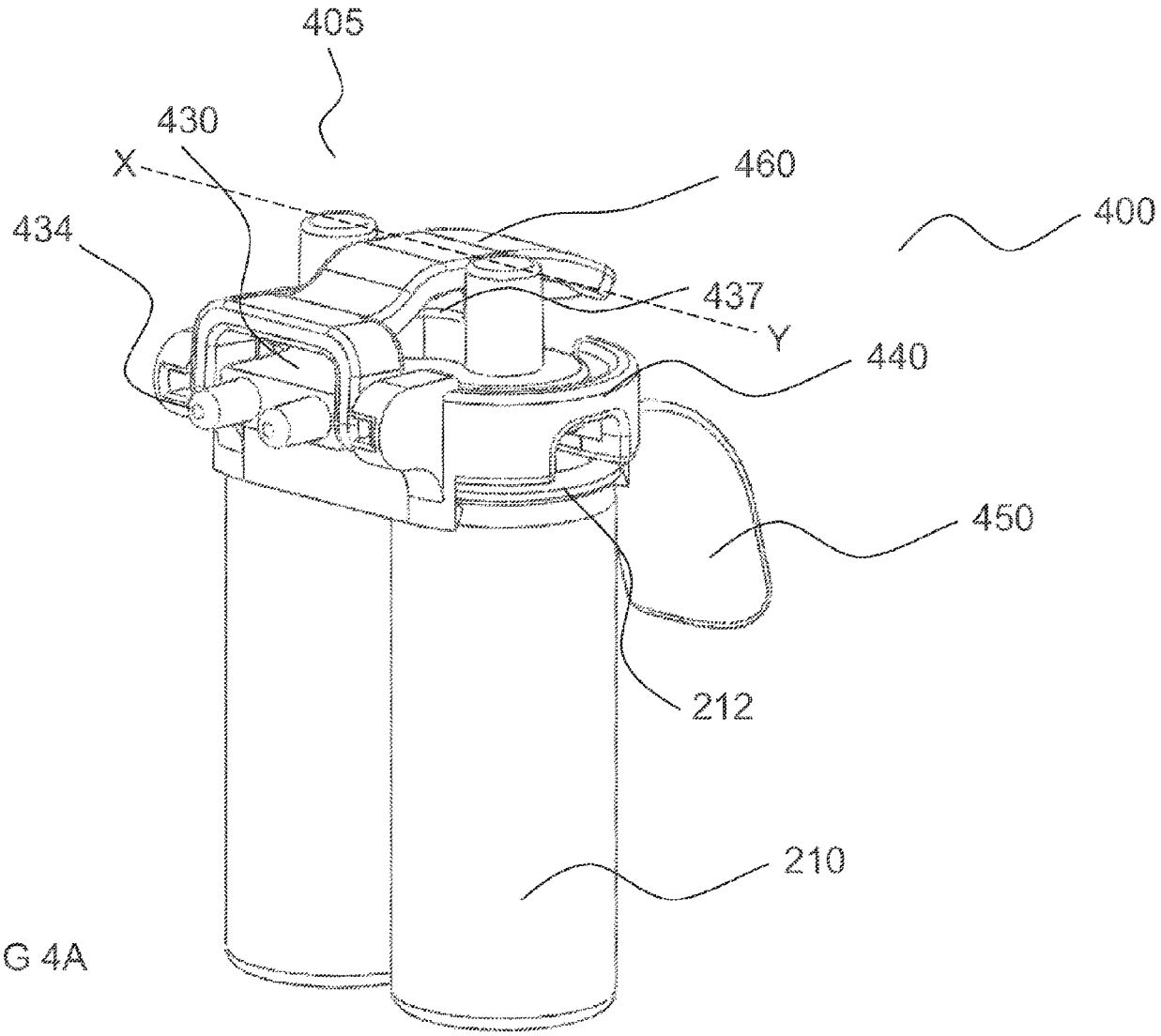
FIG. 4A is a prospective view of a dual chamber dispensing assembly including a double nozzle for dispensing two separate contents (or a combination of said contents by attachment of a mixer unit thereon—not shown).
Figure 4B:
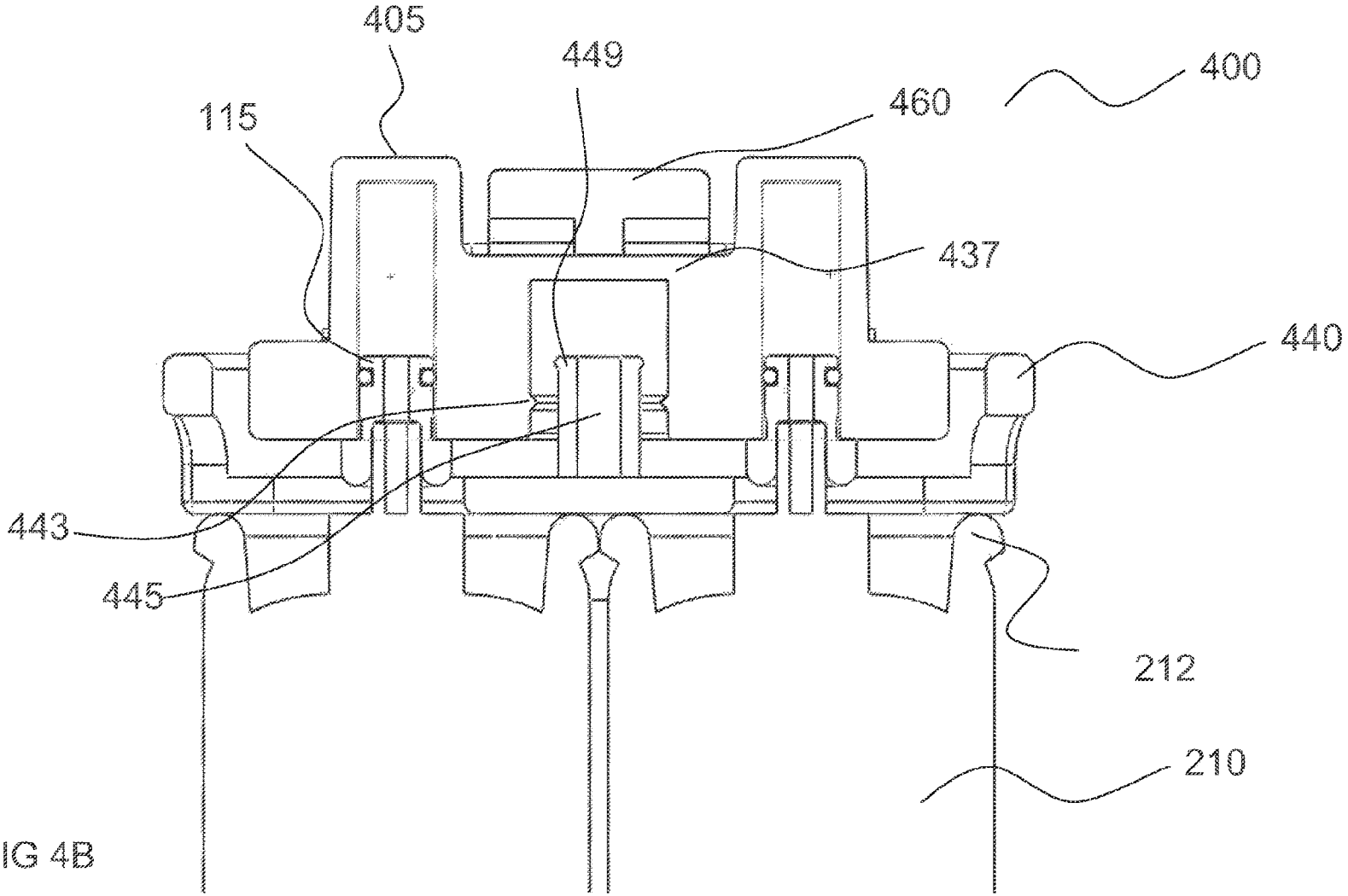
FIG. 4B is a vertical cross sectional view of a dual chamber dispensing assembly (along the X-Y axis in FIG. 4A).
Figure 4C:
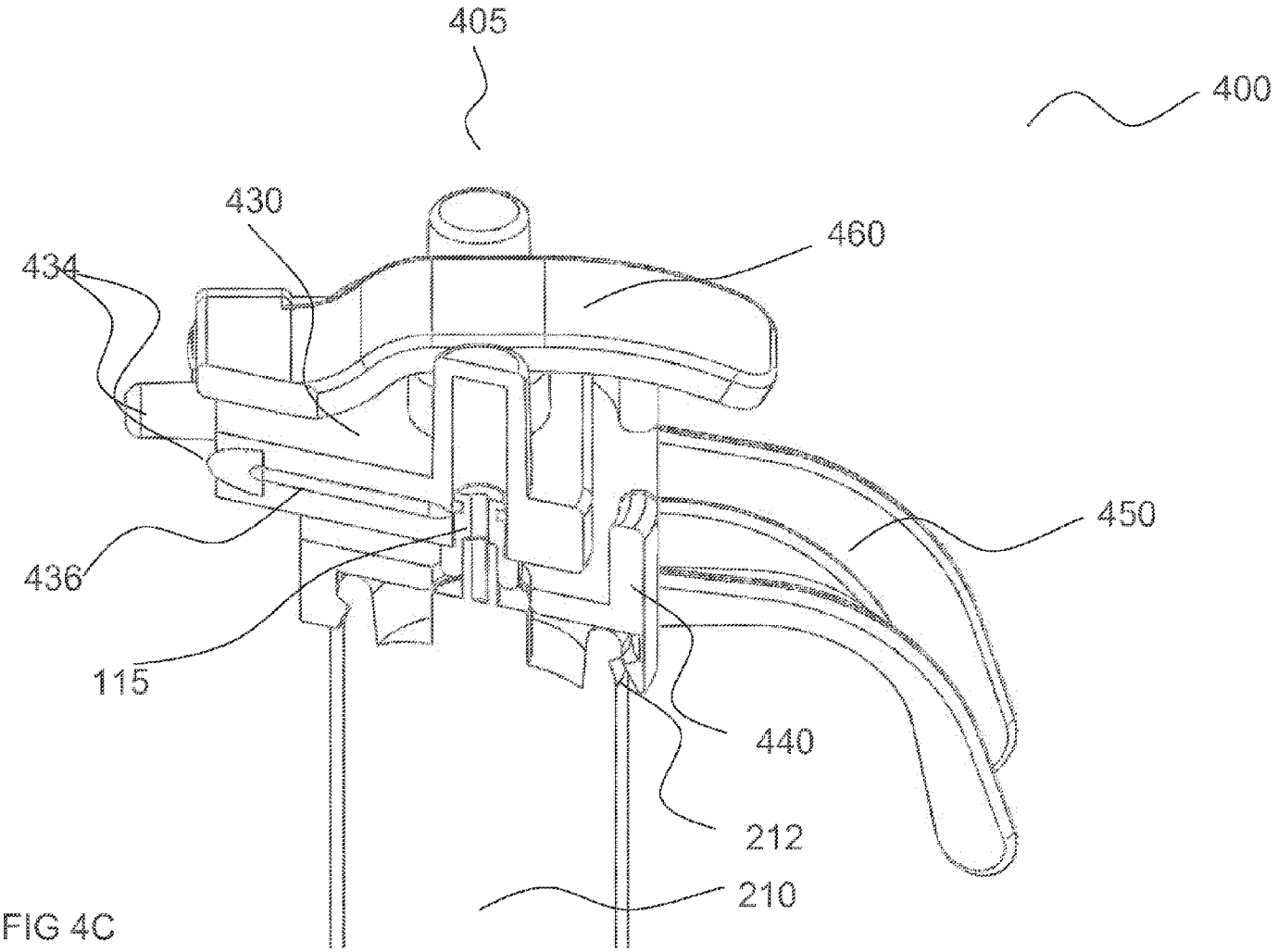
FIG. 4C is a diagonal cross sectional view of a dual chamber dispensing assembly across one canister and dispensing assembly.
Figure 4D:
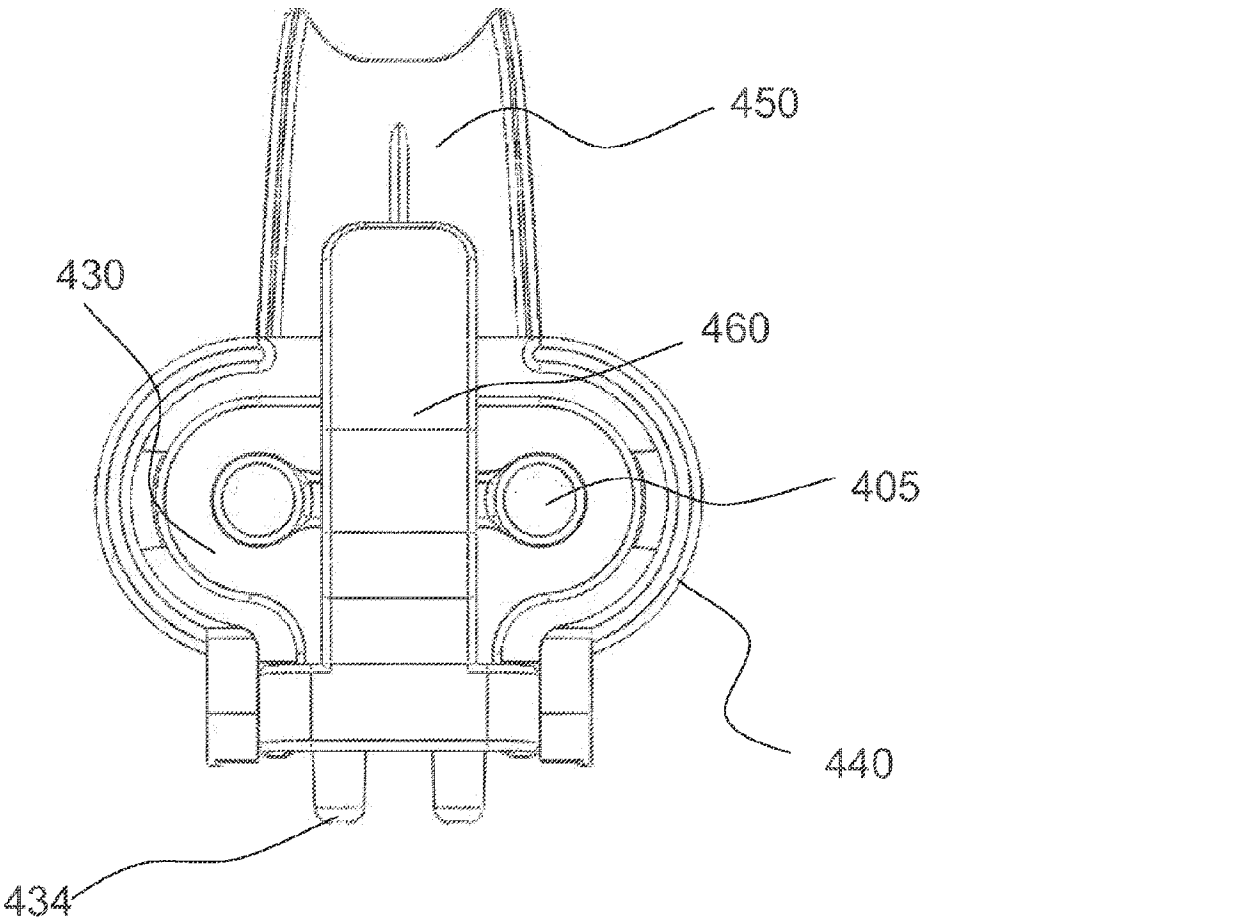
FIG. 4D is a top view of a dual chamber dispensing assembly.

Dispensing assembly 400 is shown in perspective and cross-sectional and top views in FIGS. 4A, B-C and D respectively. Actuator caps are integrated within and form part of the dual dispensing unit 430 and are connected to each other with a hollow finger engageable finger protrusion 437. The caps can be molded as one unit together with the dispensing unit or they can be attachable through two holes at the top surface of the dispensing unit. In operation, according to an embodiment the user holds on to the handle 450 and employs a finger, e.g., a thumb or forefinger on an engageable finger protrusion 437 resulting in the dispensing unit being pushed down. According to a further embodiment an actuating lever 460, is used to push down engageable finger protrusion 437. Upon release of pressure the dispensing unit returns to its original position and releases a standard dose of content from each canister and dispensing ceases. The internal size of the chamber may differ or be the same for each cap. In other words the internal volume for each canister and therefore the standard dose can be the same or different. The dual dispensing assembly may be readily snapped in place on the containers' neck portion 212. The dual dispensing assembly 400 is disposed so that it can be in flow communication with each valve stem end of each of the containers containing a pressurized content.

Figure 4E:
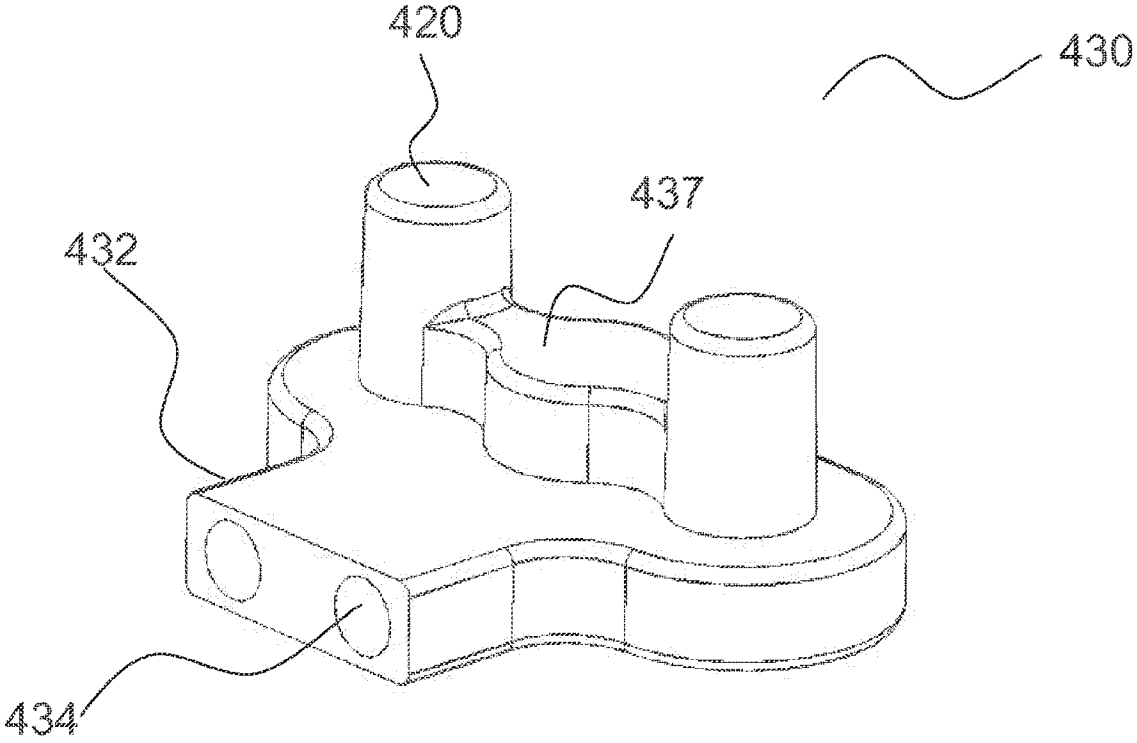
FIG. 4E is a perspective view of the integrated cap within a dual dispensing unit.

As shown in FIG. 4E, according to a first embodiment the dual dispensing unit 430 includes two integrated caps 420 within the dual dispensing unit 430 which can extend beyond the contour surface of the dual dispensing unit 430 and form an integral part thereof. The integrated caps are connected by a flat and hollow engageable protrusion 437 which is fitted onto the resilient edge 445 (FIG. 4B, FIG. 4E) of the dual enclosure unit. This arrangement facilitates simultaneous and similar depression of both actuator assemblies resulting in the opening of the internal valves to permit a predetermined amount of content to be released from each of the containers 210 into the cap metering chambers. This also enables the use of two identical sized or two different sized chambers or different chambers having different internal springs. The dual dispensing unit can be substantially flat and parallel with the top of the caps. According to one embodiment the dispensing unit is assembled from two connectable top and bottom parts which are attached, for example, glued or snapped to each other. In the event the connection has a weakness or is not complete the unit will be susceptible to leakage. According to a preferred embodiment, the dispensing unit is molded as one unit to avoid leakage, spills and misalignments. According to a further embodiment the dual dispensing unit has mounting pins at both sides of the dispensing end which are inserted in the slots within the end of mounting arms of the dual enclosure unit and secure the dual dispensing unit in the enclosure unit. The dual dispensing unit 430 may have a shorter or longer dispensing end 432 provided that the position of the mounting pins and length of the mounting arms of the enclosure unit are properly adjusted.

Figure 4F:
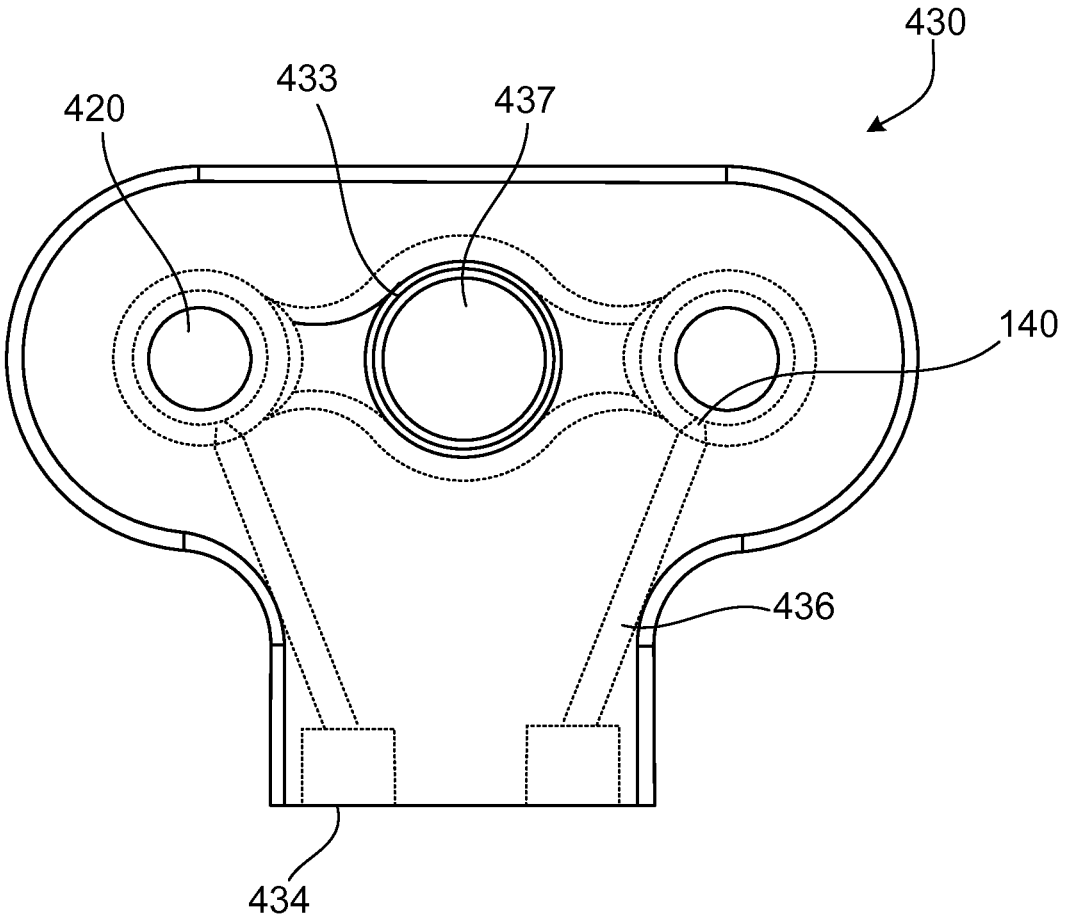
FIG. 4F is a faint outline cross section of a dual dispensing unit.

As shown in FIG. 4F, the dual dispensing unit 430 includes a dispensing end 432 which terminates with two discharge nozzles 434. Two dispensing conduits 436 are aligned with the discharge passages 140 of the caps for release of materials from containers 210 to the nozzles 434. The discharge conduits 436 are in constant flow communication with the discharge passages 140 of the cap 420 and the atmosphere via nozzles 434.

According to one embodiment, the two conduits are straight and terminate with two discharge nozzles. In one or more embodiments the conduits preferably have small cross-sectional areas. This aside from being space effective, helps to ensure that when a content is dispensed, the contents flowing in the conduits remains in a non expanded form. For foamable formulations only once the content is released from each respective nozzle each will expand into a separate foam. In one or more embodiments the conduits 436 may have different diameters, and in the case of foams their distal diameter may be wider than the proximal diameter to allow expansion of foam. The shape and size of their diameter can effect and control the spread of the formulation. In a further embodiment the conduits are arched. In a further embodiment extension nozzles may be added onto said nozzles. In one or more embodiments the extension nozzles are adapted to be compatible with the inlets of a split nozzle or of a mixer unit which respectively facilitates the separation or mixing of two foams.

As seen in FIG. 4E and in FIG. 5 the underneath side of the protrusion 437 is a hollow for receiving at least one resilient edge 445 from the enclosure unit. The bottom part of the hollow has at least one first surface being a protruding bottom flat surface 433 for engaging second surface being a protruding top flat surface 449 (at least one) of at least one resilient edge 445 positioned on the bottom flat surface 443 of the enclosure unit (FIG. 5A-F). The engagement of the first and second surfaces provides a locking mechanism for proper positioning of the dual dispensing unit on the dual enclosure unit. It further provides a stop and a resistance (to the effect of the upward force of the movement of the internal valve spring plus the upwards force of the propellant in the content as it enters into the metering chamber) so that the dual dispensing unit returns to its proper position in non-actuated state (FIG. 5E, 5F). According to a further embodiment the locking mechanism can also ensure that apparatus has not yet been used when it is in a disengaged position (FIG. 5A,5B).

Figure 4G:
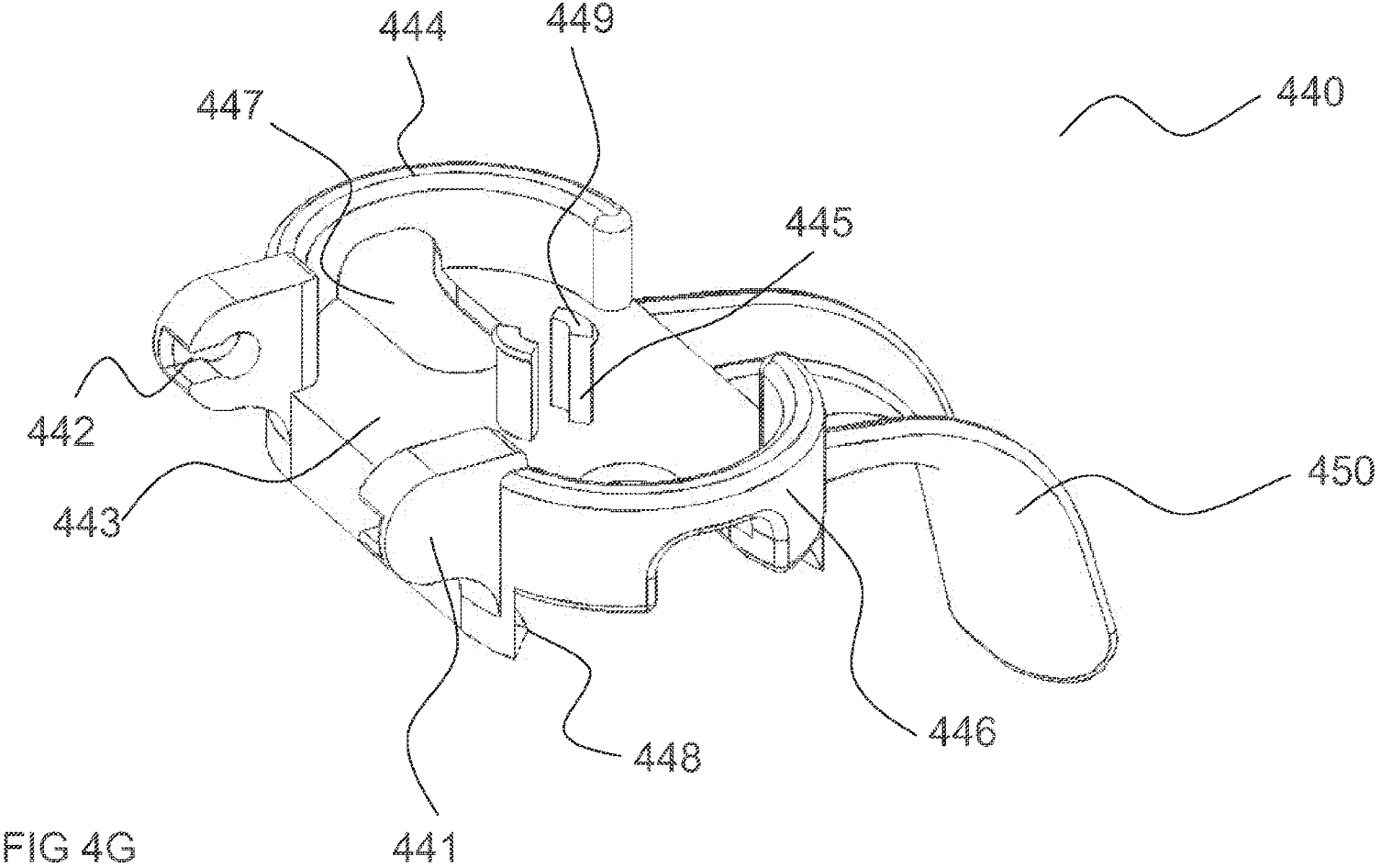
FIG. 4G is a perspective view of a dual enclosure unit.
Figure 4H:
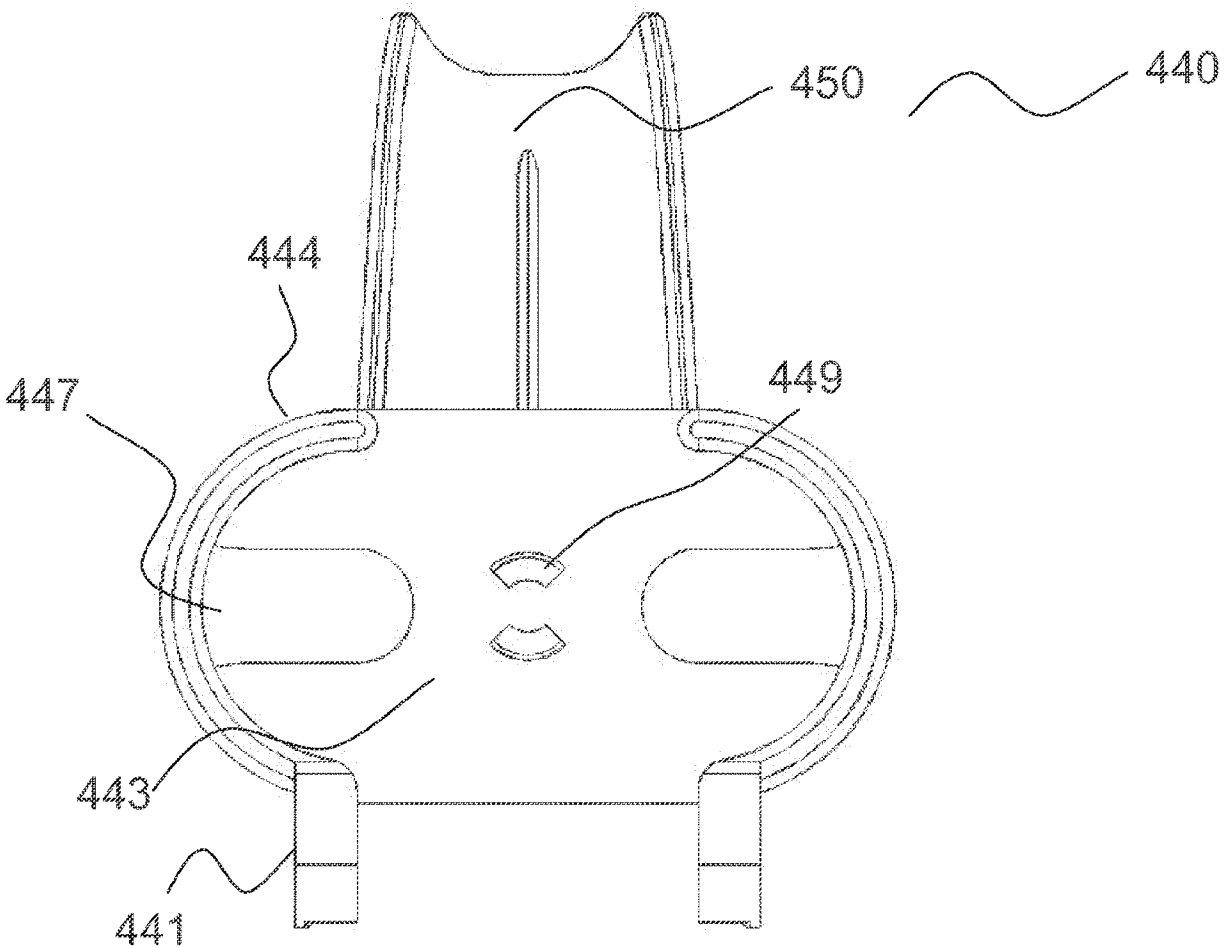
FIG. 4H is a top view of a dual enclosure unit.

As shown in FIG. 4A, the dual dispensing unit is secured onto the container via a dual enclosure unit 440. As depicted in FIGS. 4G,H, the enclosure unit can be of any general geometry; however it typically has curvature to provide comfort and ease of handling to the user. The dual enclosure unit encompasses the dual dispensing unit hence it has a peripheral wall 444 that is similarly shaped to that of the dispensing unit. The enclosure unit includes a flat bottom surface 443 which rests on top of the containers and sized about a size to accommodate two container tops. The flat bottom surface 443 (see FIG. 4H) has at least two holes 447 to accommodate at lest two actuator assemblies. At least one resilient edge 445 is positioned on and protruding at right angles from the bottom surface 443 each resilient edge having a protruding top surface 449 which engages with the bottom protruding surface 433 of the dispensing unit as described above. The enclosure unit includes mounting aims 441 which terminate with slots 442 or according to a further embodiment includes apertures at locations on either side of dispensing unit for receiving mounting pins 469 of the lever 460. In accordance with another embodiment the enclosure unit can include slots for receiving the mounting pins of the dual dispensing unit. The bottom of the peripheral wall 444 can include one or more support braces 446. The lower edge of the brace 446 is configured to attach on the top portion of the necks 212 of containers 210. The brace 446 can include a circumferential rib 448 that secures the enclosure unit 440 to necks 212 of the containers. Ribs can be located at regular or random intervals along the inner circumference of the enclosure unit.

Figure 5A:
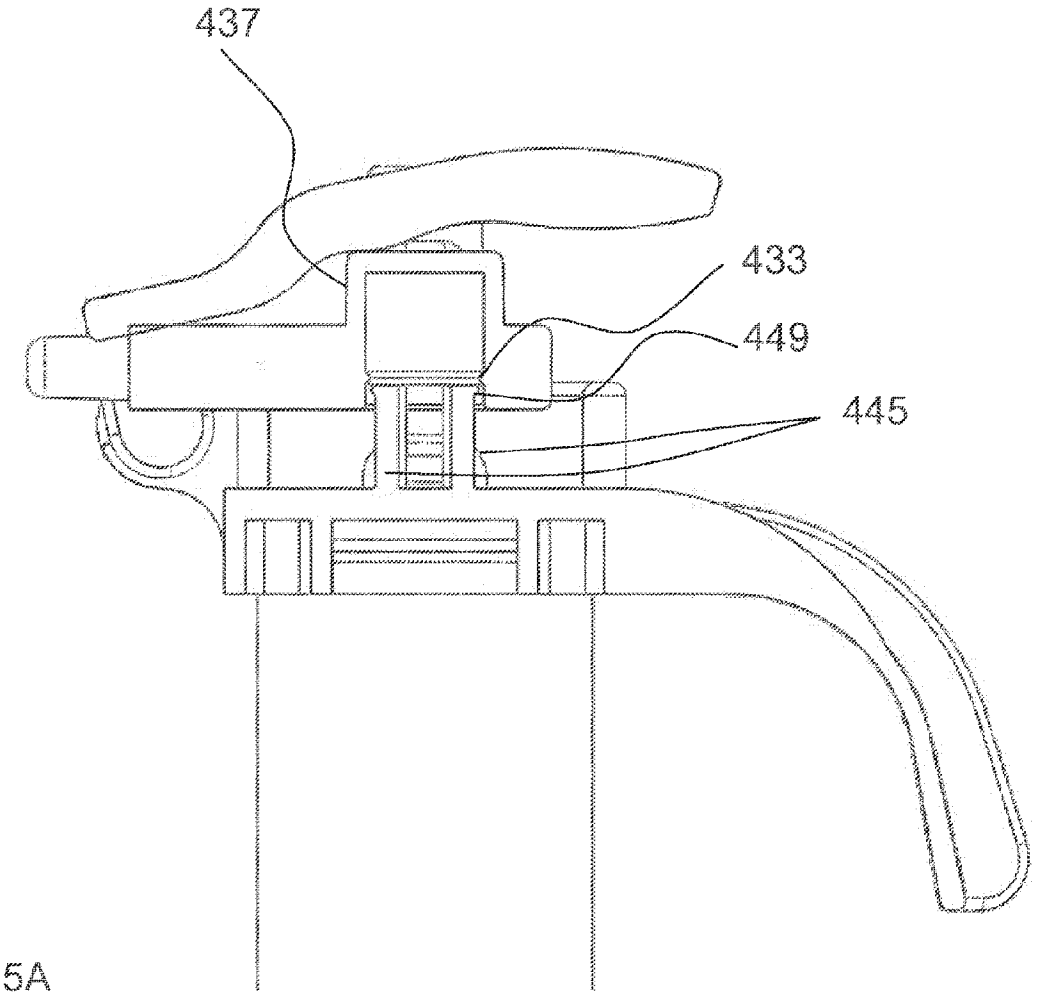
FIG. 5A is a side view of a disengaged dual chamber dispensing assembly (unlocked) wherein the dual dispensing unit is coupled onto the dual enclosure unit.
Figure 5B:
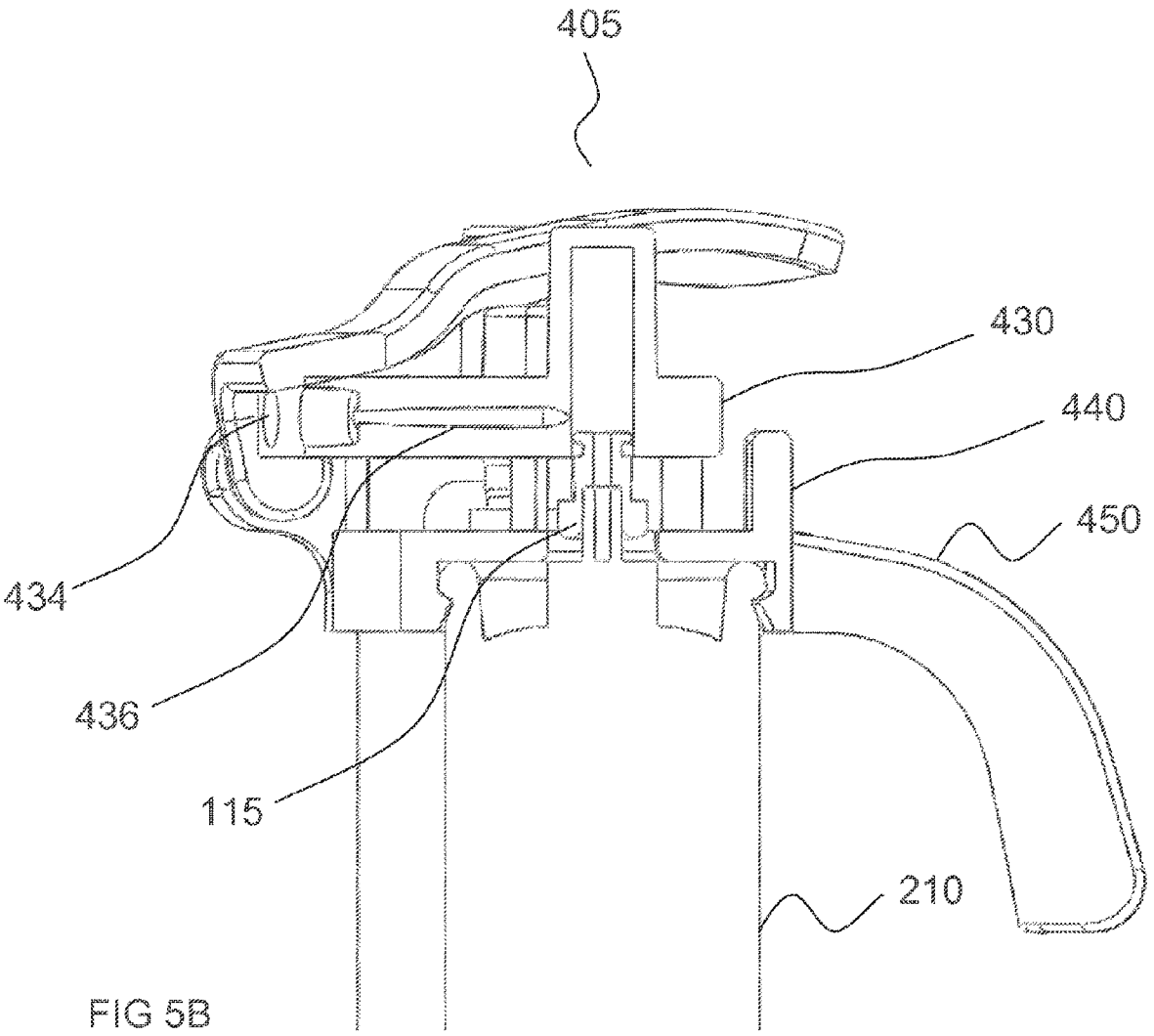
FIG. 5B is a vertical cross sectional view of 5A namely a disengaged dual chamber dispensing assembly (unlocked) through one of the actuator assemblies, conduit of the dispensing unit and containers, wherein the dual dispensing unit which is coupled onto the dual enclosure unit.
Figure 5C:
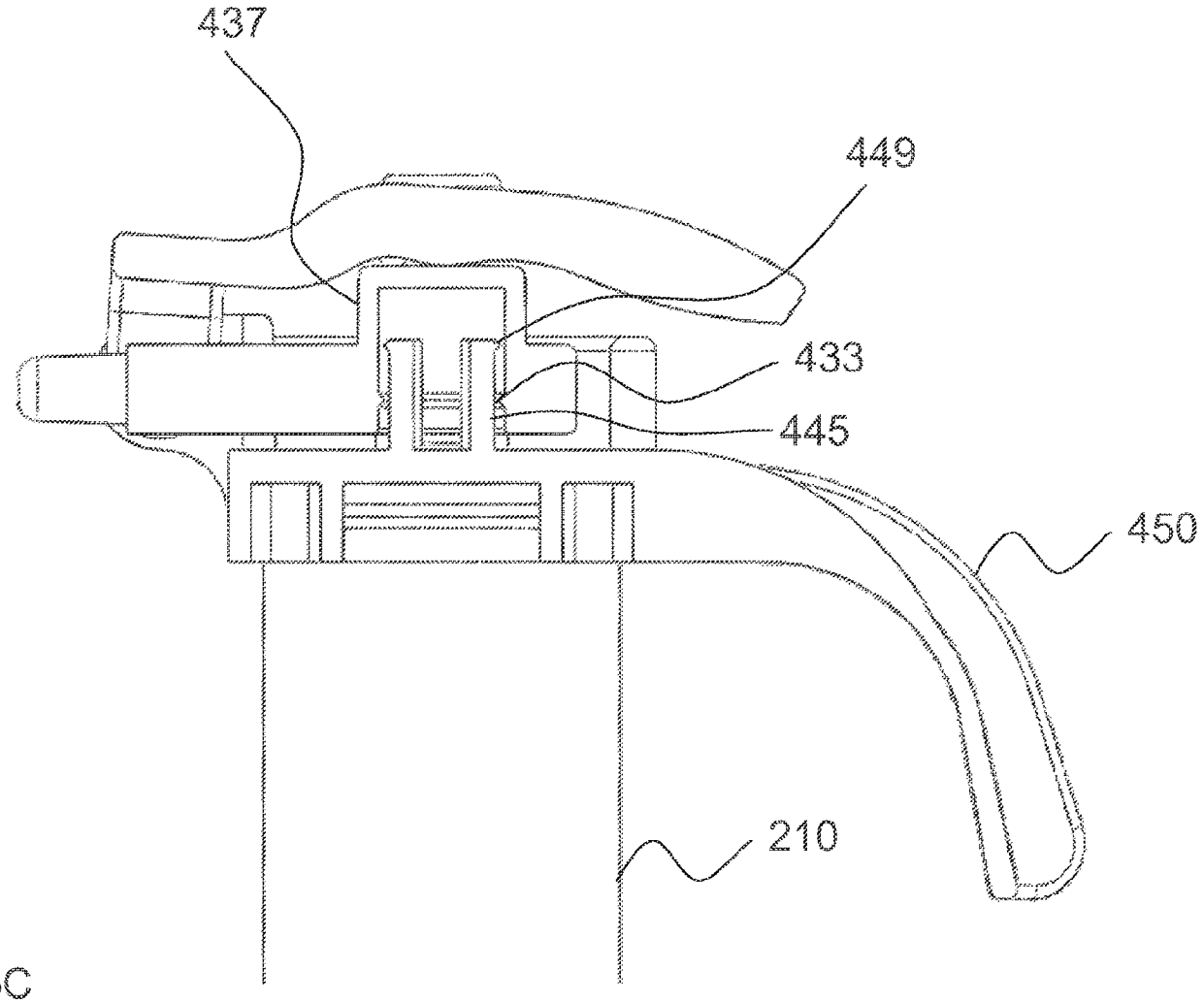
FIG. 5C provides a side view of a disengaged dual chamber dispensing assembly (locked), wherein the dual dispensing unit, which is coupled onto the dual enclosure unit, is in an actuated state, where content is released from container and stored in the metering chamber.
Figure 5D:
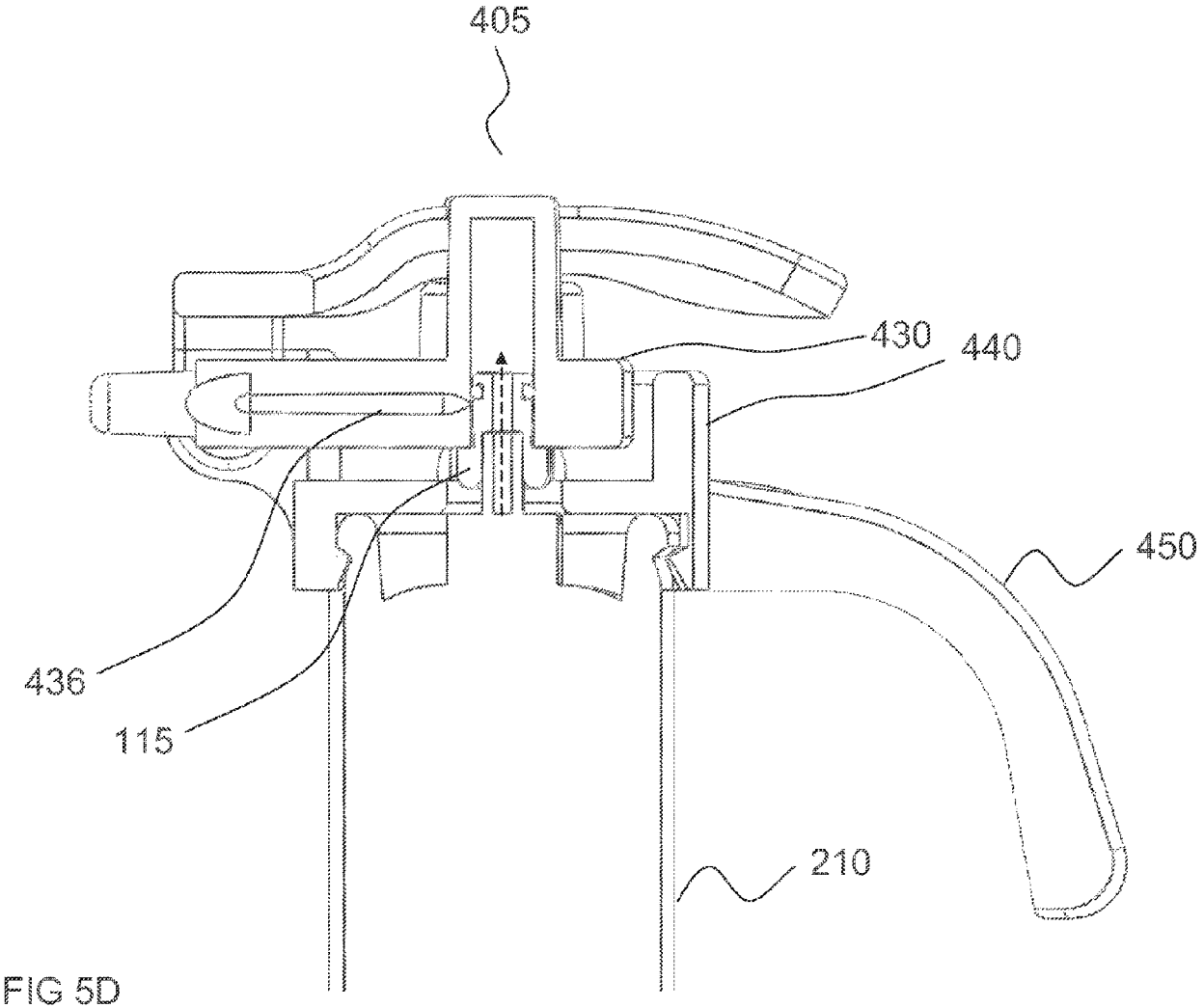
FIG. 5D provides a vertical cross sectional of a disengaged dual chamber dispensing assembly (locked), wherein the dual dispensing unit, which is coupled onto the dual enclosure unit in an actuated state where content is released from container and stored in the metering chamber.
Figure 5E:
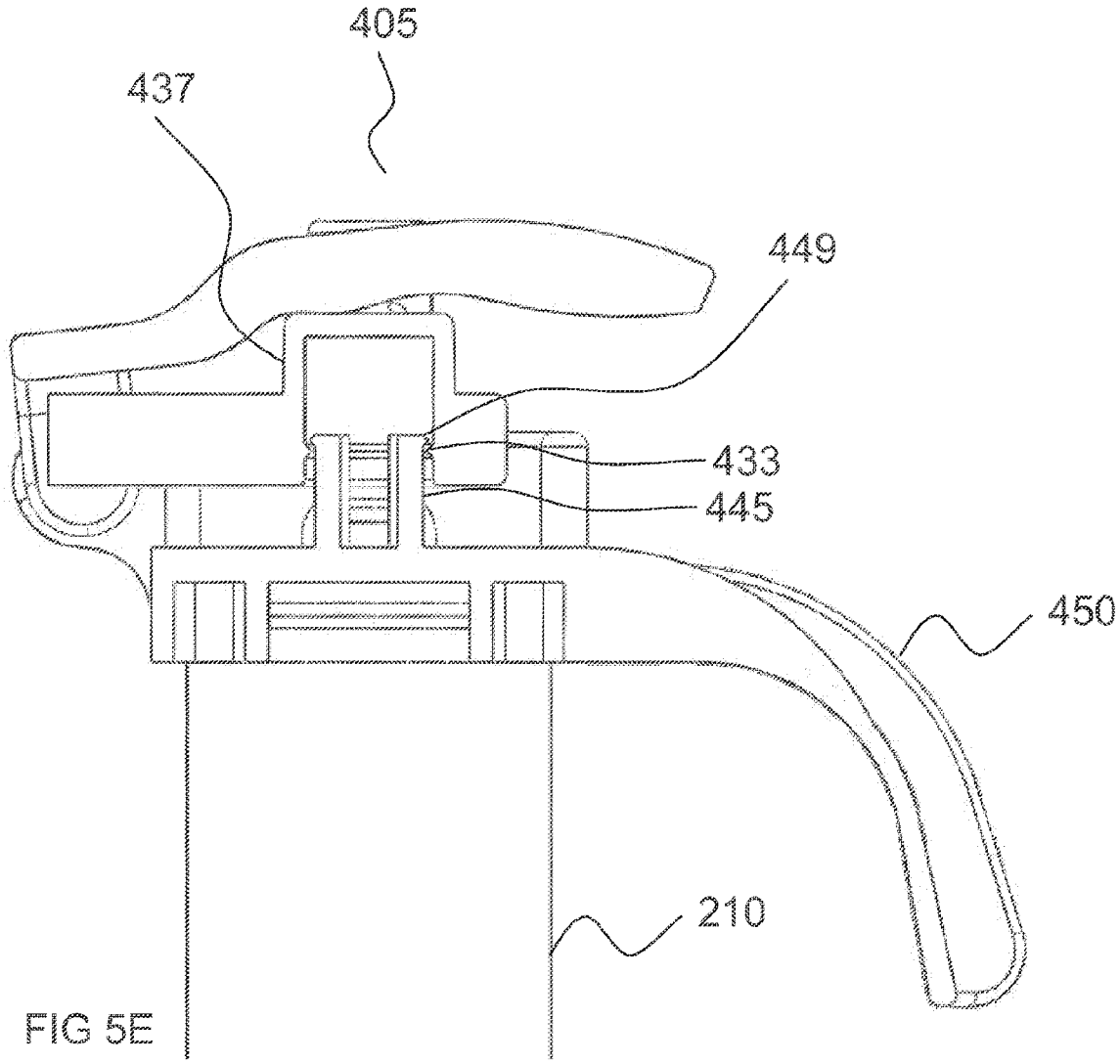
FIG. 5E provides a side view of an engaged dual chamber dispensing assembly (locked) wherein the dual dispensing unit, which is coupled onto the dual enclosure unit in a non-actuated state (post actuated) where content is released from the metering chamber.
Figure 5F:
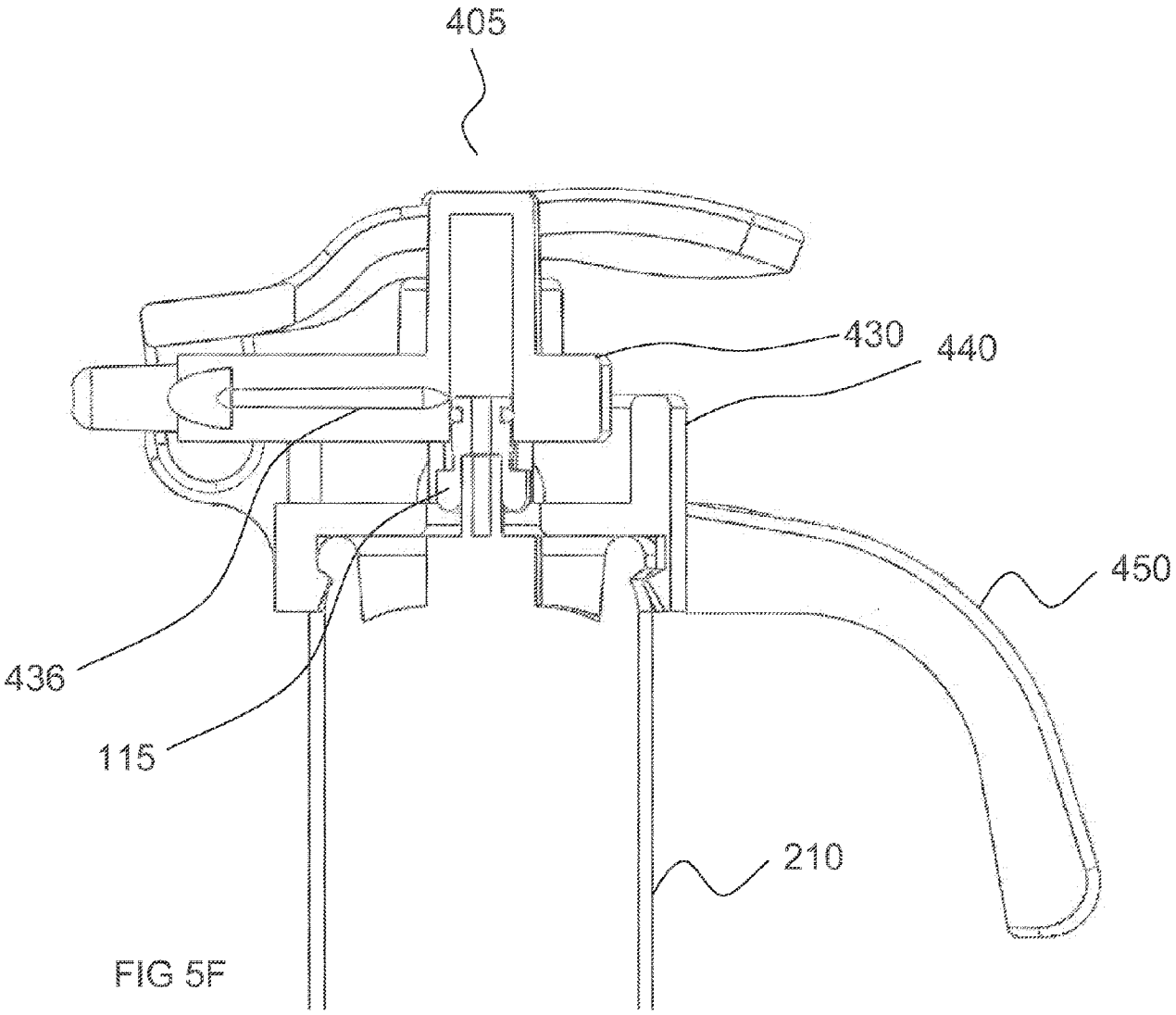
FIG. 5F provides a vertical cross sectional view of a an engaged dual chamber dispensing assembly (locked), wherein the dual dispensing unit which is coupled onto the dual enclosure unit in a non-actuated state (post actuated) where content is released from metering chamber.

In use, the user holds onto the handle 450 and depresses engageable protrusion 437, causing the dual dispensing unit comprising the integrated caps to move vertically down from a first initial unlocked position non actuated position (see, e.g., FIG. 5A,B) to a second actuated position locked position (see, e.g., FIG. 5C,D) to a third non actuated locked position (see, e.g., FIGS. 5E and F). The mechanism of operation and the locking mechanism is the same principle mutatis mutandis as that described for the single dispensing assembly.

Figure 4I:
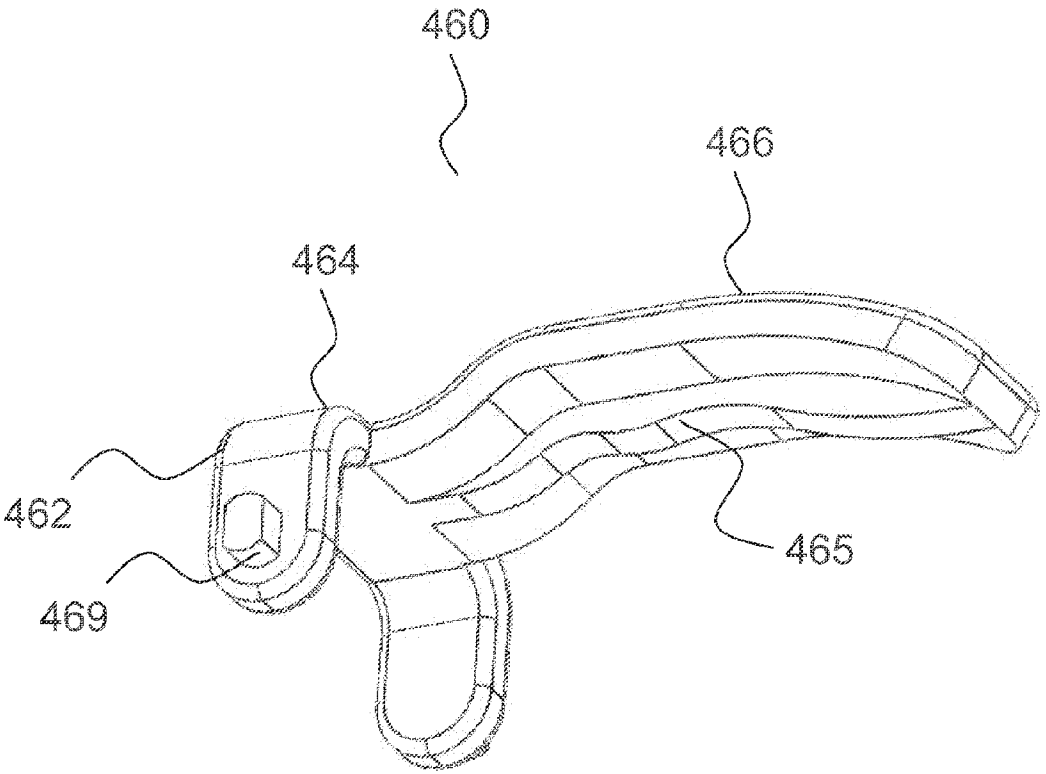
FIG. 4I is a perspective view of a lever.

According to a further embodiment leverage is obtained by adding an actuating lever 460 which when actuated depresses the engageable protrusion (FIG. 4I). Mounting pins 469 are located at both sides of the outer surface of two legs 462 of the bridge 464. The mounting pins 469 are configured to fit slots 442 within the end of mounting arms 441 of the enclosure unit. This allows the pivoting motion of the lever. The bridge is positioned over the dual dispensing unit and the curved tail 466 with protruding rib 465 is positioned over the finger engageable protrusion 437 of the dispensing unit. In use, the user holds onto the handle 450 and depressed the edge of the tail 466 with his/her thumb and the rib depresses an engageable protrusion 437, causing the dual dispensing unit comprising the integrated caps to move vertically down from a first non actuated position (see, e.g., FIGS. 5E and F) to a second actuated position (see, e.g., FIG. 5C,D).

Figure 6A:
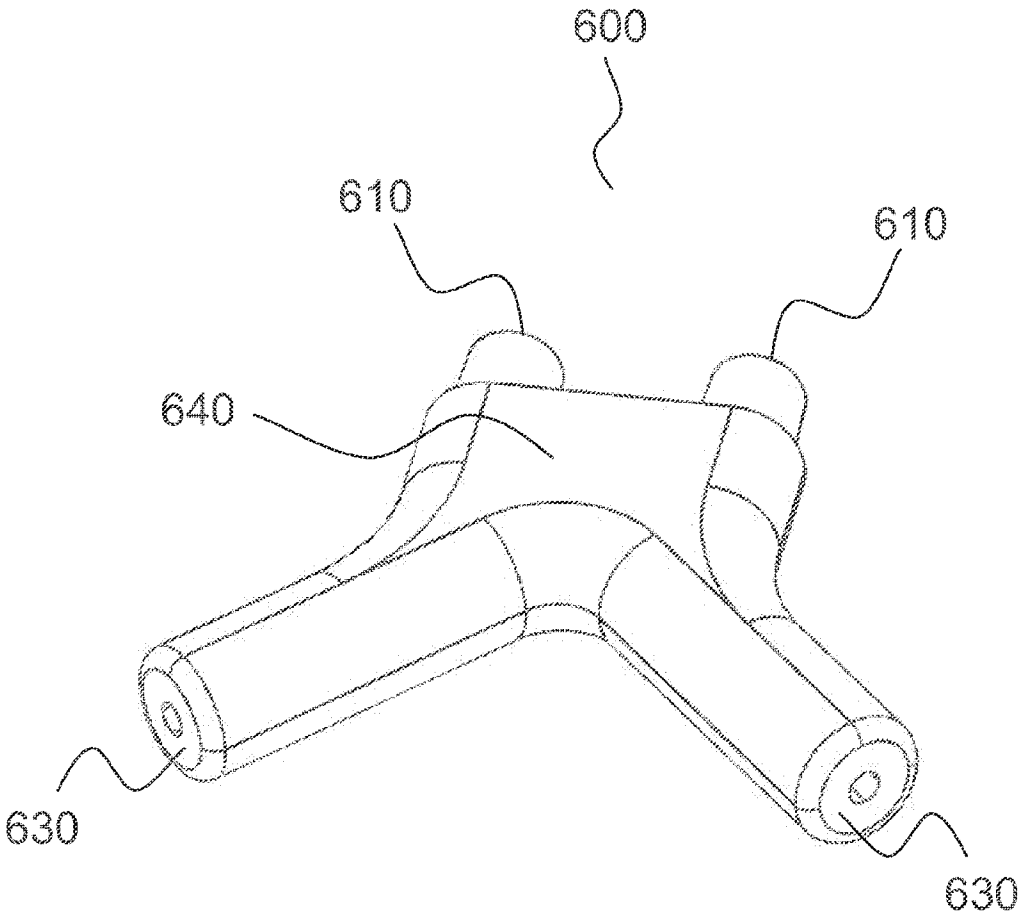
FIG. 6A is a prospective view of a split nozzle for dispensing two separate contents attachable to the nozzles of a dual chamber dispensing assembly.

In one or more alternative embodiments, a split nozzle 600 can be attached to the nozzles 434 of the dual dispensing unit 430 for simultaneously dispensing two separate contents (identical or different) at two different locations (e.g. two eyes, two nostrils etc.) (FIG. 6). The split nozzle includes two outlets 630 from which two separate contents are expelled and two inlets 610 in a diameter and shape suitable for snuggly receiving or being inserted into the nozzles of the dual dispensing unit. The two outlets are configured at an angle to each other suitable for the intended application. The body 640 can be substantially flat. According to one embodiment the split nozzle is assembled from two compatible parts which are attached to each other. According to a preferred embodiment, the dispensing unit is molded as one unit to avoid leakage, spills and misalignments (FIG. 6A).

Figure 6B:
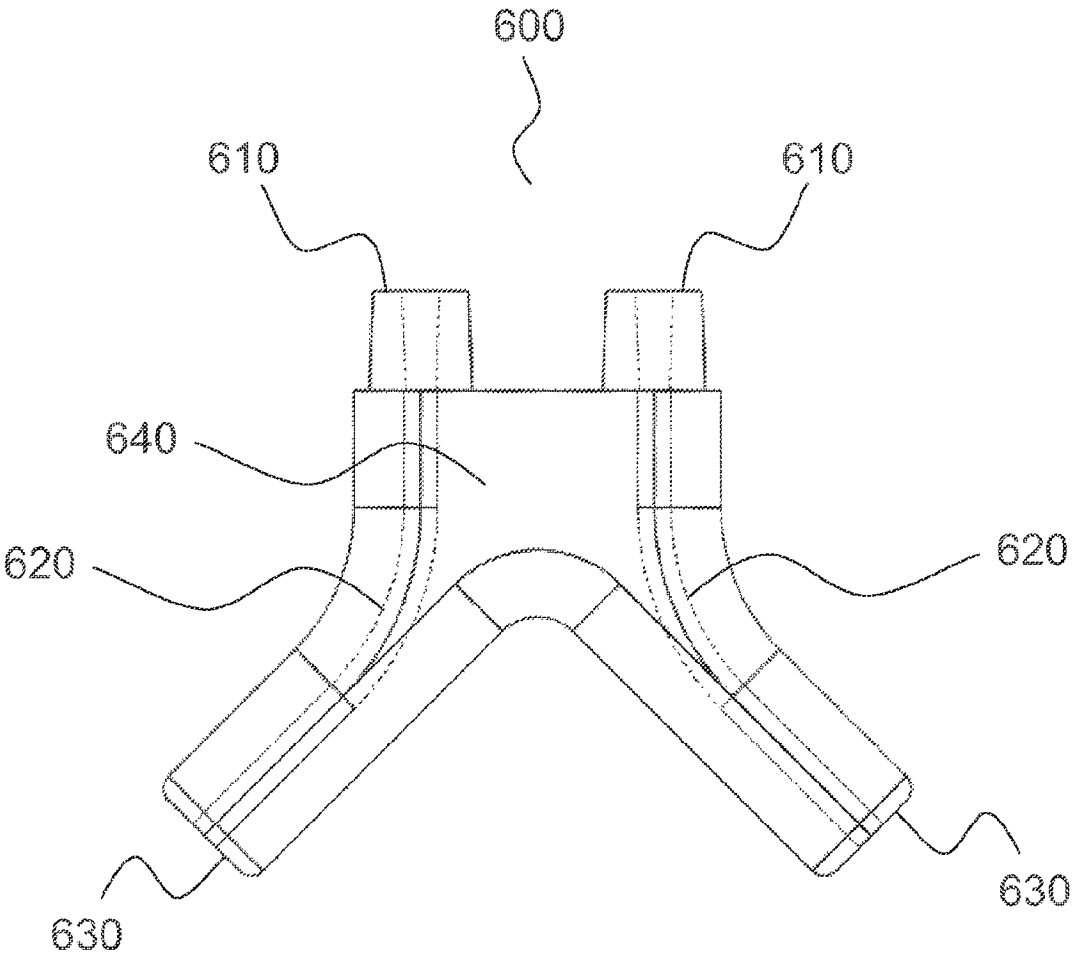
FIG. 6B is a cross sectional view of a split nozzle for dispensing two separate contents attachable to the nozzles of a dual chamber dispensing assembly.

Two conduits 620 deliver the separate contents form the inlets 610 to the outlets 630. According to one embodiment, the two conduits are straight and terminate with two discharge nuzzles. The conduits preferably have small cross-sectional areas. This, aside from being space effective, ensures that when a content is dispensed, the contents flowing in the conduits remains in a non expanded form. Only once the content if foamable, is released from each respective nozzle it will expand into a separate foam. The conduits 620 may have different diameters, and in the case of foams their distal diameter may be wider than the proximal diameter to allow proper expansion of the foam. The shape and size of their diameter controls the spread of the formulation. According to another embodiment the conduits are arched, however, they can be any shape which facilitates proper expulsion (FIG. 6B).

Figure 7A:
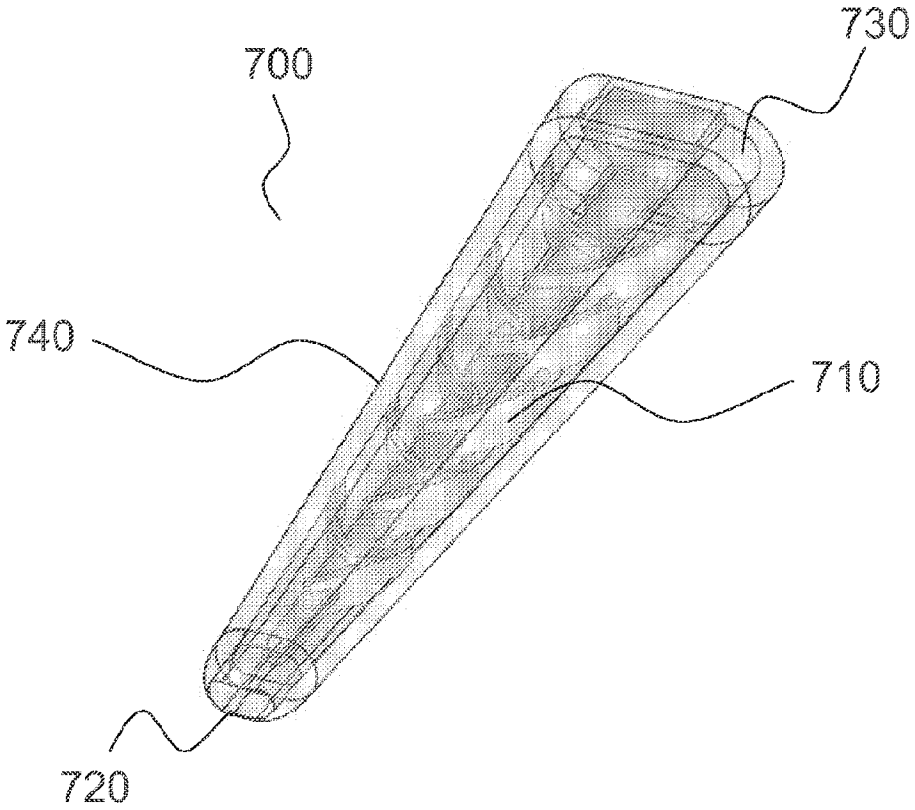
FIG. 7A is a prospective view of a paddle mixer unit.
Figure 7B:
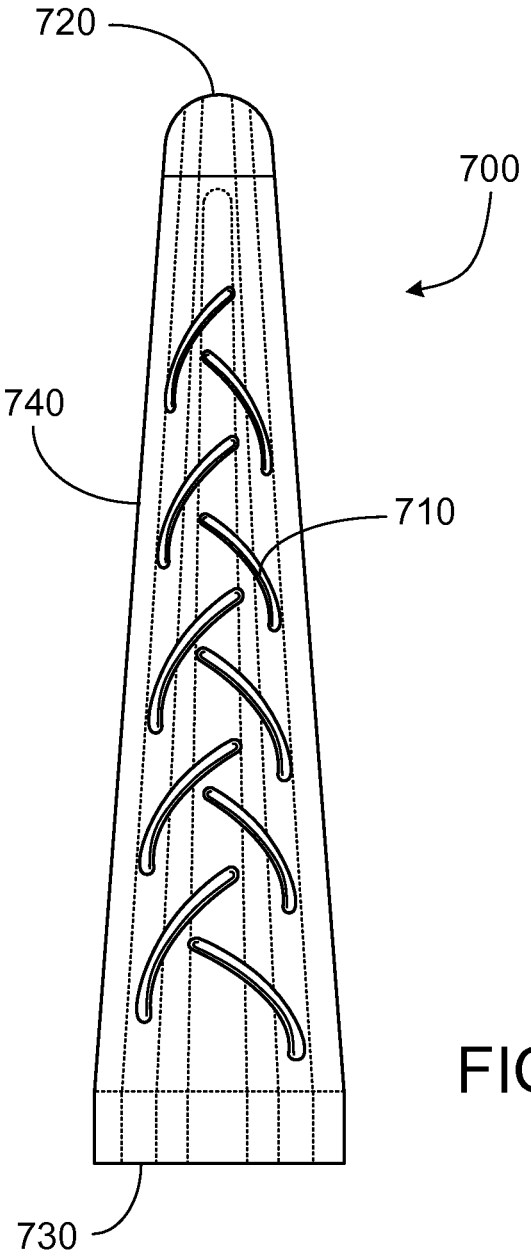
FIG. 7B is a cross-sectional illustration of a paddle mixer unit.

FIGS. 7A and 7B are illustrations of a paddle mixer unit 700 according to one or more embodiments. The mixer unit 700 includes a series of alternating curved or straight surfaces 710 or paddles or angled dove tailing blades within an elongated body 740. The mixer unit includes an outlet 720 from which the mixed content is expelled and two inlets 730 in a diameter suitable for snuggly receiving or inserting into nozzles of the dual dispensing unit. In one or more embodiments the mixer may include a rotating wheel with a number of curved surfaces or paddles or angled dove tailing blades.

Figure 7C:
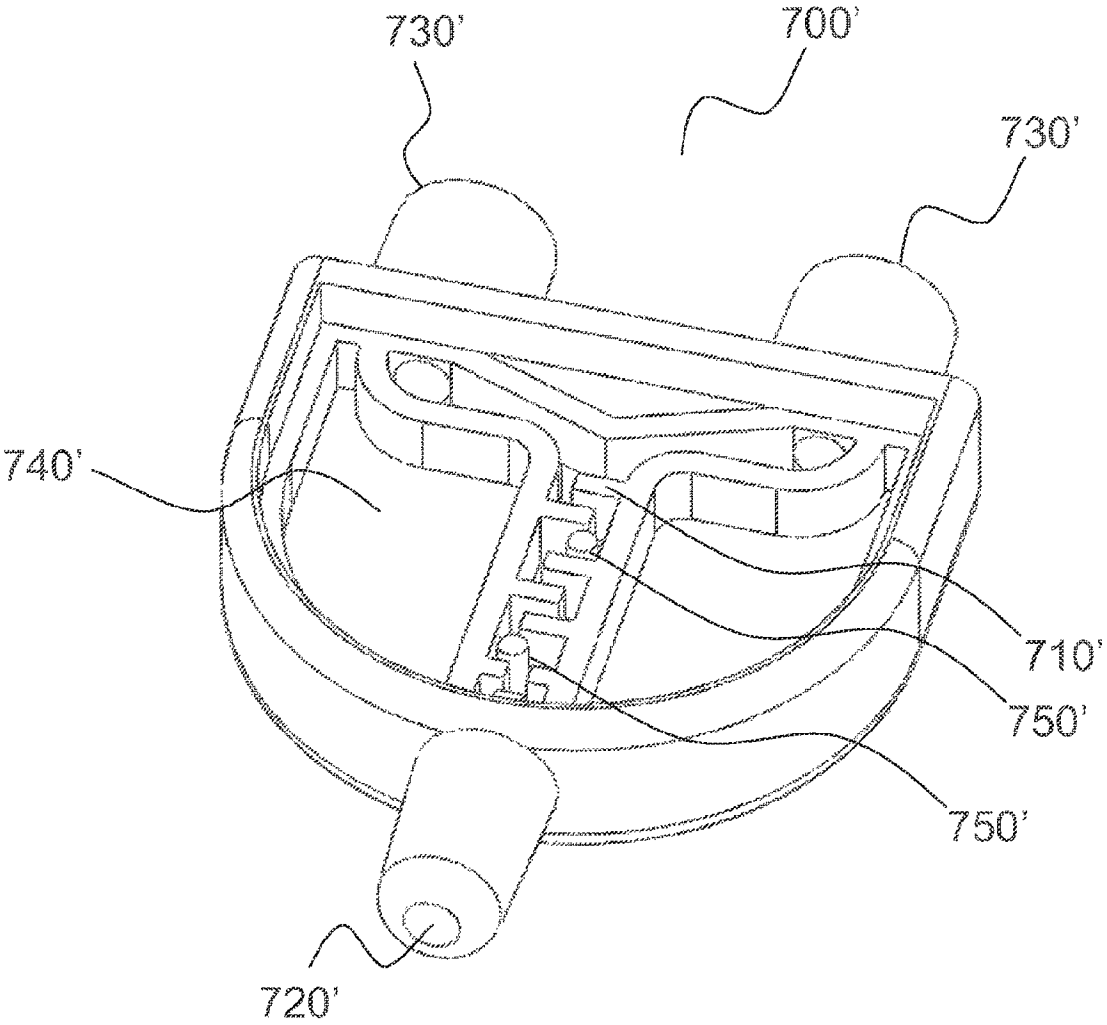
FIG. 7C is a cross-sectional prospective view of a maze mixer unit.
Figure 7D:
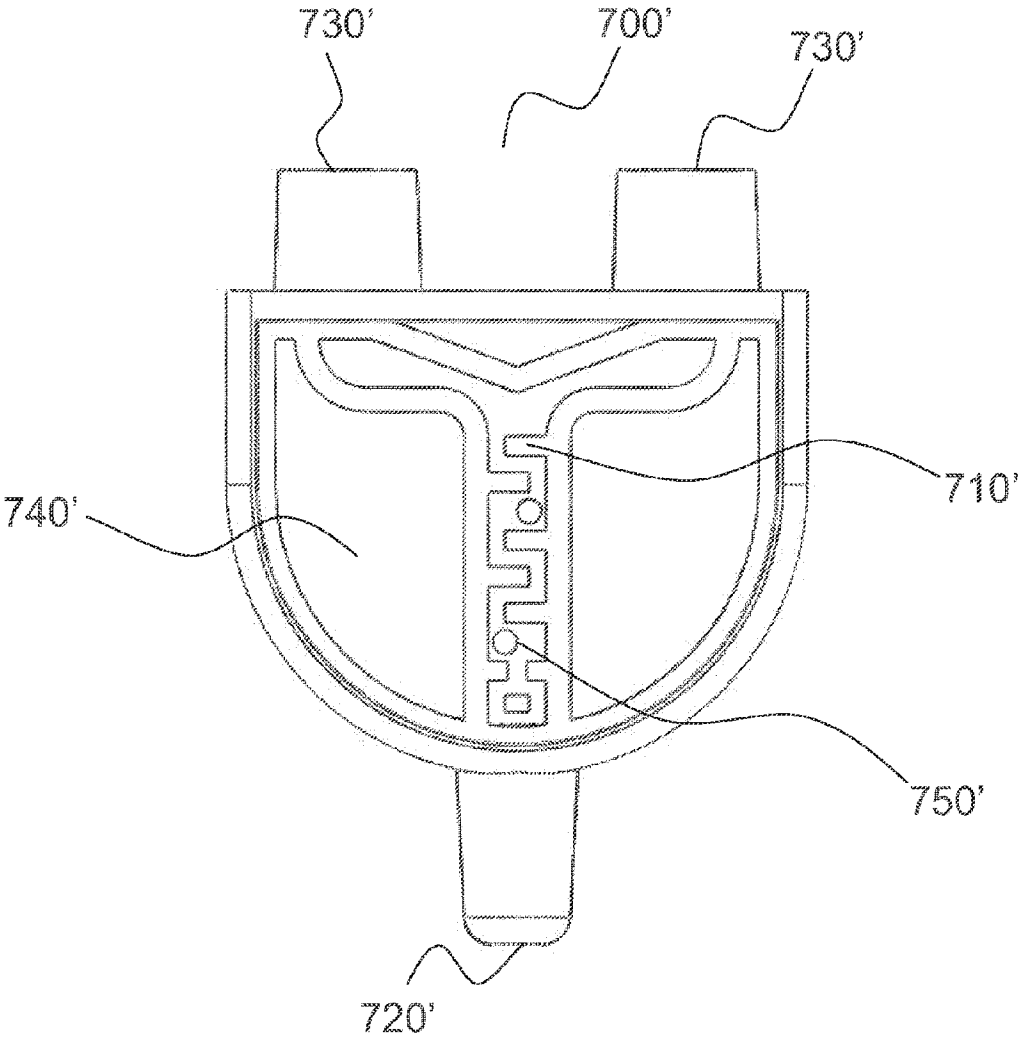
FIG. 7D is a cross-sectional illustration of a maze mixer unit.
Figure 7E:
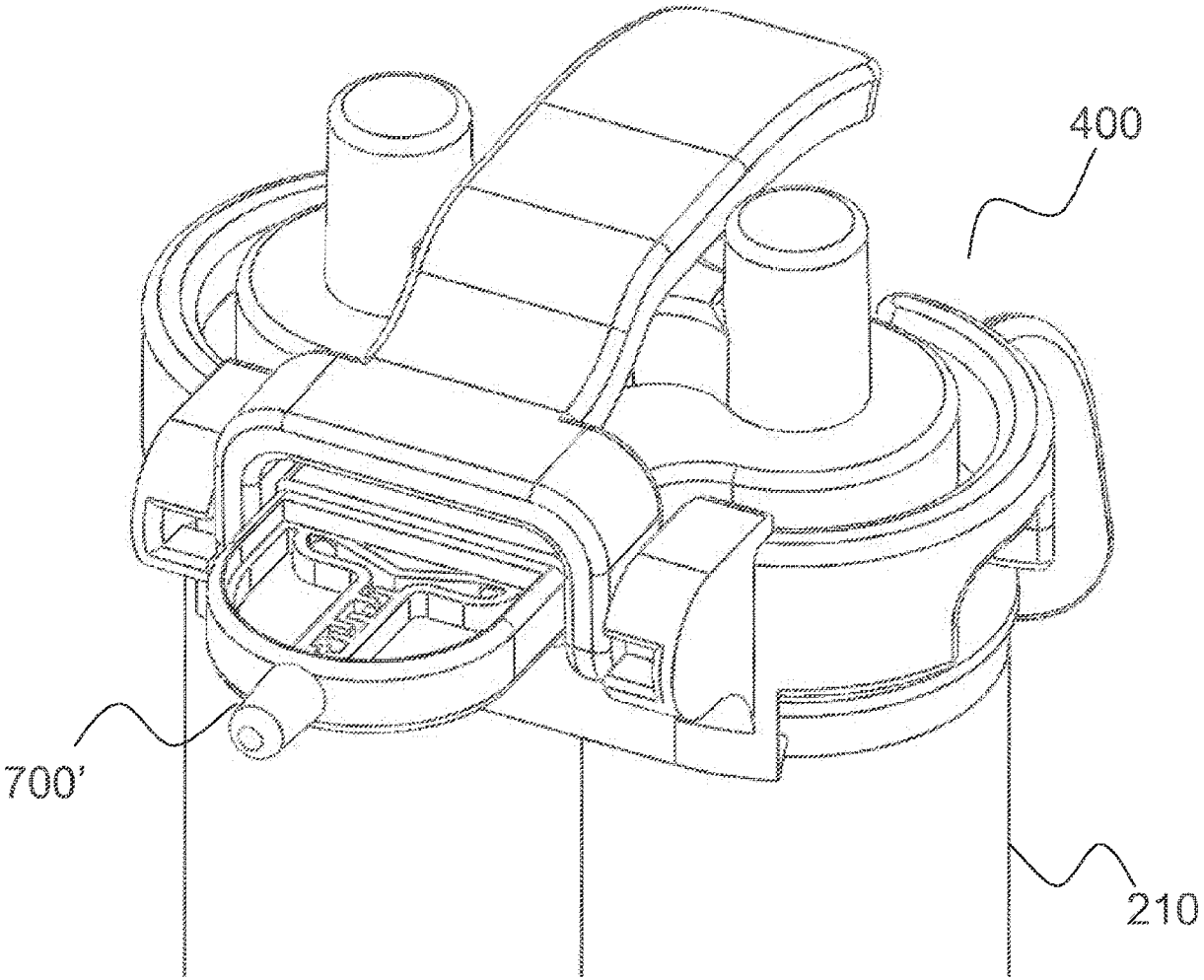
FIG. 7E is a prospective view of a maze mixer unit attached to the nozzles of a dual dispensing unit.

FIG. 7C is a prospective cross section of a maze mixer unit 700' according to one or more embodiments. The mixer unit 700' includes a series of alternating straight or curved surfaces 710' or paddles or angled dove tailing blades combined with small cylinders 750' to improve mixing within a short arched body 740'. The mixer unit includes an outlet 720' from which the mixed content is expelled and two inlets 730' in a diameter suitable for snuggly receiving or inserting into nozzles of the dual dispensing unit. In one or more embodiments the mixer may include a rotating wheel with a number of curved surfaces or paddles or angled dove tailing blades. FIG. 7C is a cross section of a maze mixer unit 700' according to one or more embodiments and FIG. 7E demonstrates the maze mixer attached to the dual dispensing unit. It has a repeatedly alternating pathway, forcing mixing of the two contents. Mixing is further facilitated by mixing posts, which may in certain embodiments be rotatable. It should be noted that the top cover of the mixer unit in FIGS. 7A-E is not shown for reasons of illustration only to allow viewing of the inner component within the body of the mixer.

Figure 8:
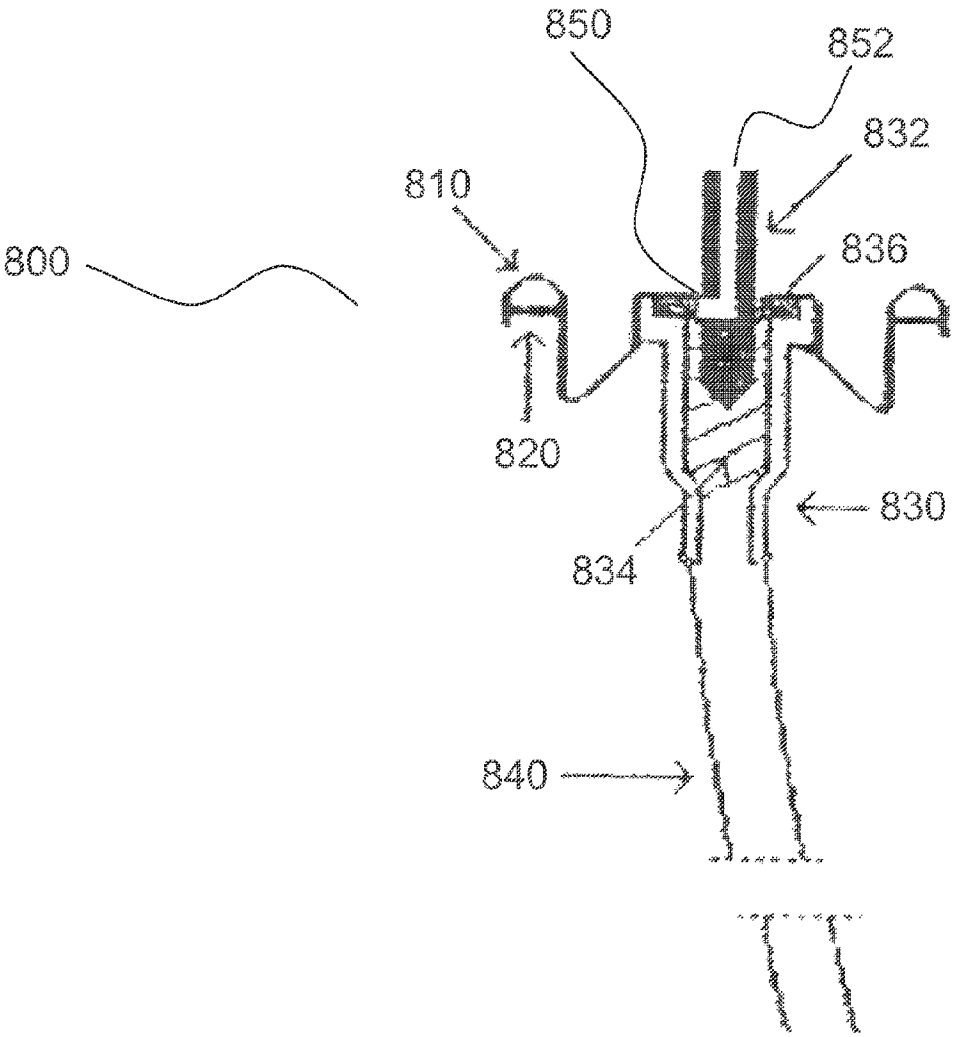
FIG. 8 is an illustration of a standard valve according to one or more embodiments.

FIG. 8 is an illustration of a typical standard valve according to one or more embodiments. In some embodiments, a conduit, or dip tube 840 is attached to or integrally formed with stem 832 and/or the valve 800. Such a conduit is in fluid communication with and extends internally from the stem or valve and is immersed in or in fluid communication with the content of container, thereby facilitating flow of the content from the interior of the container, into the conduit, and through the valve stem. In order to deliver the majority of the content from the container, the conduit extends a distance into the region of the container where the content resides. In some embodiments, the conduit extends substantially to the floor or bottom interior surface of the container.

A variety of valve configurations are known in the art and are useful in conjunction with the apparatuses and methods described herein. Such valves include, but are not limited to standard valves, metered dose valves, continuous valves and inverted valves. A description of valves and valve terminology appropriate for use in the apparatuses and methods described herein is found at http://www.precision-valve.com/en/resources/technical-reference. In one or more embodiments the apparatus and method is adapted for use with any known valve.

In any of the above described embodiments, the apparatus described herein includes an aerosol valve 800, as shown in FIG. 8. The valve is made up of the valve cup 810 typically constructed from tinplated steel, or aluminum, an outer gasket 820, which is the seal between the valve cup and the aerosol can (not shown), a valve housing 830, which contains the valve stem 832, spring (resilient means) 834 (typically made of stainless steel) and inner gasket 836, and a dip tube 840, which allows the liquid to enter valve. The valve stem 832 is fitted with small apertures 850, which is the tap through which the product flows. The inner gasket 836 covers the aperture 850 (hole) in the valve stem. Valves may contain one, two, three, four or more apertures 850, depending on the nature of the product to be dispensed. In FIG. 8 a first aperture can be seen at the top of the valve stem and a second aperture can be seen close to the bottom of the valve stem at one side. An integral channel is formed between first apertures 850 and second aperture 852 through which content from the canister may pass or through which content (e.g. propellant) may be loaded into the canister.

In one or more different embodiments a valve can have a stem with 1 to 4 second apertures, or 1 to 2 second apertures. Each aperture can have a diameter of about 0.2 mm to about 1 mm, or a diameter of about 0.3 mm to about 0.8 mm. The total aperture area, i.e., the sum of areas of all apertures in a given stem, is between about 0.01 $mm^2$ and 1 $mm^2$ or the total aperture area is between about 0.04 $mm^2$ and 0.5 $mm^2$.

With a simple or standard valve, the valve hole is sufficiently small such that with normal operation it is in effect fully open once the valve is depressed. Thus, in an embodiment, upon depression of the valve to an open position, liquid will flow until the valve becomes closed. In another embodiment, it can be envisaged that the valve can be provided with an elongated or elliptical hole such that initially, as the valve stem moves downwards, only a portion of the hole is exposed. With further downward movement of the valve, greater portion of the hole is exposed and only when the valve is fully depressed is all of the hole exposed. In such circumstances then the depth of depression as well as the time of depression would control how much material is released.

The container 210 is a hollow body which may be made from any material, for example, aluminum, tin-plate, plastics including polyethylene terephthalate (PET), oriented polypropylene (OPP), polyethylene (PE), polypropylene (PP) or polyamide and including mixtures, laminates and the like. When the container is metal, the interior surface of the metal container is in some embodiments laminated with a plastic material or coated with a lacquer or with a varnish to protect the interior surface of the container from corrosion. Corrosion may weaken the container and may also lead to a discoloration and contamination of the container's content. Preferred plastic materials for lamination and lacquers or varnishes for coating are epoxy phenolic, polyimide imide, organosol, PET, PP, PE or a combination thereof. As would be appreciated by a man of the art the materials selected for the container, the valve and the dispensing apparatus should be chosen for their compatibility with the content to be stored in and expelled from the canister. To this end materials that do not corrode or leach out into the content to be stored during the intended shelf life of the product are selected.

Figure 9:
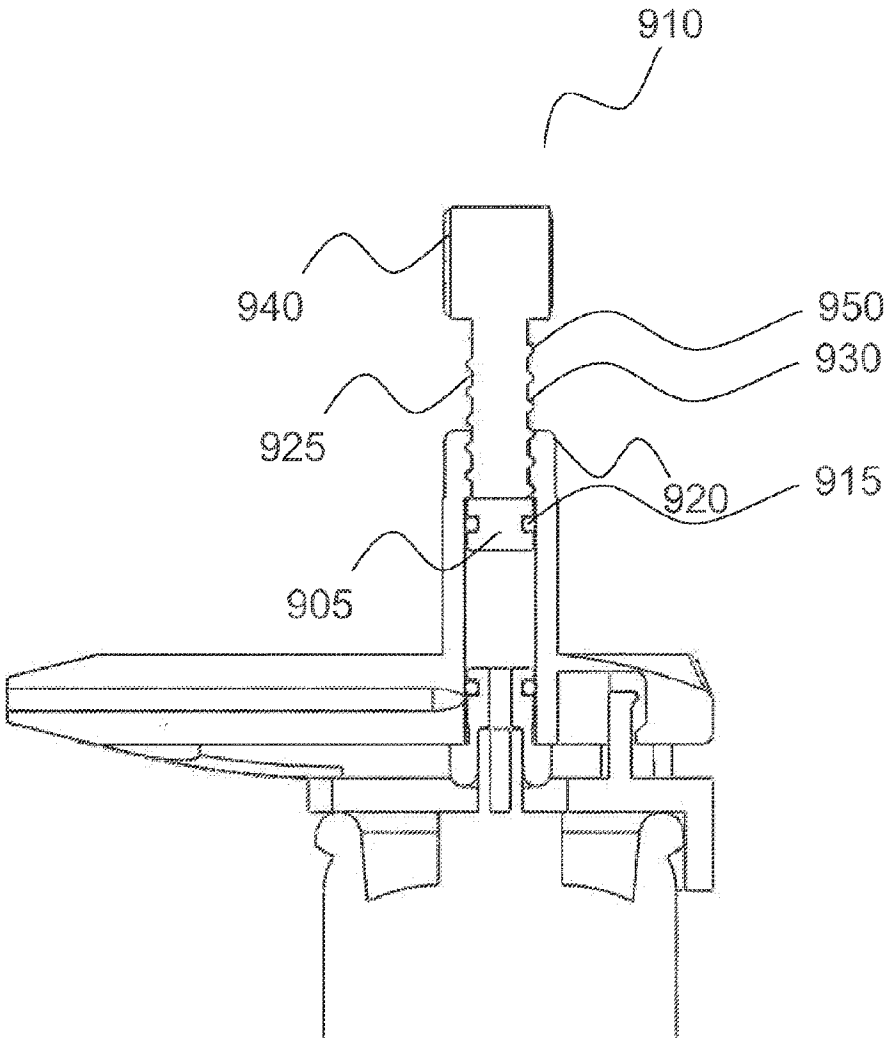
FIG. 9 is a cross-sectional illustration of an adjustable metering chamber in an actuated state (locked).

According to one or more further embodiments there is provided a metering or standard dose adjuster which can be fitted onto and incorporated within a cap, which can allow the size of the internal volume of the metering chamber to be varied accurately to control and adjust the internal volume of the metering chamber. The dose adjuster, for example, allows the same dispensing assembly to be used, say with a first content in a first canister requiring a full single standard dose of X ml and after washing, it can be used with a second content in a second canister requiring say a partial single standard dose of Y ml where Y is say two thirds of X or even with a larger dose of Z ml where Z is say 50% bigger than X. The position of the dose adjuster in the cap is simply adjusted so that it provides a larger or smaller volume as is required. In an embodiment the dose adjuster is provided by a piston device that allows the internal roof height of the cap to be adjusted upwards or downwards depending on need. In an embodiment the dose adjuster is provided by a mechanical screw device, which likewise allows the internal roof height of the cap to be adjusted upwards or downwards depending on need (See FIG. 9). The length of the thread and stops incorporated on the body of the screw device can provide a minimum and a maximum dose volume. The device can, for example, be conveniently marked or graded to indicate the new internal dose volume provided with say each full turn of the screw. The device can therefore dynamically and easily accommodate various aspects of dosage which suit particular requirements of different users. For example, in an embodiment there is provided a topless cap 920 (a cap with an opening instead of a roof) with an internal thread 930 in the internal wall of the cap adapted to receive an adjustable screw device 910. The screw device has a head 940 designed to be adjusted or turned comfortably by an inexperienced operator to vary the metering or standard volume. Extending from the head is a narrower body with a thread 925 and one or more stops 950, which then connects with a base comprising a washer 905 and ring seal 915, which are vertically positioned within the chamber to define the metering volume. Moving the washer upwards or downwards for example by screwing or unscrewing the screw determines the size of the chamber and the dose can be registered at the side of the cap. As shown in FIG. 9 the basic components of the apparatus and method of operation are similar to those of non-adjustable chamber. According to a further embodiment the adjusting device can include a round disc or cog wheel, which fits inside the topless cap and is the size of the internal cap diameter. On the top of the cap is a head which can be used to turn and adjust the height of the washer in the cap. The disc or cog has indentations or teeth which fit into a corresponding or matching housing in the side wall of the cap. As the disc or cog rotates in one direction it moves lower into the cap thereby decreasing the controlled dose volume. If it is rotated in the opposite direction it moves higher in the cap thereby increasing the controlled dose volume. The rotation of disc or cog determines the height of the chamber and provides a specific required dose. In an embodiment, an annular surface is provided that surrounds the disc and is calibrated such that as the disc turns a certain number of turns or part thereof it registers the dose effected. FIG. 9 depicts this embodiment in an actuated state. The non-actuated and initial disengaged states will be like depicted in FIG. 3 (without the adjustable screw device).

The size of the chamber may be dynamically varied to suit particular requirements, as may be readily understood, by varying not only the position of the roof wall but also the size and shape of the washer, for example by providing a hollow inside the washer and if required extending into the body of the screw device or in the piston device which can extend the metering volume. In one or more embodiments the hollow in the washer and body of the screw device can be opened and closed as is required by a twist of the head, for example in the same way a camera lens can be opened and closed.

The amount of content to be released from the container can also be conveniently controlled by varying the size of chamber or using different caps having different sized chambers. For example, the height of the chamber may vary (without changing the adaptor) to any suitable height. In an embodiment for example its height can be between about 3 mm and about 18 mm and the height of the adaptor should be at least 2 mm less than the height of the cap. For example, in non-actuated state a 2 mm space is maintained between adaptor and cap. The width of the chamber may also be varied provided the width of the adaptor is properly adjusted so that the cap tightly engages the adaptor. For example, if the width of the adaptor is about 6 mm and the width of the chamber is about 9 mm. The position of the center of the discharge passage from the bottom edge of the cap may vary according to height of the adaptor including the sealing ring and the diameter of the discharge passage; provided that once the cap is actuated the discharge passage is fully obstructed by the top of the adaptor. In one or more embodiments, for example, the chamber may be elongated further between about 19 mm and about 50 mm. In one or more embodiments the volume of the cap may be simply extended by providing a cap with the shape of a mushroom or by other similar devices.

According to one embodiment the diameter of the cap is 6 mm. The diameter of the chamber within the cap is 5.9 mm. The diameter of the top of the adaptor is 4.2 mm. The diameter of the bottom of the adaptor of including the ledge is 9 mm. The diameter of the recess within the adaptor is 3.9 mm. The diameter of the stem is 2 mm. The radius of ledge is 1.2 mm. The height of ledge is 4.7 mm. The radius of the discharge passage is 0.5 mm. The height of the cap is 3.2 mm and the bottom edge of the cap is positioned, in non actuated state, 2 mm above the top ledge of the adaptor. The height of the top of the adaptor is about 3.2 mm and the height of the adaptor including the ledge is 7.9 mm.

In one or more other embodiments there is provided a modified dispensing assembly. An example of a modified dispensing assembly 1000 is shown in perspective view and perspective vertical cross sectional view in FIGS. 10A and 10B, respectively. In one or more embodiments the dispensing assembly 1000 is curved inter alia to provide, simple efficient operation, strength, and connections that are adapted to be leak proof with repeated use. In addition it is formed to add comfort and ease of handling to the user and this can contribute to reliability and also to provide eye appeal. The dispensing assembly is disposed on a valved-container (not shown) that is capable of including a content and internal valve assembly (not shown). The dispensing assembly may be readily connected with the valved container (e.g. aerosol canister). For example the dispensing assembly can be readily snapped in place on the neck portion of the valved container by pressing down an enclosure unit 1040 onto the said container. The dispensing assembly is disposed in flow communication with one end of a container that includes pressurized content. A valve (not shown) is located at one end of the container.

Figure 10A:
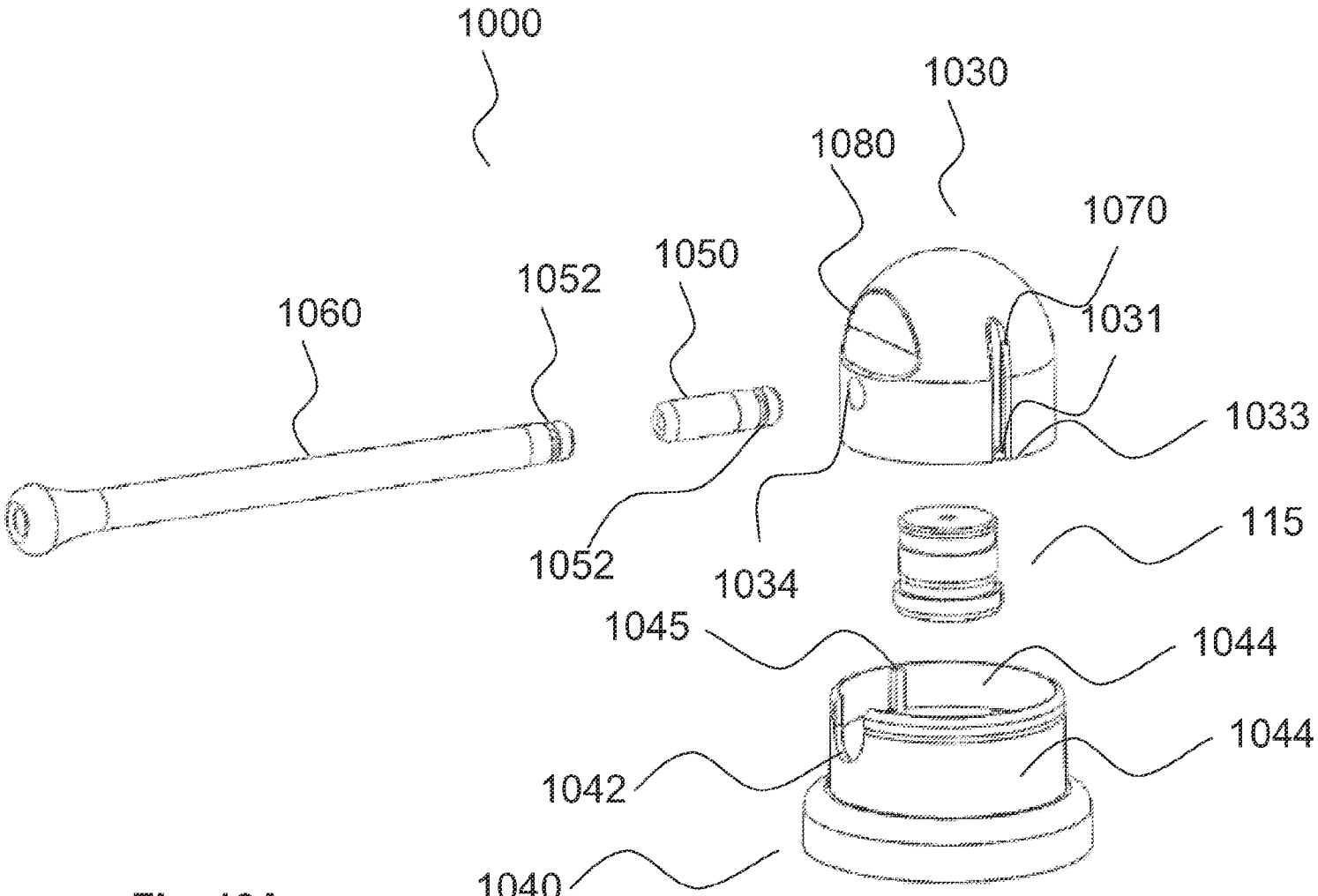
FIG. 10A is a perspective view of a modified dispensing assembly, having a cap, a dispensing unit and an enclosure unit.

The dispensing assembly 1000 comprises (i) an actuator assembly 205 which allows a standard quantity of the formulation to be effected and stored upon downward pressure and dispensed upon termination of pressure, (ii) a dispensing unit 1030 which allows a standard quantity of the formulation to be dispensed with each actuation; (iii) an enclosure unit 1040 securing the dispensing unit to the container. In FIGS. 10A and B the upper surface of the dispensing unit is curved. In one or more other embodiments it can be horizontally flat or can describe an angled plane or provide an area of insert such as thumb or finger shaped indent from which to apply pressure. In other embodiments it is a combination of curved and flat or indented areas.

In operation, the user employs a finger, e.g., a thumb or forefinger on the top of the curved dispensing unit or optionally on an engageable finger indentation (not shown), to push down the dispensing unit including actuator assembly 205 indirectly and obtain a standard dose of content. Once the assembly is depressed dispensing can occur. Even if the operator forgets to remove his finger, the assembly is formed so as to release a single unit or standard dose. In other words, even if the operator temporarily forgets to release the actuator no additional dose should be released. Upon release of the finger the dispensing unit returns to its original position and dispensing ceases. By way of example if the content to be released is a foam then during the downward stroke a dose of foamable formulation passes into the metering chamber to form a standard dose. The standard dose is not released when the dispensing unit reaches the bottom of the downward stroke but remains in the chamber until the assembly proceeds in an upward stroke that allows the chamber to connect to a dispensing unit or nozzle or applicator. In other words release is during the upward stroke. As the foamable formulation is released it expands to form a foam.

Figure 10B:
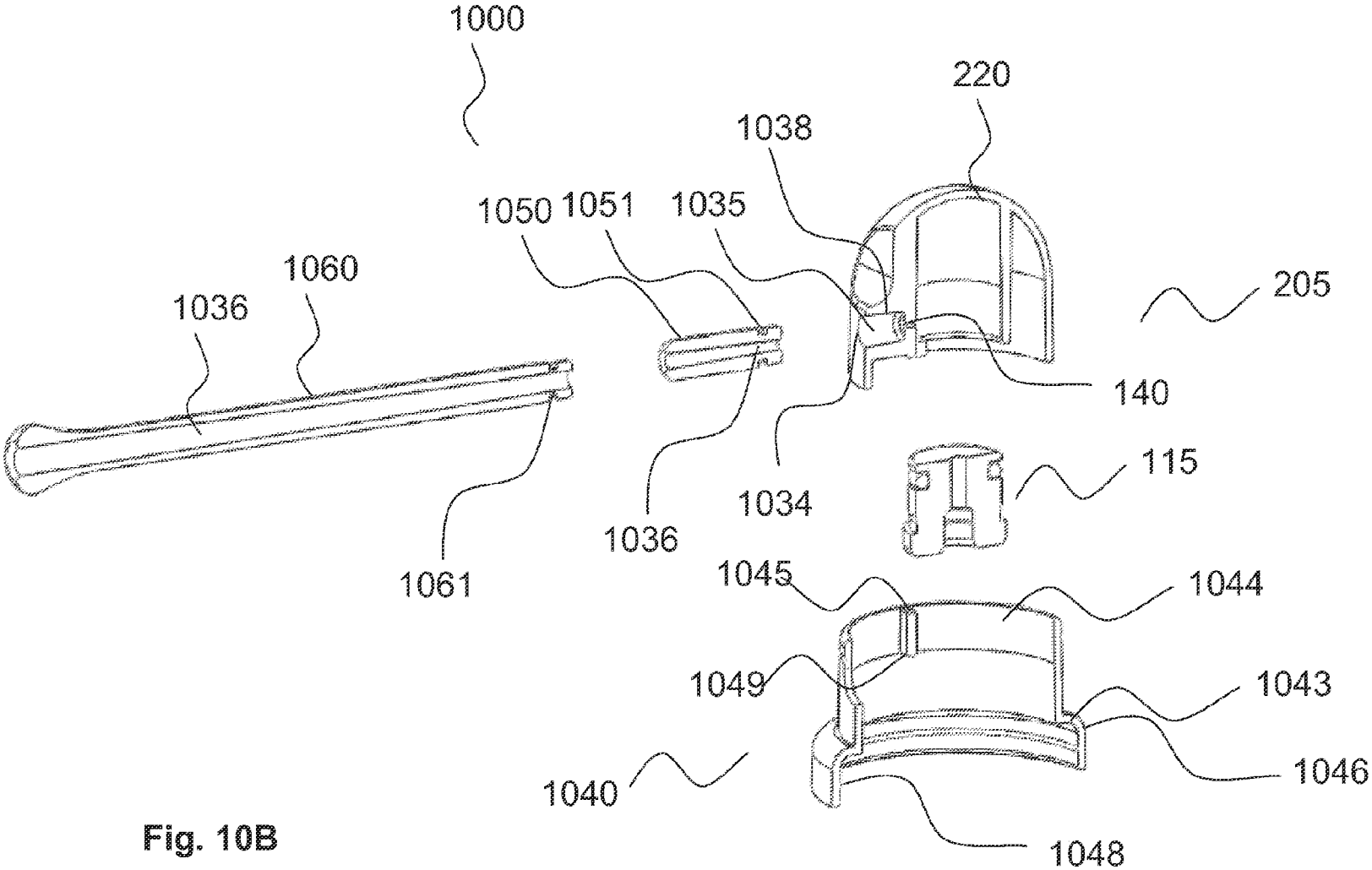
FIG. 10B is a perspective vertical cross sectional view of the modified dispensing assembly.

As shown in FIG. 10A and FIG. 10B the annular dispensing unit 1030 includes an cap 220, a dispensing conduit 1035 surrounded by a conduit housing 1038 and a discharge nozzle 1034. The cap can be integrated into and molded as one unit together with the dispensing unit or separate. In one or more embodiments, the internal geometry of the cap and the cap material are selected such that upon release of the dose no or minimal residual content remains within the cap. In addition in one or more embodiments the internal surfaces are smooth without ridges or depressions. In one or more embodiments the internal surfaces are coated with a non stick low friction coating which is non reactive with the formulations for which it is intended. According to another embodiment, the cap can be attachable to the dispensing unit having a slight conical structure where the diameter of the bottom edge of the cap is slightly larger (or alternatively slightly smaller) than the top surface of the cap and the diameter of the hole within the dispensing unit. The attachment may be via a screw thread or a clip or a resilient means or other connecting means.

The nozzle may have different lengths and may be integrated or attachable and/or modular depending on the intended use. Where integrated, in one or more embodiments it can comprise a cavity or dispensing conduit 1035 within the cap 1030. The cavity can be cylindrical or rectangular or other shape. It can be a shallow cavity or a deep cavity or something between the two. The contents are released from and through the cavity. In one or more embodiments the cavity is omitted and the discharge passage 140 is flush with the outer surface of the cap. In one or more other embodiments the nozzle extends beyond the external contour surface of the dispensing unit. When the nozzle so extends it is also referred to as an applicator. For example, it may include an attachable or integrated protruding discharge nozzle or applicator 1050 which slightly extends beyond the external contour surface of the dispensing unit. In one or more embodiments it is attachable by insertion into the dispensing conduit. In one or more embodiments, applicator 1050 is inserted into dispensing conduit 1035 until the applicator is in close to flush with or in contact with the discharge passage 140, in order to minimize the presence of dead volume in the dispensing conduit. In one or more embodiments it is part of and extends beyond the cap. The nozzle or applicator may be further extended to facilitate body cavity application, for example, vaginal application by attachment of an extended applicator 1060. The applicator or extended applicator may be circular or elliptical. Its circumference may be the same or varied along its length. In one or more embodiments it may have an expanded and rounded tip to facilitate insertion and application of the unit dose. In one or more embodiments the applicator is flexible. In one or more embodiments the applicator is rigid. In one or more embodiments the applicator is rigid or semi rigid along the length which is to be inserted into the cavity but has a flexible section, which is positioned to be external to the body cavity, thereby allowing some movement of the applicator and canister without causing discomfort to the user. In one or more embodiments the flexible section will be located in the half of the applicator closest to the cap. In other embodiments it will be located somewhere in the fifth and a third of the applicators length closest to the cap. In still further embodiments it is located somewhere in the quarter and a third of the applicators length closest to the cap. So by way of example, if the applicator is 100 mm in length the flexible section is found, for example between about 25 mm and about 33 mm from the cap. In one or more embodiments the applicator is between about 20 mm to about 150 mm in length, or between 125 mm and 75 mm or between 120 mm and 80 mm. In one or more embodiments it is between about 0 and 9 mm in length, 10 mm or more in length, 20 mm or more in length, 30 mm or more in length, 40 mm or more in length, 50 mm or more in length, 60 mm or more in length, 70 mm or more in length, 80 mm or more in length, 90 mm or more in length, 100 mm or more in length, 110 mm or more in length, 120 mm or more in length, 130 mm or more in length, 140 mm or more in length, or 150 mm or more in length. When the nozzle or applicator is not integrated a connecting means is provided at the end to be inserted through the dispensing conduit 1035 to provide a sealed connection with the conduit housing 1038. In one or more embodiments the connecting means is provided by a resilient seal. In one or more embodiments the applicator or nozzle will have at the end for insertion into the cap a conduit 1051 or 1061 embedded in the applicator external wall to ring the circumference of the applicator. A resilient seal or sealing means sits within and beyond the conduit. When an applicator or nozzle is present the dispensing conduit 1036 continues and or sits within a protective conduit housing of the nozzle 1050 or applicator 1060. Likewise, one end of the nozzle fits within the conduit housing 1038 and is aligned with the discharge passage 140 of the cap for release of materials from container to valve stem, to the discharge passage 140, through the dispensing conduit and out through a discharge nozzle 1034 in the body of the cap. The protruding discharge nozzle 1050 and vaginal applicator 1060 also have a dispensing conduit 1036 within a conduit housing 1038 which is aligned with the discharge nozzle. The dispensing conduit 1036 is in constant flow communication with the discharge passage 140 of the cap 220 and the atmosphere.

The dispensing conduit may have a constant internal diameter or a varying internal diameter or shape. It may be circular or elliptical or rectangular or other suitable shape to facilitate release of the contents. In one or more embodiments the inner surface of the conduit is coated with a non stick or low friction coating. The internal diameter may progressively increase or decrease. Alternatively it may increase or decrease in one or more steps. In one or more embodiments the distal end diameter of the conduit is wider than the proximal diameter. This may be helpful for foamable formulations to allow some expansion of the foam. In one or more other embodiments the distal end diameter of the conduit may be narrower than the proximal diameter. The shape and size of the diameter of the conduit can influence or control the rate of release and the spread of the formulation depending also on the formulation and expulsion method. In one or more embodiments the internal diameter is between about 0.005 and 20 mm in diameter, is between about 0.008 and 10 mm in diameter, is between about 0.01 and 0.09 mm in diameter, is between about 0.1 mm and 15 mm in diameter, about 0.01 mm or more in diameter, 0.02 mm or more in diameter, 0.03 mm or more in diameter, 0.04 mm or more in diameter, 0.05 mm or more in diameter, 0.06 mm or more in diameter or 0.07 mm or more in diameter, 0.08 mm or more in diameter, 0.09 mm or more in diameter, 0.1 mm or more in diameter, 0.2 mm or more in diameter, 0.3 mm or more in diameter, 0.4 mm or more in diameter, 0.5 mm or more in diameter, 0.6 mm or 0.7 mm or more in diameter, 0.8 mm or more in diameter, 0.9 mm or more in diameter, 1 mm or more in diameter, 2 mm or more in diameter, 3 mm or more in diameter, 4 mm or more in diameter, 5 mm or more in diameter, 6 mm or more in diameter, 7 mm or more in diameter, 8 mm or more in diameter, 9 mm or more in diameter, 10 mm or more in diameter, 11 mm or more in diameter, 12 mm or more in diameter, 13 mm or more in diameter, 14 mm or more in diameter, or 15 mm or more in diameter. In one or more embodiments the diameter is less than any of the preceding figures. If the protruding discharge nozzle 1050 and vaginal applicator 1060 are attachable they may have sealer rings 1052 that fit in sealer channel 1051 or 1061 to snuggly and resiliently hold them in position in the dispensing conduit 1035, which facilitates repeated and leak free use (FIG. 10B).

The dispensing unit 1030 is positioned on the adaptor 115 and secured thereon by the enclosure unit 1040. The interior of the dispensing unit 1030 (apart from the integral cap and conduit housing) can be hollow in order to be more cost effective. It may have different designs which are both economic and esthetic, for example it may include a cut out face 1080 that is flat horizontally and vertically. In one or more embodiments the cut out describes an angle less than 90 degrees. In one or more embodiments the cut out describes an angle more than 90 degrees. In one or more embodiments it is curved. It may also have at least two elongated rails or slots 1070 on both sides of the dispensing unit within the external peripheral wall of the dispensing unit for allowing the dispensing unit to move vertically on the adaptor. In one or more embodiments the rails are straight. In one or more embodiments may be slightly or partially curved. Each rail may terminate with a notch 1031, having a first surface—for example being a protruding bottom flat surface 1033—for engaging or interlocking with a second surface—for example being a protruding top flat surface 1049 of at least one resilient edge 1045 positioned at the top edge of the inner peripheral wall 1044 of the enclosure unit 1040. The engagement of the first and second surfaces provide a locking mechanism for proper positioning of the dispensing unit within the enclosure unit, both in actuated and post actuated states. It further provides a stop and a resistance to the internal valve spring so that the dispensing unit returns to its proper position in non-actuated state and does not pop off. Other engaging means may be envisaged. In one or more other embodiments the dispensing unit 1030 is integrated with the enclosure unit 1040 to form a single unit within which is positioned the adaptor 115.

The enclosure unit 1040 can be any general geometry; however for example it describes a curvature to provide comfort and ease of handling to the user so as to improve patient compliance, for example the annular enclosure unit as depicted in FIG. 10A and FIG. 10B. The enclosure unit encompasses the dispensing unit hence it has a peripheral wall 1044 which is shaped accordingly.

In one or more embodiments the enclosure unit 1040 consists of circumferential surface 1043 which rests on top of the container or aerosol canister. The enclosure unit is adapted to fit on top one or more containers or canisters. In one or more embodiments the circumferential surface has one or more engaging or resilient points to engage the container or canister. The dispensing unit 1030 is secured to the enclosure unit 1040 via a protrusion 1045, which is adapted to move along the rails 1070 of the dispensing unit. The protrusion can be rectangular, square or slightly curved or may be a wheel. The protrusion may be resilient. It is positioned on the top edge of the inner side of the peripheral wall 1044 and slides within the rails 1070. The protrusion 1045 may have a protruding top surface 1049 which engages with the bottom flat surface 1033 of the dispensing unit as described above, whilst for example allowing movement of the dispensing unit along a vertical axis in relation to a stationary enclosure unit. The enclosure unit can include a nozzle slot 1042 through which can pass the discharge nozzle 1050 or applicator 1060. In one or more embodiments the applicator 1062 can connect to and extend the nozzle 1052. In one or more embodiments the lower inner side of the peripheral wall 1044 of the enclosure unit can include one or more support braces or ribs 1046. In certain embodiments the lower edge of the brace 1046 is configured to attach on the top portion of the neck 212 of container 210 (not shown in FIGS. 10A and B but see e.g. FIGS. 2A, 3A). The brace 1046 can include a circumferential rib 1048 that secures the enclosure unit to the neck of the container. Ribs can be partial. Ribs may be resilient. Ribs can be located at regular or random intervals along the inner circumference of the brace as are needed.

As can be understood from FIGS. 10A and 10B the method of operation of the modified dispensing assembly is similar to that illustrated in FIG. 3, where the dispensing unit is slideably coupled to the enclosure unit to allow movement of the actuator assembly together with the dispensing unit on the valve stem.

As shown in FIG. 11 according to one or more further embodiments there is provided an adjustable modified metering dose assembly 1100, allowing the size of the internal volume of the metering chamber to be varied accurately. In FIG. 11A, a dispensing unit 1030, a nozzle 1050 (optional) a dose adjuster 1110, an adapter 115, and an enclosure unit can be seen. According to one or more embodiment the adjustable metering dose assembly 1100 includes (i) a dispensing unit 1030 having an orifice 1160 at its top; (ii) an actuator assembly 205 (FIG. 11B); (iii) an enclosure unit 1040 and (iv) a dose adjuster. In an embodiment the dose adjuster is provided by a piston or screw device 1110 which is affixed and adjusted by means of internal thread 1130 (FIG. 11B) that allows the internal roof height of the cap to be adjusted upwards or downwards depending on the unit volume desired. The length of the thread and stops incorporated on the body of the screw device can provide a minimum and a maximum dose volume (FIGS. 11A-C).

Figure 11A:
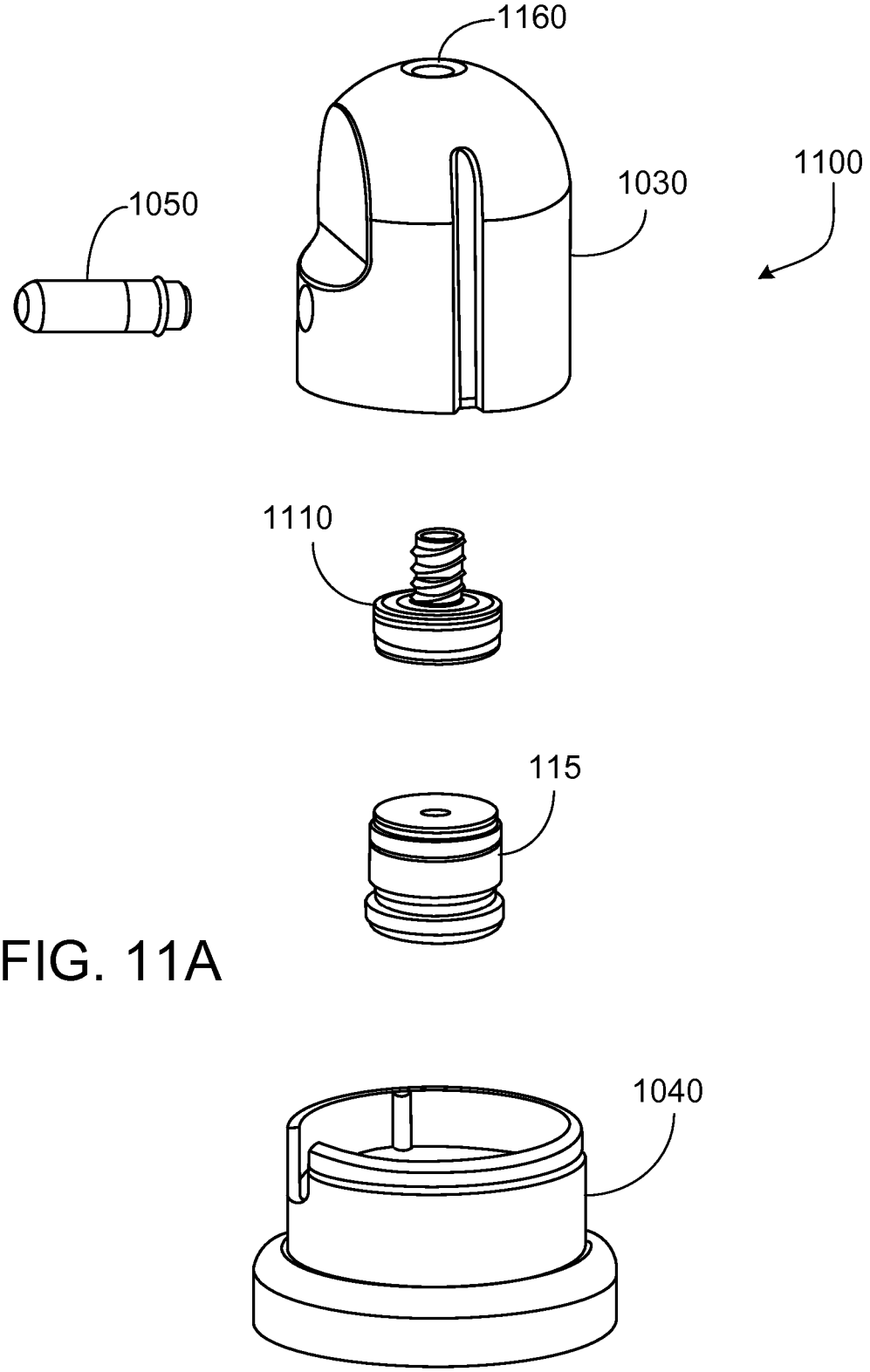
FIG. 11A is a perspective view of a disassembled modified adjustable dispensing assembly.
Figure 11B:
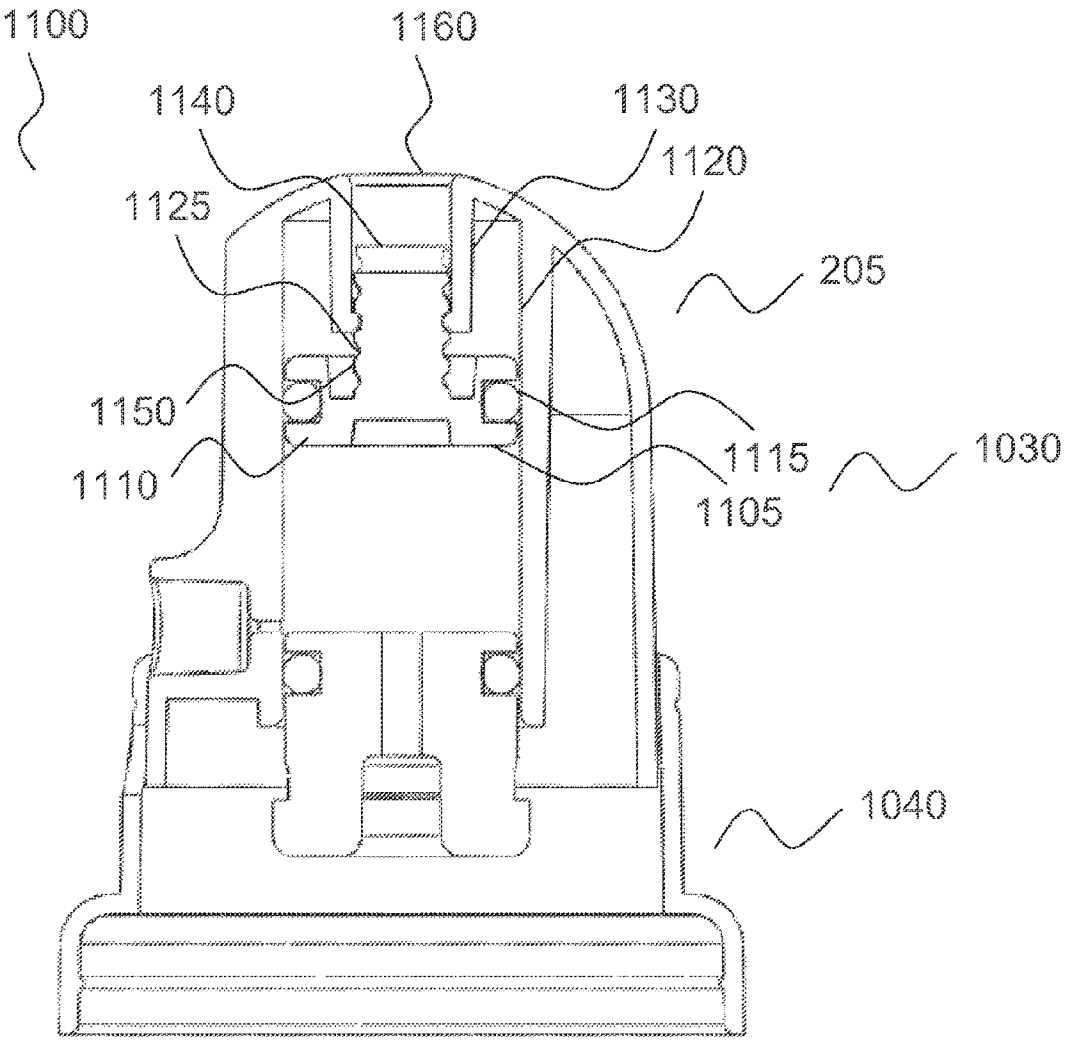
FIG. 11B is a vertical cross sectional view of the modified adjustable dispensing assembly in a non actuated state.
Figure 11B:
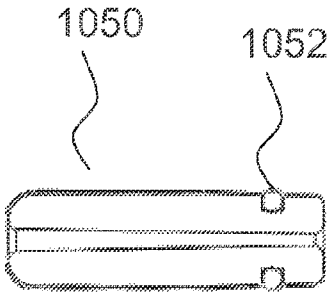
Figure 11C:
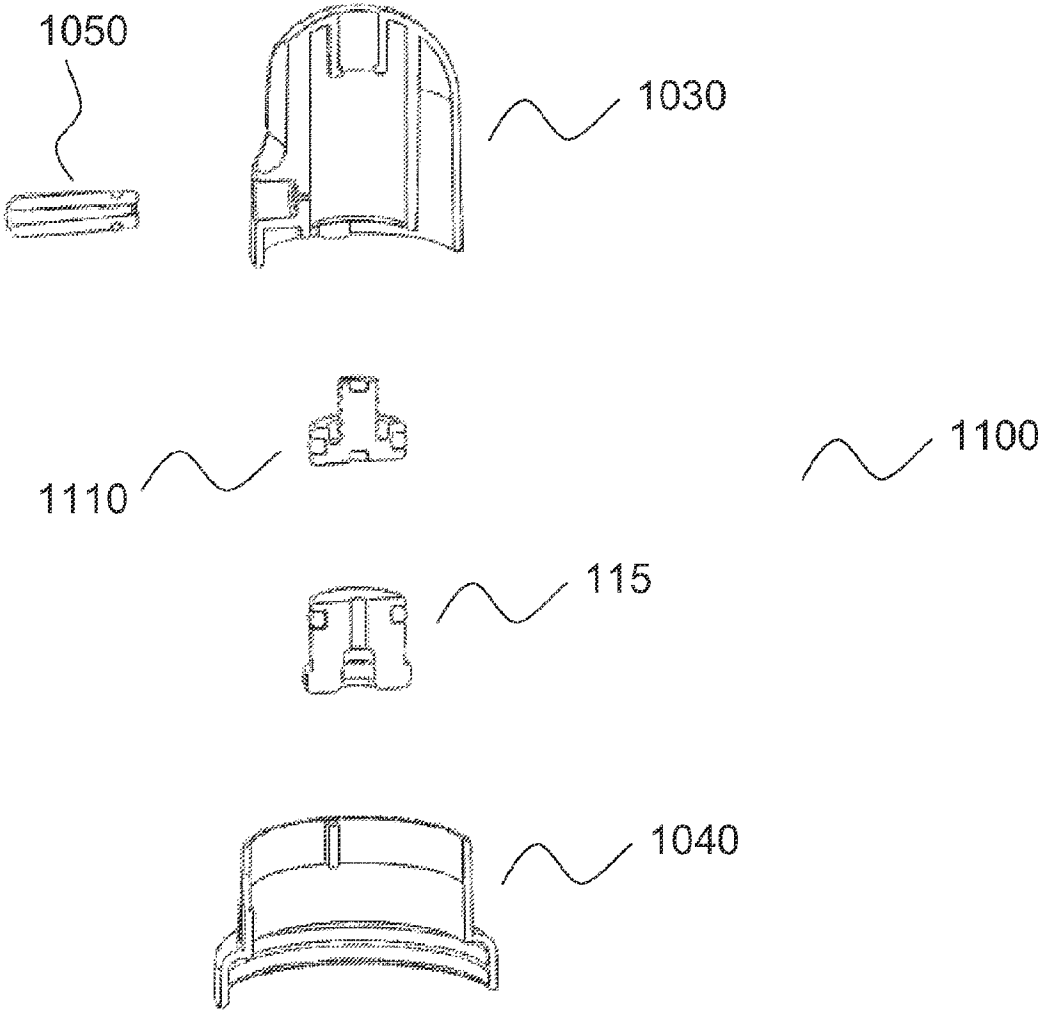
FIG. 11C is a perspective vertical cross sectional view of a disassembled modified adjustable dispensing assembly.

For example, in an embodiment there is provided adjustable dispensing unit including a topless cap 1120 (a cap with an opening instead of a roof) having an internal thread 1130 which extends from the orifice 1160 adapted to receive an adjustable device 1110. In certain embodiments the adjustable device is a screw device. In one embodiment the screw device should tightly engage the internal thread so that it does not move during operation. In another embodiment the screw device comprises a locking means to fix it in a position to achieve a desired unit dose volume, for example, a sliding bolt (not shown) that fits into one or more bolt holes (not shown) in the wall of the cap, enabling the available internal unit dose volume to be increased or decreased as desired. The internal thread may be the width of the cap or narrower. The screw device has a head 1140 designed to be adjusted or turned comfortably by an inexperienced operator to vary the metering volume. Extending from the head is a body with a thread 1125 and one or more stops 1150, which then connects with a base comprising a washer 1105 and ring seal 1115, which are vertically positioned within the chamber to define the metering volume. The width of the washer correlates with width of the cap. Moving the washer upwards or downwards for example by screwing or unscrewing the screw determines the size of the chamber and the dose can be registered at the side of the cap (FIGS. 11A-C). The screw device can be screwed upwards or downwards by inserting a screwdriver or key through orifice 1160 into head 1140 which can be equipped with a slot (not shown) suitable for a key or screwdriver. By screwing the screw device upwards or downwards, the volume within the chamber can be varied. Stops can be provided so as to define the highest and lowest positions the screw device can achieve and thereby the minimum and a maximum available chamber volume. By way of illustration a maximum chamber volume is obtained when the screw device is screwed upwards up to a position where thread 1125 is located entirely into internal thread 1130. By screwing the screw device downwards, the chamber volume can be decreased by say about 10%, about 20%, about 30%, about 40%, about 50%, about 60%, about 70%, about 80%, about 90%, or about 100% or some other percentage between 0-100. The rest of the components of the adjustable curved dispensing assembly (including the enclosure unit, dispensing unit and actuator assembly) and method of operation are similar to those of the curved dispensing assembly chamber (FIG. 10). In one or more further embodiments the adjustable device extends through the orifice 1160 and is adjustable externally. In certain embodiments the top of the protruding adjustable device may act as or be adapted to act as an actuator so that when pressure is exerted on the upper surface of the adjustable device the dispensing unit is displaced downwards relative to the enclosure unit. In one or more embodiments the external upper surface is shaped like a button or mushroom.

Figure 11D:
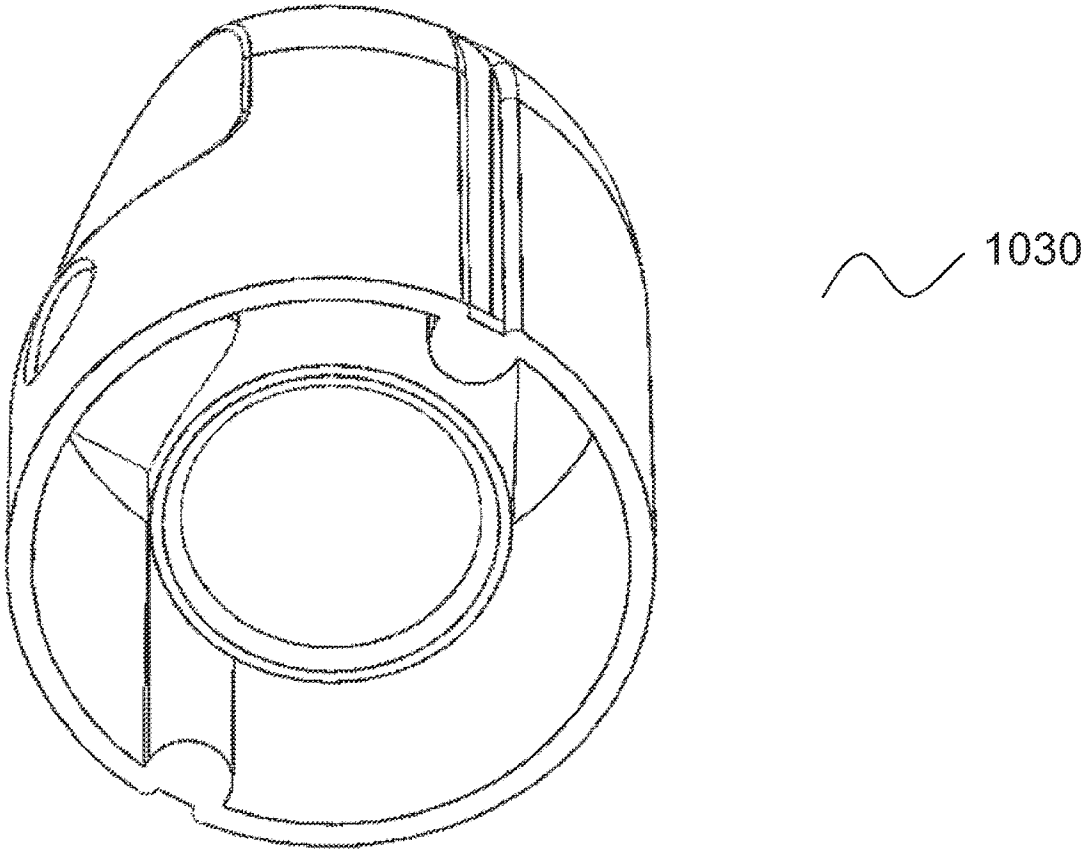
FIG. 11D is a prospective view of a single chamber lid from below.

According to one or more embodiments, as illustrated in FIG. 11D a perspective view from underneath is provided of the dispensing unit 1030.

Figure 12A:
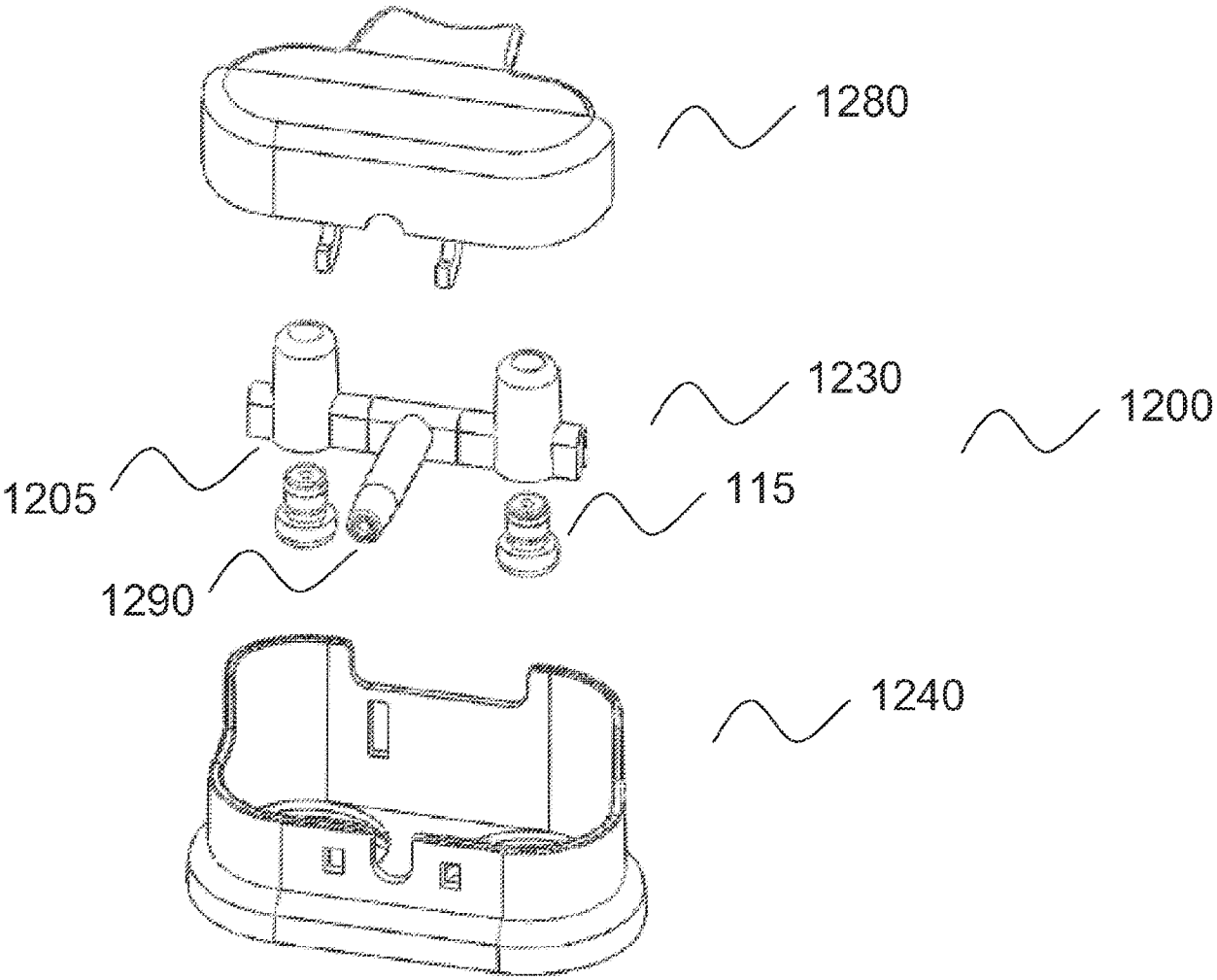
FIG. 12A is a perspective view of a disassembled modified dual chamber dispensing assembly comprising, a dispensing unit comprising two actuator assemblies coupled to an integrated mixer and a modified dual enclosure unit.

According to another embodiment, there is provided a modified dual chamber dispensing assembly 1200 comprising an integrated mixer unit 1290 (FIG. 12A). The mixer unit shown directs the pressurized contents of one canister towards the pressurized contents of the other canister. In FIG. 12A the contents are directed towards each other on a straight 180 degree line. Where the two contents first collide is referred to as the collision region. At or about or reasonably close to the collision region there is a "T" exit conduit through which both contents can exit. The collision and then right angle exit of the contents facilitates mixing of simultaneously expelled contents from two compressed gas containers disposed side by side, which are actuatable in common by a dual dispensing assembly 1200. In one or more alternative embodiments the mixer unit may comprise of a structure not shown) where the contents are directed towards each other on an angled path and then exit though a "T" exit conduit. The angled path may be arranged so the contents meet and collide at about an angle of say about 25 degrees or 30 degrees or 35 degrees or 40 degrees or 45 degrees or 50 degrees or 55 degrees or 60 degrees or 65 degrees or 70 degrees or 75 degrees or 80 degrees or 85 degrees or 90 degrees or 95 degrees or 100 degrees or 105 degrees or 110 degrees or 115 degrees or 120 degrees or 125 degrees or 130 degrees or 135 degrees or 140 degrees or 145 degrees or 150 degrees or 155 degrees or 160 degrees or 165 degrees or 170 degrees or 175 degrees or 180 degrees or 185 degrees or 190 degrees or 195 degrees or 200 degrees or 210 degrees or 215 degrees or 220 degrees or an angle described between any two figures listed such as 91, 92, 93, or 94 degrees. The dual dispensing assembly 1200 comprises a dual dispensing unit 1230 comprising two actuator assemblies 1205 coupled to an integrated mixer unit 1290. The dual dispensing unit 1230 is disposed within a dual enclosure unit 1240 and secured and actuated by pressing an enclosure unit lid 1280 (FIG. 12A). In one or more embodiments the parts are separate and are assembled together. In one or more embodiments the two or more parts are formed as an integrated or modular unit.

Figure 12B:
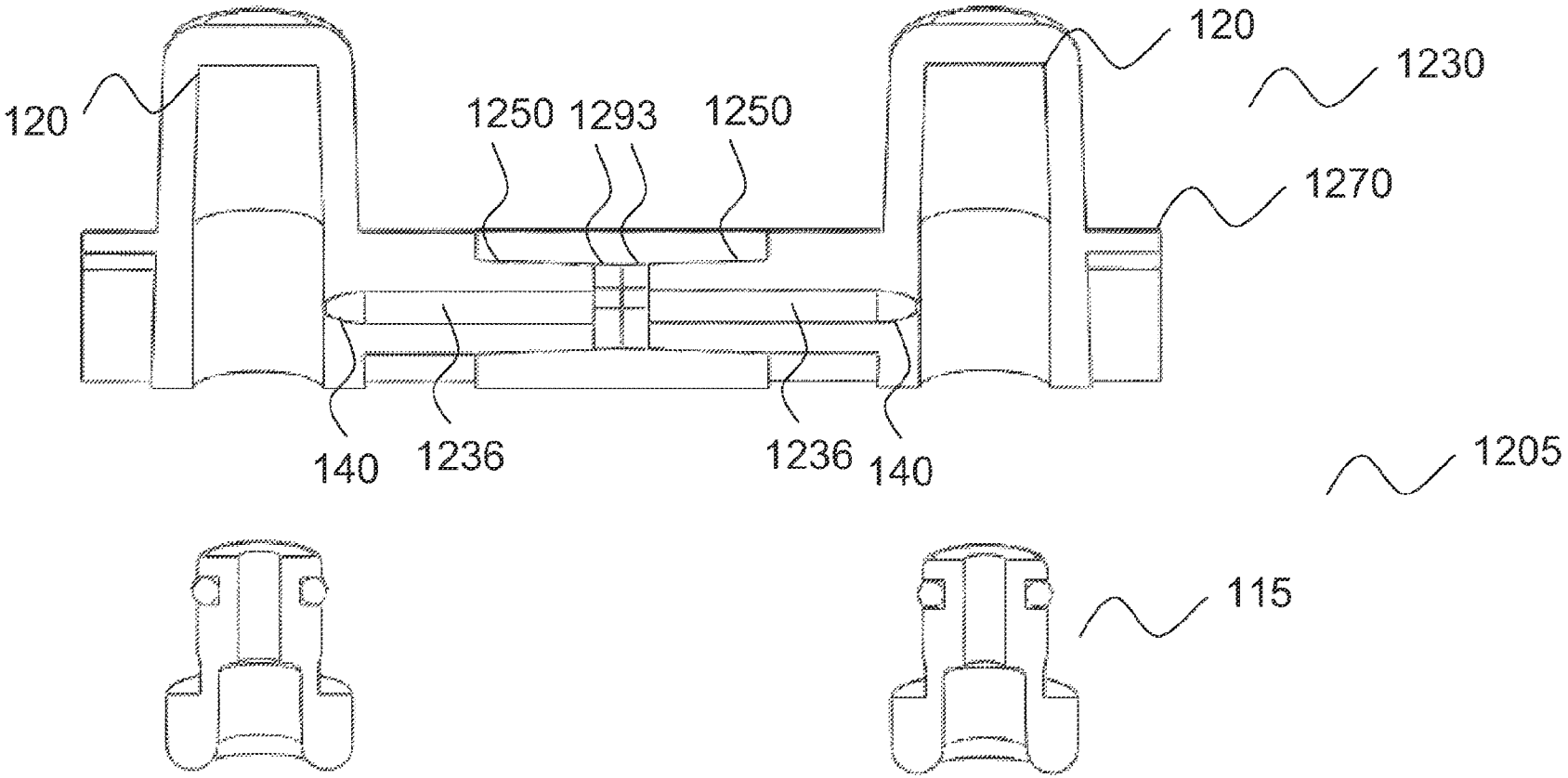
FIG. 12B is a vertical cross section view of a modified dual dispensing unit comprising two actuator assemblies coupled to an integrated mixer unit.

The dual dispensing unit may be molded as one unit or modular (FIG. 12B). For example wherein each of the protruding discharge nozzles 1250 of each actuator assembly is integrated and inserted into an inlet 1293 on each side of an integrated mixer. In the illustration, both discharge passages 140 and discharge conduits 1236 of each actuator assembly are positioned to face each other (at 180 degrees) and aligned with the inlets 1293 of the integrated mixer. The mixer can be simply the space where the two contents collide and then redirected or it can be a cavity with one or more mixing posts, wheels or paddles or it can further comprise a mixing chamber or nozzle through which the contents of both canisters are redirected. One of the challenges of the invention is to ensure that content from both canisters is ejected and dispensed in parallel. In one or more other embodiments the contents are directed so that mixing occurs outside the dispensing assembly. In one or more alternative embodiments the nozzles are arranged so that the contents are expelled in parallel without contact or that they are expelled side by side. In certain embodiments it may be desirable that about 50% of the expelled content comes from one canister and about 50% comes from the other canister each time a unit dose is expelled. In other embodiments it may be desirable that there is a split of say 60/40 or 70/30 or 80/20 or some other suitable split—in which case one or more parameters may be varied including the unit volume of each dispensing assembly, the conduit size of each nozzle, the structure of the mixing chamber which can be adapted to allow volume V1 of one canister to mix with volume V2 of another canister, wherein V1>V2. The discharge conduits 1236 are in constant flow communication with the discharge passages 140 of the caps 120 and the atmosphere via the exit nozzle, for example, the mixer nozzle 1296 (FIG. 12H). In one or more embodiments each cap can have a shoulder 1270 (FIG. 12B) at its outer edge, which may be hollow, allowing proper positioning and actuation of dual dispensing unit as will be explained below.

Figure 12C:
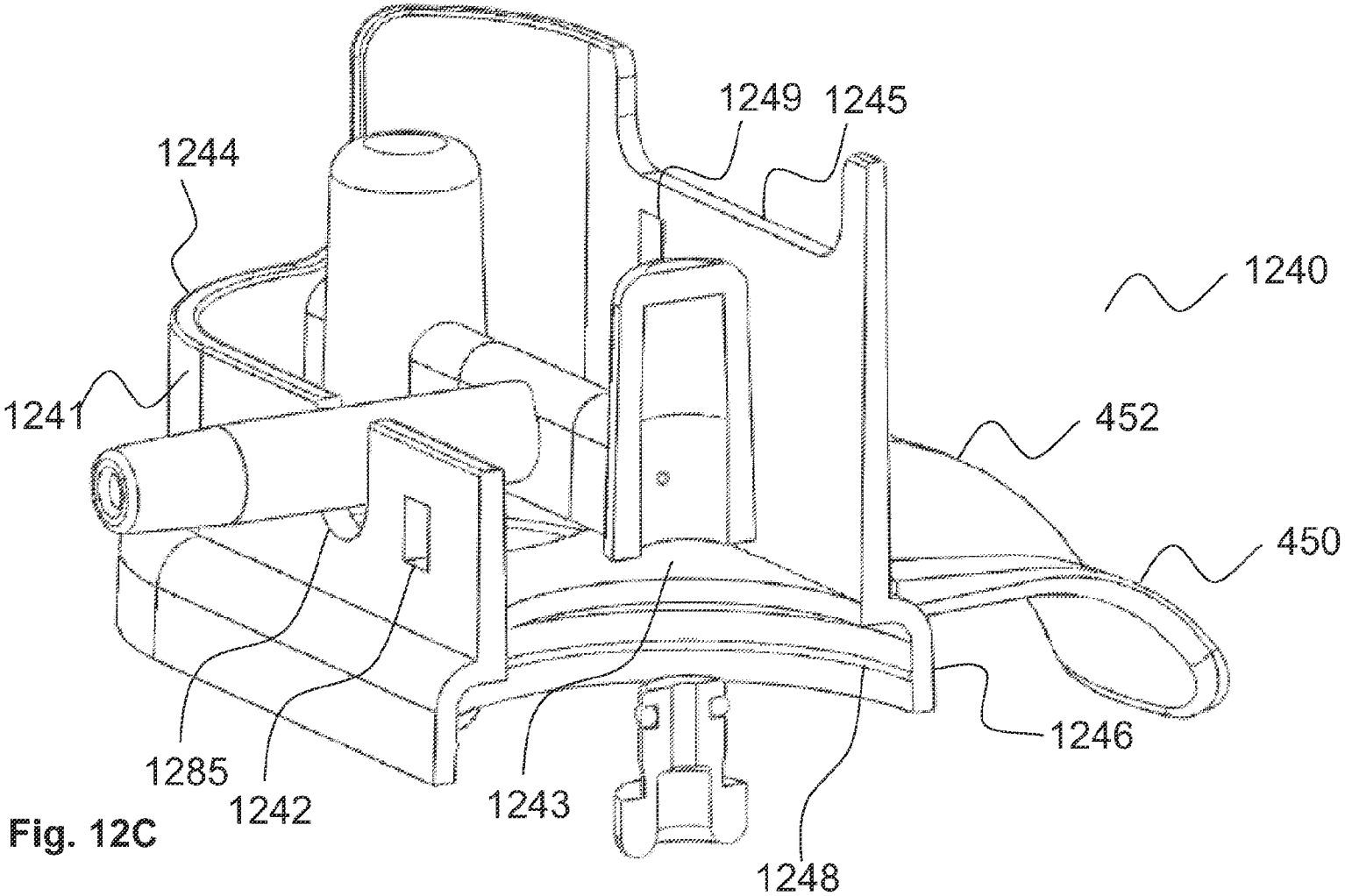
FIG. 12C is a prospective view of a modified dual dispensing assembly including an integrated mixer unit and also providing a vertical cross section of one actuator assembly.

The dual enclosure unit 1240 (e.g. FIG. 12B) can be of any general geometry; however it typically has curvature and smooth rounded surfaces to provide comfort and ease of handling to the user (FIG. 12C). In some embodiments the assembly may be provide with one or more holding points, which are comprised of non slip material or have indentations or serations to facilitate a better grip. The dual enclosure unit encompasses the dual dispensing unit and containers. The peripheral wall 1244 of the dual enclosure unit is shaped to fit over and encompass the canisters/containers (not shown) and at the same time hold within its perimeter the adapters, caps and nozzles leading to the mixer. The top part of the front peripheral wall 1241 is similarly shaped to compliment the front peripheral wall 1281 of enclosure lid together interlinking to form one functioning assembly unit.

In one or more embodiments the enclosure unit includes a surface 1243 which rests on top of the containers and sized about a size to accommodate two container tops. In one or more embodiments the surface is flat. In other embodiments it may be curved or contoured to achieve an improved inter-relationship between components. The surface 1243 has at least two holes 1247 to accommodate at lest two actuator assemblies (FIGS. 12A and 12C). The peripheral wall 1244 illustrated is approximately perpendicular to the surface 1243 and contains a front and back wall which may be parallel to each other. In some embodiments the peripheral wall may describe an angle extending outwards of more than 90 degrees. The front peripheral wall 1241 has two mounting arm apertures 1242 at locations on either side of mixer nozzle for snuggly receiving two mounting arms 1282 of the lid. The front peripheral wall further comprises a bottom nozzle hole 1285, which is illustrated as a partial elliptic hole for accommodating the protruding nozzle of the mixer, although it may be any suitable shape. The back peripheral 1245 wall has a tail aperture 1249 for accommodating the tip 1284 of a long tailed mounting arm 1282. The tail aperture 1249 is aligned with the arm aperture 1242 of the front wall (e.g. FIG. 12D). The back wall may be generally higher than the front wall. The back wall 1245 is concaved to receive the lever 1287 and facilitate its movement within. The bottom of the peripheral wall 1244 can include one or more support braces 1246. The lower edge of the brace 1246 is configured to attach on the top portion of the necks of containers. The brace 1246 can include a circumferential rib 1248 that further secures the enclosure unit 1240 to necks of the containers (e.g. FIG. 12C). Ribs can be located at regular or random intervals along the inner circumference of the enclosure unit. The enclosure unit may include a handle 450 which is secured onto the back peripheral wall with two sails 452 ((e.g. FIGS. 12F, 12C and 12E).

Figure 12D:
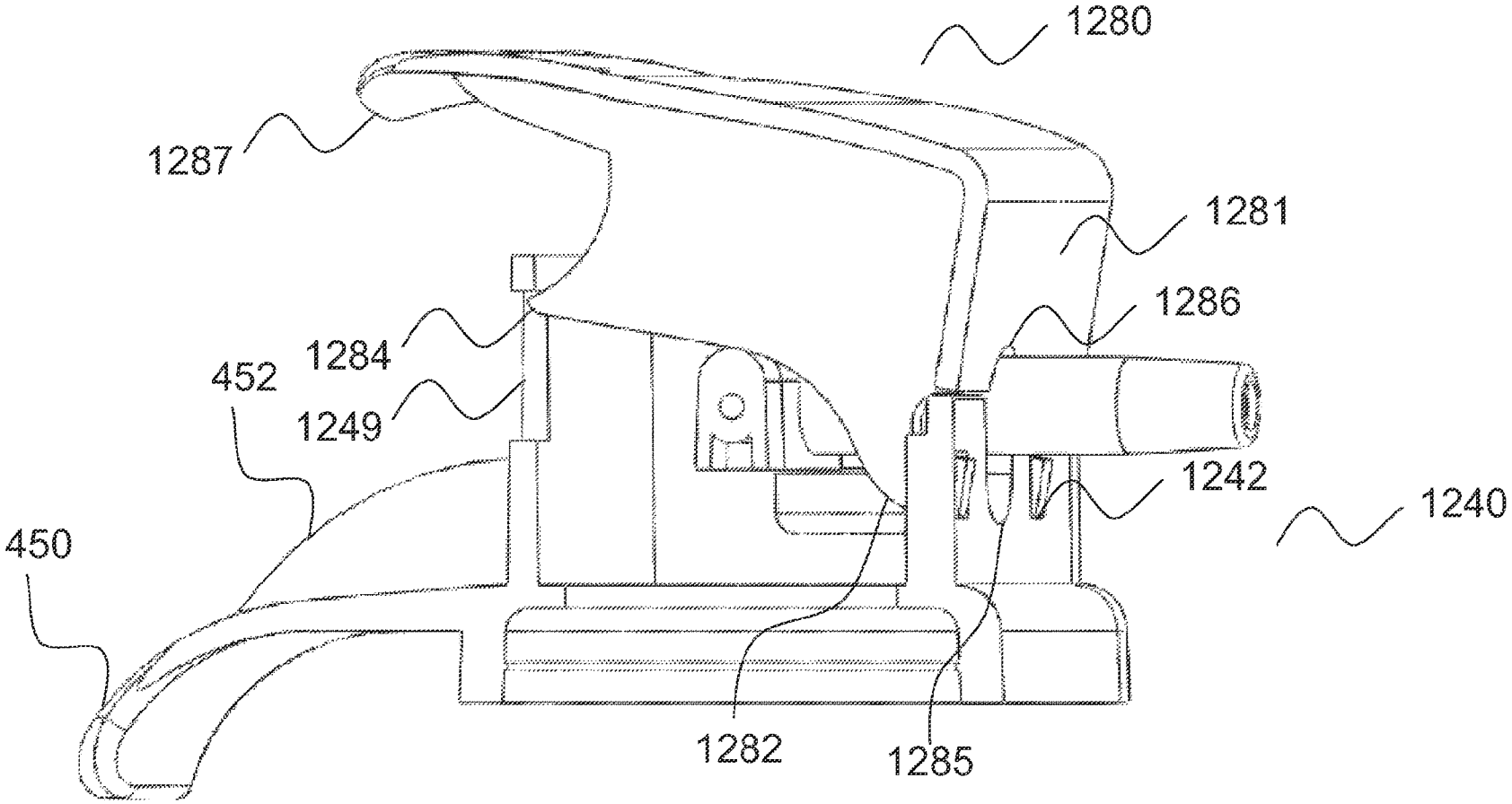
FIG. 12D is a prospective vertical cross section view of an assembled dual dispensing assembly comprising an integrated mixer unit and a lid.
Figure 12E:
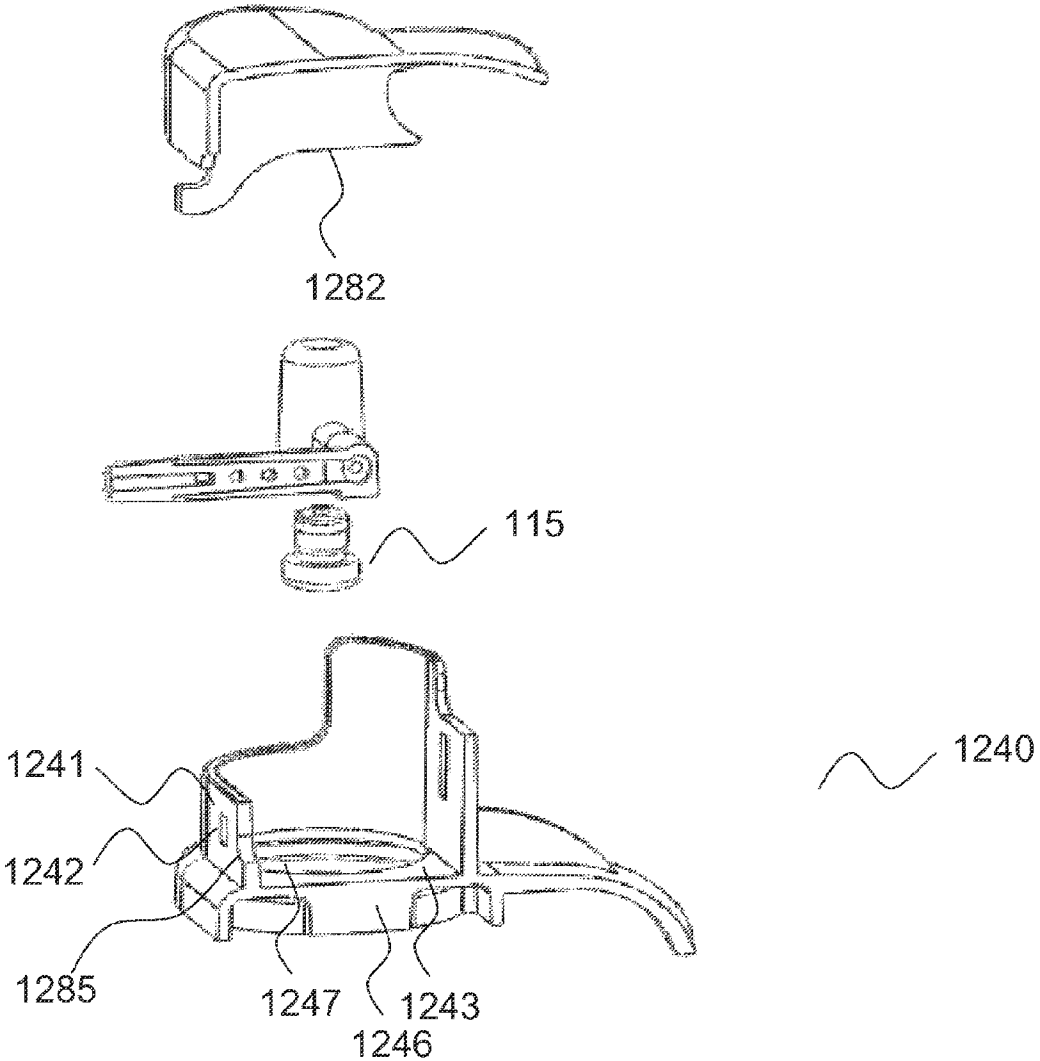
FIG. 12E is a prospective vertical cross section view of a disassembled dual dispensing assembly comprising an integrated mixer unit and a lid.
Figure 12F:
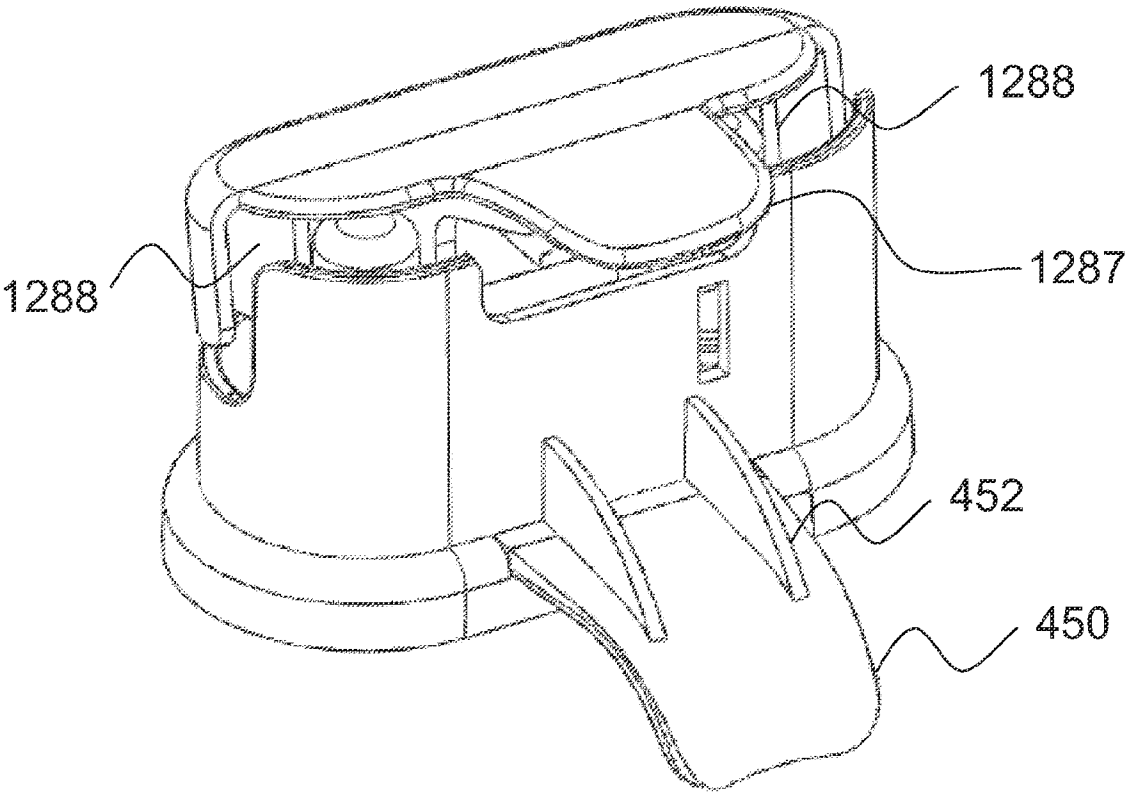
FIG. 12F is a prospective rear view of an assembled dual dispensing assembly comprising an integrated mixer unit and a lid.

According to further embodiment an enclosure unit lid 1280 is mounted over and covers the dual dispensing unit (e.g. FIG. 12D). The front peripheral wall of the lid 1281 is as illustrated to be complimentary to the front peripheral wall of the enclosure unit 1241 and contains a top nozzle hole 1286 which is complimentary to the bottom nozzle hole 1285 and together forms a hole which facilitates vertical movement of the protruding mixer nozzle within. Other formats and orientations can be envisaged to achieve the same objectives. The top of lid, for example, may be flat or curved. The lid is secured onto the enclosure unit via two mounting arms 1282. The mounting arms extend from both sides of the bottom of the lid. Each mounting arm may be the same or one may be longer than the other. In one or more embodiments the enclosure unit lid 1280 has extending opposite each mounting arm a tail arm whose tip 1284 is secured in a tail aperture 1249 which is adapted so as to be large enough to allow up and down movement of the tail within tail aperture. The ends of the mounting arms are configured to fit the arm apertures 1242 of the enclosure unit. This configuration allows for a pivoting motion of the lid 1280 within the enclosure unit (FIG. 12D). The pivoting motion of the lid, when applied downward exerts a force on the valves through the caps and adapters to actuate the valves. In one or more embodiments the inner side of the lid may optionally display two short bridge sails 1288 which are placed approximately perpendicular to the lower surface of the lid and positioned over each shoulder 1270 of the dual dispensing unit (FIGS. 12E, F and).

In one or more embodiments additional leverage is obtained by providing or extending an actuating lever 1287 on enclosure unit lid 1280. When pressure is applied on the actuating lever the enclosure lid unit pivots down to apply pressure on the caps, and thereby the adapters and the canister valves of the dual dispensing unit. The lever may have a finger engageable indentation. When user depresses the lever both bridges and mounting arms cause the dual dispensing unit to move pivotally down from a first non actuated position to a second actuated position. The mechanism of operation is the same principle but in duplicate mutatis mutandis as that described for a single dispensing assembly. An additional challenge of the dual unit is to achieve simultaneous and coordinated release from both canisters of a desired amount, which may be the same or different for each canister. Similarly the system is adapted for use with a formulation content of each canister that may be closely the same or very different.

By way of a non-limiting example, in operation, according to an embodiment a user may hold onto a handle 450 and employ pressure from a finger, e.g., a thumb or forefinger on a lever 1287 resulting in the dual dispensing unit being pushed down and actuating both valves simultaneously (FIG. 12D). Upon release of pressure the dual dispensing unit returns to its original position and releases a standard dose of content from each canister and dispensing ceases. The internal size of the chamber may differ or be the same for each cap. The dual dispensing assembly may be readily snapped in place on the containers' neck portion. The dual dispensing assembly is disposed so that it can be in flow communication with each valve stem end of each of the containers containing a pressurized content.

The nozzle hole as well as the bridges and mounting arms can help serve as a guiding and stopping mechanism for proper positioning and use of the dual dispensing unit on the dual enclosure unit. Its design provides a stop and a resistance (to the effect of the upward force of the movement of the internal valve spring and or the upwards force of the propellant through the content as it enters into the metering chamber) so that the dual dispensing unit readily returns to its proper position in its non-actuated state so it is ready to release a repeat unit dose.

Figure 12G:
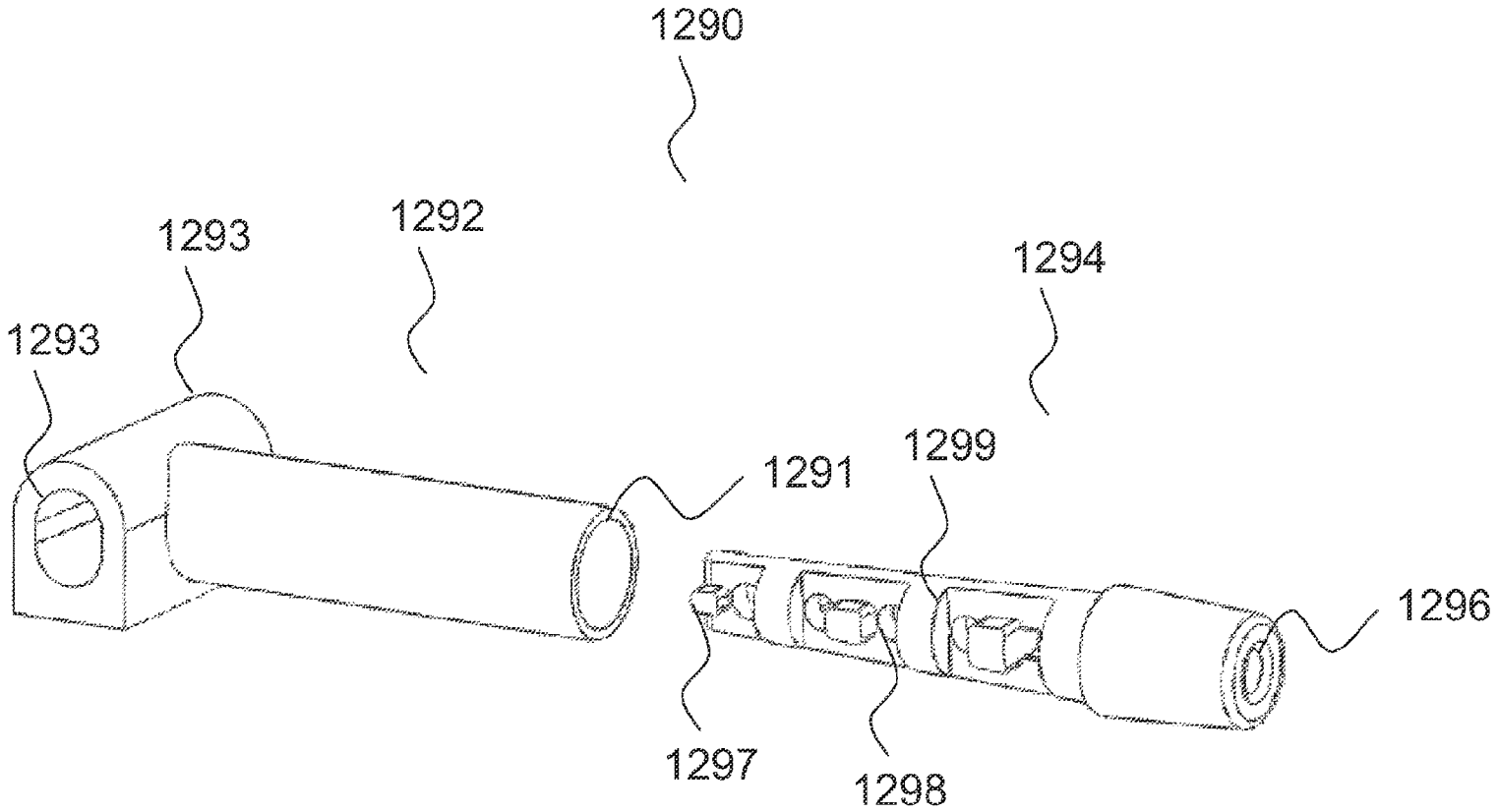
FIG. 12G is a prospective view of a disassembled mixer unit comprising an insert and a body.
Figure 12H:
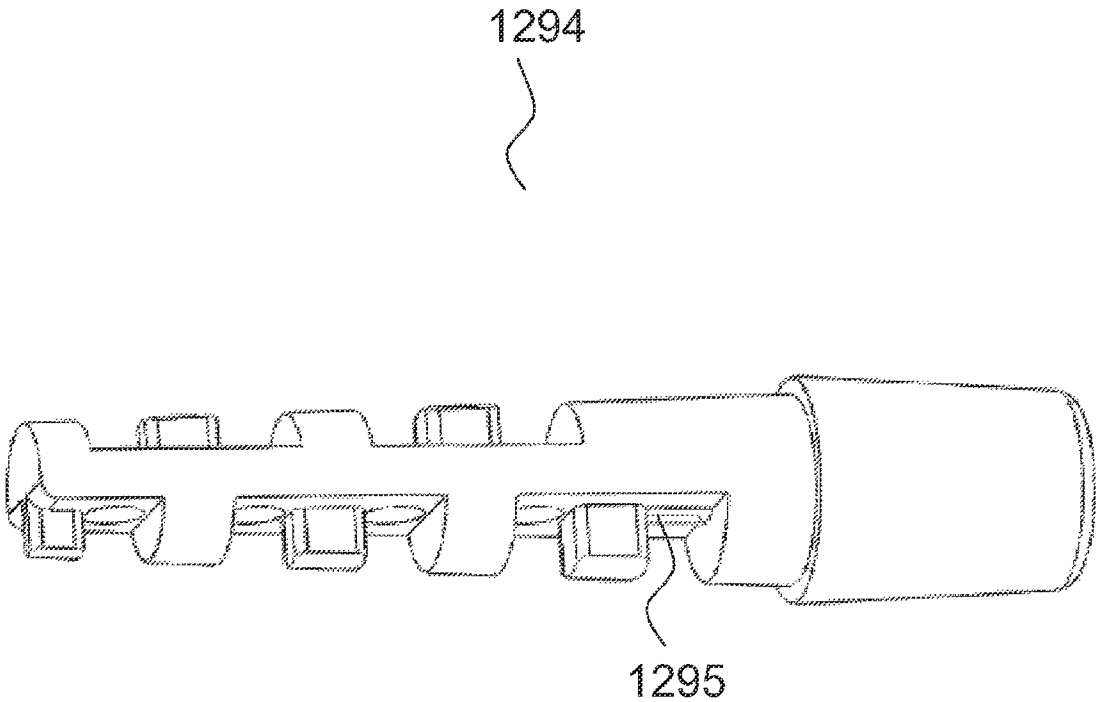
FIG. 12H is a prospective view of integrated mixer's insert.

FIG. 12G is a prospective view of a disassembled integrated mixer unit 1290 according to one or more embodiments. The mixer unit may be molded as one unit or is made of two or more components where the first is a hollow body 1292 shaped like a "T" and the second is mixer insert 1294 which is disposed within the hollow body. In the embodiment illustrated, the body includes an outlet 1291 into which the mixer insert can be inserted and two inlets 1293 in a diameter and structure suitable for receiving two nozzles one from each of the dispensing units to provide a sealable leak proof connection. On both sides of the mixer's insert are included a series of alternating protruding structures 1297 and indentations 1298 to improve mixing within the mixer. The former can be rectangular, square, circular or some other similar shape. The latter can be orifices 1298, which may likewise be rectangular, square, circular or some other similar shape. The external surface 1299 of the protruding structures is curved or shaped to match the inner surface of the hollow body 1292. It may in one or more other embodiments have different alternating pathways, forcing mixing of the two contents. The pathways may form differing obstructions and pathways that encourage mixing. Some of the surface may obstruct and some surface may allow the flow of the contents. The surfaces and orifices may vary in shape, size, number and spacing facilitating different levels of mixing. The mixer insert terminates with an outlet nozzle 1296 from which the mixed content is expelled.

The insert may have different diameters. In one or more different embodiments the distal end diameter of the insert may be the same, narrower or wider than the proximal diameter. In one embodiment the distal end is wider as this may be helpful for foamable formulations to allow some expansion of the foam as it is exiting and mixing. In other embodiments mixing may be facilitated by keeping the contents from expanding, when the diameter is maintained the same or sometimes by a narrowing at the distal end compressing the content together to improve mixing before release and full expansion of pressurized content if the product is for example is a mousse or foam. The shape and size of the diameter of the insert can influence or control the rate of release and the spread of the formulation depending also on the formulation and expulsion method.

Content is expelled from each dispensing unit enters simultaneously through each inlet into the hollow body. Contents is forced around the different obstructing surfaces on both sides of the mixer and through the orifices alternating from side to side until the final mixed content is forced to enter aperture 1295 on one side of the insert. The mixed content exits through the outlet nozzle 1296.

For example, in an embodiment there are at least four orifices 1297 which allow the flow of the content from one side of the insert to the other. There are at least three curved surfaces 1299 of increasing widths and heights on each side of the insert and are adapted to take into account the shape of the internal wall of the hollow body 1292. The curved surface 1299 closest to the distal end on the side of aperture 1295 is shorter than the curved surface on the other side. The side with aperture 1295 comprises at least three rectangular protruding structures 1297 whereas the other side of the insert comprises at least two rectangular protruding structures 1297 The rectangular protruding structures 1297 and the curved surfaces 1299 increase in width and height the closer they are to the distal end of the nozzle. The rectangular protruding structures 1297 and the curved surfaces 1299 are positioned back to back to each from both sides of the insert. FIG. 12H is a prospective top view of insert which demonstrates one embodiment of the alternating series which facilitates mixing. In one or more embodiments the protruding structures can be increased on one side or both sides. In one or more embodiments the orifices can be increased. In one or more embodiments the curved surfaces can be increased.

The unit dose is at least in part defined by the chamber volume within a cap. The volume may be a product of the diameter and length or height of the chamber volume.

According to one or more embodiments of the modified dispensing assembly the diameter of the chamber within the cap is about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm.

According to one or more embodiments of the modified dispensing assembly the diameter of the chamber within the cap is greater than 1 mm, greater than 5 mm, greater than 10 mm, greater than 15 mm.

According to one or more embodiments of the modified dispensing assembly the diameter of the chamber within the cap is between about 1 mm and 20 mm, between about 3 mm and 15 mm, between about 5 mm and 10 mm.

According to one or more embodiments of the modified dispensing assembly the diameter of the chamber within the cap is about 6 mm. According to another embodiment the diameter of the chamber within the cap is about 12 mm.

According to one or more embodiments of the modified dispensing assembly the height of the chamber within the cap is about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm.

According to one or more embodiments of the modified dispensing assembly the height of the chamber within the cap is greater than 1 mm, greater than 5 mm, greater than 10 mm, greater than 15 mm.

According to one or more embodiments of the modified dispensing assembly the height of the chamber within the cap is between about 1 mm and 20 mm, between about 3 mm and 15 mm, between about 5 mm and 10 mm.

According to one or more embodiments of the modified dispensing assembly the height of the chamber within the cap is about 15 mm.

According to one or more embodiments of the modified dispensing assembly the height of the chamber within the cap, in an actuated state, is about 1 mm, about 2 mm, about 3 mm, about 4 mm, about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm.

According to one or more embodiments of the modified dispensing assembly the height of the chamber within the cap, in an actuated state, is greater than 1 mm, greater than 5 mm, greater than 10 mm, greater than 15 mm.

According to one or more embodiments of the modified dispensing assembly the height of the chamber within the cap, in an actuated state, is between about 1 mm and 20 mm, between about 3 mm and 15 mm, between about 5 mm and 10 mm.

According to one or more embodiments of the modified dispensing assembly the height of the chamber within the cap, in an actuated state, is about 9 mm.

The dimensions provided herein are only an example and may be scaled up or down proportionately to allow proper movement of the actuator assembly. In one or more embodiments the scale up or scale down may be within a range of about or less than about +/−500%, of about or less than about +/−400%, of about or less than about +/−300%, of about or less than about +/−250%, of about or less than about +/−200%, of about or less than about +/−150%, of about or less than about +/−100%, about or less than about +/−50%, about or less than about +/−30%, about or less than about +/−20%, about or less than about +/−10% about, or about or less than about +/−5%, provided that the close contact allowing proper movement of the actuator on an adaptor yet preventing leakage/seepage is maintained. A variation in the size and shape of one or more components may be applicable provided that the other components are sized and shaped to accommodate proper engagement and movement.

The principal of operation as shown in FIGS. 3A-C also applies to the modified embodiments.

What is different in the single dose modified embodiments is for example:

1. The cap and nozzle arrangement. In the single dose modified the cap which together with adaptor defines the metering chamber. The cap can move downwards to actuate and upwards to release (and does not require a pivoting action as required in the device in FIG. 2 which pivots about axis 239). The cap has rails in the side walls into which fit projections 1045 (or wheels) located on the inside of the enclosure unit 1040 (see FIG. 10A) that sits on the canister. The rails/projections define the up/down movement of the cap in relation to the enclosure unit.
2. In the modified arrangement, the nozzle can be separate or replaceable by other nozzles or applicators or not present at all.

What is different in the dual dose modified embodiments is the structure which e.g. affects how it is actuated and how the actuation applies force to the caps of the dual chamber assembly.

During operation, the dispensing assembly is relocated back into the original resting position to enable repeated use via the pressurized content and the internal valve spring. However, this can be accomplished in a number of alternative ways, such as by a mechanical means, which can be simply physical pressure applied by an operator pushing the dispensing assembly upwardly or by incorporating a resilient means that will help return the dispensing assembly back into its uplifted resting position. The resilient means can for example be a spring. The spring is positioned below the assembly and is in a relaxed state. Upon actuation, the dispensing assembly is pressed into the spring. The resilient force of the spring pushes the dispensing assembly back to its original position. In an embodiment the resilience of the spring is less than the resilience of that in the internal valve.

As shown in the figures, the usual embodiment is where the canister is upright and the assembly sits on the top of the canister (at about 90 degrees to the canister). Nevertheless, the dispensing apparatus may be adjusted or adapted for use where the canister is at an angle other than at about 90 degrees to the canister. According to a further embodiment there is provided a dual chamber assembly wherein the containers are positioned at angle to each other instead of standing vertically parallel to each other. According to a further embodiment the containers are horizontally positioned along a same horizontal plane in a sort of handle bar orientation where the dispensing assemblies are located in between the dual chamber device. In one or more embodiments the cap of the first dispensing assembly rests on the flat top surface of enclosure unit of the second container and the cap of the second dispensing assembly rests on the flat top surface of the first container. The caps are sized and shaped so that an actuating action applies the same or very similar pressure on both dispensing assemblies by the flat top surface of each enclosure unit at the same time causing the simultaneous actuation and release of content form each discharge passage to a dispensing unit. The actuator action can be simply brought about by pressing one canister in the direction of the other, or by pressing both canisters together or providing a lever or switch that when operated will apply simultaneous actuation to both assemblies.

In one or more embodiments a dual dispensing unit encompassing a pair of caps could be diagonally and pivotally attached to dual enclosure unit using pins which slidably fit into slots in a pair of mounting arms of the dual enclosure unit. In an embodiment the pins may also be positioned diagonally. Alternatively, according to another embodiment a dispensing unit is provided that is adapted for latitudinal attachment to slots in mounting arms of enclosure unit. In one or more embodiments the caps can be separate from the dispensing unit. In which case the dispensing unit can have holes in which the caps fit. In certain embodiments mounting pins are equally positioned on both sides of the dispensing unit to fit into parallel slots of the enclosure unit. In certain other embodiments the mounting pins are positioned diagonally fit into parallel diagonal slots of the enclosure unit, which allows the dispensing unit to sit diagonally between the two canisters. In one embodiment, when one of the canisters is compressed towards the other canister the dispensing unit moves from a diagonal position to a longitudinal (i.e. at approximately right angles to the horizontal direction of the canisters) position. The movement from a diagonal to a longitudinal position depends on and is determined by the location of the pins.

According to certain embodiments of the dual chamber actuator can be molded as one unit together with the dispensing units, or according to other embodiments they can be attachable through two holes, at the top surface of the dispensing units, which can extend beyond the contour surface of the dual dispensing unit, and form an integral part thereof.

In one or more alternative embodiments the containers can be aligned longitudinally in an enclosure unit facing cap to cap and pivotally connected to a dispensing unit. One container has its base resting on the inner side wall of one end of the enclosure unit. The other container has its base slightly protruding out of a hollow in the other end of the enclosure unit. When this protruding end is pushed by user into the enclosure unit both dispensing assemblies are actuated, the pins slide within the slots allowing both caps to be pushed down and release their unit contents simultaneously into the side dual dispensing unit. The dual dispensing unit moves form a first diagonal or latitudinal position to a second latitudinal or diagonal position respectively. Upon release of pressure the pins slide back in their respective slots and the side dual dispensing unit resumes its original position and dispensing ceases.

According to one or more embodiments, the apparatus is designed to release an adequate dosage of a formulation, which is a specific unit dose according to the needs of specific targeted surface and, if present, comprising a therapeutically effective dose of an active agent, by adjusting the size of the cylinder or chamber.

According to one or more embodiment the apparatus releases a formulation in the form of a foam in a volume that will allow effective spreading of the foam and active agent if present on the target surface in a correct amount and avoiding an underdose, overdose and or potential systemic effects. In foam formulation the design must further take into account density and viscosity of the formulation. As can be seen in the result section below there is a correlation between the amount by weight of each unit dose and the viscosity and the density of the formulation. As seen in Table 2 where the density of the foam formulation is low the weight of foam released is higher and vice versa. A similar correlation is seen between viscosity and weight of dose such that with low viscosity a higher weight is observed than with high viscosities. So in determining the amount of unit dose to be delivered some adjustment needs to be taken into account bearing in mind the formulation properties such as formulation viscosity prior to addition of propellant and foam density. In one or more embodiments the content properties may be varied to achieve a certain unit dose. For example, by fine tuning formulation parameters and adjusting the ratio between the liquid and solid components of the composition and or the propellant, the foam density and or formulation viscosity and therefore the dose can be varied without changing the volume of the metering chamber.

Aside from the ability to vary the amount of unit dose in one or more embodiments more than one unit dose may be expelled. The number of unit doses to be applied may vary depending on different factors such as condition, weight, age and gender of a specific user or the target.

In one or more embodiments a foam formulation is expelled from a standard pressurized canister where the propellant is part of formulation. According to other embodiments part of the propellant system is in the formulation and part of the propellant system is separate from the formulation, which is used to expel said formulation using a bag or can in can system. In this way it is possible to reduce the amount of propellant within the formulation and avoid unwanted gaseous effects, for example in vaginal applications, but still provide good expulsion from the canister, where the foamable formulation is expelled sufficiently quickly but without jetting or noise.

An apparatus and method for applying foam released from a pressurized container also are described. The apparatus and method amongst other things eliminates the requirements of a metered valve, a continuous valve, a specialized valve, a diaphragm, or an external reservoir of specific measure which is first filled and then emptied. Further the apparatus and method eliminate seepage/leakage. According to one or more embodiments the dispensing assembly is permanently affixed on canister. According to one or more embodiments the dispensing assembly may be attachable to canisters differing in shape and size thereby transforming one or more non-metered dose dispenser(s) into a standard dose dispenser(s). According to one or more embodiments the apparatus includes a set of adaptors to enable attachment of said assembly to non standard containers or canisters.

The apparatus solves a problem of dispensing a predetermined amount of content from each of one or more containers of a variety shapes and sizes using standard aerosol valves thereby satisfying both economical and safety needs. More specifically, according to one or more embodiments there is provided a foam metering apparatus which is capable of providing an accurate or reliable or repeatable measure or dose of content from a container, within metes and bounds of intended use. In one or more embodiments the amount of content released from the apparatus is a function of the size of the chamber. In one or more embodiments the weight dispensed is also a function of the formulation properties. In one or more embodiments the weight dispensed can also be a function of the propellant system selected and amount.

The content housed by container is flowable and can be a liquid, a semi-liquid or gas. Non-limiting examples of the content housed by container include lotions, creams, ointments, gels, liquid sprayable compositions, mousse compositions foamable compositions and other flowable forms.

The mousse and foamable compositions can be presented as a liquid, a cream or an ointment prior to release from the container. The apparatus can also be adapted for use with a bag in a can device, which contains both propellant and composition separately in the container or can, wherein the composition is enclosed in bag which is separate from the propellant but upon actuation the propellant expels a portion of the contents from the bag. In the former case the apparatus should include a further resilient means, such as a spring, to move or return the adaptor and cap to a non actuated (locked) position. In a further embodiment the bag may also contain propellant.

When the content is a foamable composition, for example, it includes components to provide the desired functionality of the foam upon administration such as polymeric agents to stabilize the foam, as well as additives that promote foam formation, such as surfactants, foam adjuvants and propellant. Aerosol propellants are used to generate and administer the foamable composition as a foam. Foamable compositions include, without limitation, foamable emulsions, foamable solutions, foamable suspensions, foamable gels, foamable non-aqueous formulations, foamable oleaginous formulations, foamable viscous materials, or extrudable materials, and foamable petrolatum formulations. The total composition including propellant, foamable composition and optional ingredients is referred to as the foamable carrier. Whilst higher levels of propellant can be used for foamable formulations the propellant usually makes up about 3% to about 40% or preferably from about 4% to about 35% or more preferably from about 5% to about 25% by weight of the foamable carrier. Where high levels of propellant are used they can have a cooling effect on the target, which may be undesired in sensitive areas and yet be desired where a mild soothing or anesthetic effect can be helpful to reduce pain or stinging or when shaving.

In one or more embodiments a propellant which is separate from the formulation can be used to expel said formulation from the container using a bag or can in can system as will be appreciated by someone skilled in the art. The formulation may be an ointment or a lotion or a cream or a gel or a spray or suspension which once expelled from container remains unchanged. It should be noted that a gel is thixotropic meaning it is semi-solid at rest, liquid upon application of shear forces thereto (therefore more spreadable and penetrable when rubbed onto the body surface) and returns to the semi-solid state upon standing.

In one or more embodiments the discharge passage can be bigger for non-foam formulations. In one or more embodiments it can be wider at the entrance. Non-foam formulations can be expelled by using propellant which is separate from the formulation using a bag in can or can in can system. Although, these systems can be used with compressed air the pressure may not be sufficient to expel the formulation through the device and higher pressure propellant such as AP70 should be selected. In an additional embodiment for use with non-foam formulations where there is no propellant in the formulation an expelling membrane can be placed at the top inside roof of the cap. In a simple form the membrane can be operated to create downward pressure on the formulation in the metering chamber to assist its expulsion through discharge passage. The membrane would be operated after the metering chamber has filled and the discharge passage becomes open. In a simple embodiment, the membrane would be depressed by pressing on a resilient button on the upper external surface of the cap which immediately returns the membrane to its original position at the top of the inside roof when the resilient button is released.

An effective amount of propellant is used to propel the contents from the canister so that the composition is not released so slowly so as to cause the user to wait a substantial period of time to receive the dose and or to display substantial tailing where the content is released in pulses and/or to display jetting where the propellant causes the contents to be expelled in forceful jets, which can be uncomfortable or even painful if the jets make contact with the user. In an embodiment, the propellant is a hydrocarbon propellant. Examples of suitable propellants include volatile hydrocarbons such as butane, propane, isobutane or mixtures thereof, and fluorocarbon gases. Non limiting examples are AP70; AP46; and 1681. Alternatively, use of ether propellants, fluorocarbon propellants, as well as compressed gases (e.g., air, carbon dioxide, nitrous oxide, and nitrogen) is also possible. Examples of other optional propellants are dimethyl ether (DME), methyl ethyl ether and hydrofluoroalkanes (HFA), for example HFA 134a (1,1,1,2,-tetrafluoroethane) and HFA 227 (1,1,1,2,3,3,3-heptafluoropropane). Mixtures of propellants can be useful. Typical concentrations of hydrocarbon and fluorocarbon propellants is between about 3% and about 25%, however, in various applications, higher concentrations, up to about 40% or in limited cases even up to about 70% can be used. The concentration of a compressed gas, such as carbon dioxide and nitrogen is restricted to up to about 5% to 10% due to their high pressure; however, it should be noted that even about 1% propellant depending upon the pressure and formulation may be sufficient to evolve a foam.

In one or more preferred embodiments, the propellant is a liquefied gas, such as butane, propane, isobutane or mixtures thereof. The liquefied gas typically forms a solution or emulsion with the other components of the content and is in equilibrium with propellant gas, which occupies a volume of the container (e.g., the "head space") and generates the internal pressure used to discharge the product from inside the container. Furthermore, upon release, the gas expands to form many "bubbles" within the composition thereby creating the foam. In one or more embodiments sufficient gas is contained in the container to substantially expel all the product from the container at the correct pressure throughout the life of the article. The quantity and quality of the foam also depends on the type of gases used.

In an embodiment the propellant is 1681, which is a mixture of propane, isobutene and butane. In another embodiment the propellant is AP 70, which is a mixture of propane, isobutene and butane under higher pressure.

In some embodiments, the ratio of the liquefied or compressed gas propellant to the other components of the formulation ranges from about 3:100 to about 25:100 by weight, from about 3:100 to about 35:100, from about 3:100 to about 40:100 or from about 3:100 to about 45:100. In some embodiments, the ratio of the liquefied or compressed gas propellant to the other components of the formulation is at least about 3:100, at least about 10:100, at least about 15:100, at least about 20:100, or at least about 25:100. In an embodiment, the ratio of the foamable carrier to the propellant is about 100:1 to about 100:25. In other embodiments, the ratio of the foamable carrier to the propellant is about 100:3 to about 100:30, is about 100:5 to about 100:15, is about 100:8 to about 100:20, is about 100:10 to about 100:30, is about 100:8 to about 100:45 or is about 100:12 to about 100:55.

Alcohol and organic solvents render foams inflammable. Fluorohydrocarbon propellants, other than chloro-fluoro carbons (CMCs), which are non-ozone-depleting propellants, are useful and include, but are not limited to, hydrofluorocarbon (HFC) propellants, which contain no chlorine atoms, and as such, fall completely outside concerns about stratospheric ozone destruction by chlorofluorocarbons or other chlorinated hydrocarbons. Exemplary non-flammable propellants include propellants made by DuPont under the registered trademark Dymel, such as 1,1,1,2-tetrafluorethane (Dymel 134), and 1,1,1,2,3,3,3-heptafluoropropane (Dymel 227), 1,1-difluoro ethane (Dymel 152) and 1,1,1,3,3,3-hexafluoropropane. HFCs possess Ozone Depletion Potential of 0.00 and thus, they are allowed for use as propellant in aerosol products.

In one or more embodiments, the propellant includes a combination of an HFC and a hydrocarbon propellant such as n-butane or mixtures of hydrocarbon propellants such as propane, isobutane and butane. Where mixtures are used, they can be selected to generate different levels of pressure. For example 1681 has a lower pressure than AP 40 which is lower than that provided by propane alone. The amount and pressure of the propellant is selected to provide release without powerful jets and without tailing such that the foam is released in ideally a substantially single unbroken pulse.

In one or more embodiments, "liquefaction" occurs following adding the propellant, which in turn will affect the viscosity substantially or radically. Thus in one or more embodiments, the compositions are liquefied or further liquefied by the propellant.

In one or more embodiments, propellant is used to create a spray instead of a foam or mousse. Where a spray is intended a high amount of propellant is used which is usually higher than that for a foam and can be for example about 85% or about 90% or about 95% by weight. There are different types of sprays and the amount of propellant will vary depending on the type and purpose of the spray. If the spray is to occupy a space, such as, applying insecticides or deodorants to a room the propellant can be between about 80% to about 98% of the formulation by weight. On the other hand if the spray is intended to coat a surface then lower levels of propellant may be used of about 25% to about 75% As noted herein, a spray or aerosol is a suspension of liquid droplets or solid particles in a gas, such as air; a foam is a substance that is formed by trapping many gas bubbles in a liquid or solid. A foam is normally an extremely complex system consisting of polydisperse gas bubbles separated by draining films.

In one or more embodiments, propellant is used to expel a "cream" instead of a foam or mousse or spray. In one or more embodiments, propellant is used to expel a "lotion" instead of a foam or mousse or spray or cream.

Advantages of the Present Apparatus, Applicator and Method for Release of a Measured Content from a Container:

Advantages have been realized from placement of the metering mechanism within the actuator assembly rather than within the internal valve structure. Generally, such an arrangement involves a less complex and less costly dispensing construction.

An internal non-metering valve construction is generally of a simple, easy to fill and relatively problem-free design diminishing the possibility of valve malfunction. Simplification of the internal valve structure makes possible the provision of a more reliable dispensing system. So combination of a system to provide a standard dose with a standard simple valve avoids or minimizes risk of valve malfunction, seepage, and waste and it is possible to replace a metering actuator without requiring sacrifice of the remaining contents of the container. Further advantages reside in the fact that containers and valves may be manufactured in a standard arrangement with subsequent mounting of a metering actuator determining whether the dispensing system is to be a continuous system or a standard dose system. Furthermore, a metering actuator assembly could be reused by remounting upon new containers after the contents of an initially used container had been exhausted. Additionally, canisters with these simple and standard valves can be filled directly though the canister valve before assembly and do not require any special filling.

The principle of operation of the metering chambers (single and multiple) involves closing a discharge passage at the time that the internal valve of the container is opened, to effect a charging or filling of a metering chamber. All this can occur upon the initial actuation or depressing movement of the actuator. Upon release of the actuator, the internal valve of-the container becomes closed and the discharge passage is cleared or opened whereby the contents of the metering chamber will issue from the discharge passage. The relatively simple structure of the metering apparatus, using the above principle of operation, does not require any diaphragm or any spring to open or close the metering valve. It allows use with different sized or adjustable sized metering chambers, thereby being capable of delivering different "unit" doses reliably. This is enabled by incorporating a very effective adaptor having a special structure including a sealing ring which provides inter alia for seepage free operation.

The risk of continuous flow and other disadvantages of metering type actuator buttons are obviated by the apparatuses, applicators and methods provided herein. Thus, there is provided a novel and improved metering dose actuator assembly of the type which may be used with different kinds of non-metering aerosol dispensers, and wherein the likelihood of a continuous discharge occurring is very greatly minimized or effectively eliminated. The corollary to this is that a repeatable and positive metering action should ensue.

Another feature of the apparatuses, applicators and methods provided herein resides in the provision of an improved metering actuator assembly which is especially leak proof, whereby undesired dripping, seepage and the like through the discharge passage or past the operating parts is eliminated.

Another feature of the apparatuses, applicators and methods provided herein resides in the provision of an improved positive-acting metering type actuator assembly as set forth herein, which is of relatively simple construction, involving a minimal number of parts and in a certain embodiment includes only two main parts which may be economically fabricated or produced and assembled, by simple manufacturing techniques.

Another feature of the apparatuses, applicators and methods provided herein resides in the provision of an actuator assembly which is intended for standard small hand-held aerosol devices of the type employing standard valves. It may be readily applied to various makes of aerosol dispensers having non-metering valves, and will simply and quickly convert such dispensers into metering type devices.

The apparatuses, applicators and methods provided herein further provide an actuator assembly which allows fast filling of the container directly through the hollow stem of the internal canister valve in the same manner conducted with conventional dispensers having non-metering valves before the apparatus or actuator is added. In other words filling does not take place through the apparatus but directly into the canister, which when filled is quickly and easily attached to the apparatus, which is then ready for use. This further facilitates re-use of the apparatus by allowing refilling of the same canister or alternatively replacing the used canister with a new full canister.

The apparatuses, applicators and methods provided herein are able to provide different dosages of a formulation or a combination of different doses of different formulations (with multi chambered devices) by using different sized chambers or cylinders or by using an adjustable controlled dose chamber according to the specific needs of the user and target site. Where the device provides for multiple containers the release can be selected to be simultaneous or staggered and may be an equal amount or different amounts form each container.

Thus, there are provided apparatuses, applicators and methods which satisfy a long existing need for relatively simple, and inexpensive metering or unit dose actuator for a repeatable release of a "unit" content from a container, which avoids unwanted leakage or continuous release. Additionally they can be used with standard canisters and valves. The need and uses of such a dosing apparatus vary widely and can include any process requiring or enhanced by a controlled application of "unit" content and can usefully replace "guesstimate" applications for example using a brush, hands or any other similar implement or applicator.

Foam metering devices capable of providing a repeatable measure or dose of content from a pressurized container are provided. The apparatus and method relates to a standard dose dispensing assembly wherein the metering or measuring is affected in the actuator assembly with discharge occurring upon down stroke of a cylinder in the assembly. In particular, the apparatus provides effective sealing of the actuator assembly which eliminates or prevents unwanted leakage and or continuous release. It can be used with standard small hand-held aerosol devices of the type employing standard metering valves. It may be readily applied to various makes of aerosol dispensers having non-metering valves, and will convert such dispensers into metering type devices. The standard dose may be adjusted, for example, dynamically according to the specific needs of the application and or user.

EXAMPLES

The dose reproducibility of a single chamber unit dose prototype apparatus, as illustrated in FIG. 2, was tested as follows. For each of the different formulations below, 20 g of pre foam formulation was introduced into a canister, a valve was crimped and the aerosol was pressurized with propellant. The cylinder actuator was mounted on the valve, and 15 foam samples were dispensed and weighted.

Materials

TABLE 1

Exemplary possible ingredients suitable for the production of foamable compositions disclosed herein. Equivalent materials from other manufacturers can also be used satisfactorily.

| Chemical Name | Function | Commercial Name | Supplier |
|---|---|---|---|
| Beeswax white | Foam adjuvant | Beeswax white | Henry Lamotte |
| Behenyl alcohol | Foam adjuvant | Lanette 22 | Cognis |
| Capric Caprilic Triglycerides | Solvent | Captex 355 | Abitec |
| Castor oil | Solvent | Castor oil | Fluka |
| Ceteareth-20 | Surfactant | Sympatens acs 200G | Colb |
| Cetostearyl alcohol | Foam adjuvant | Speziol C16-C18 | Cognis |
| Cetyl alcohol | Foam adjuvant | Speziol C16 | Cognis |
| Cholesterol | Wax | Cholesterol | Spectrum |
| Cyclomethicone-5 | Solvent | ST-cyclomethicone-5 | Dow |
| Glyceryl monostearate | Surfactant | Cutina GMS V PH | Cognis |
| Heavy Mineral Oil | Solvent | Paraffin oil liquid heavy | Gadot |
| Hydrogenated castor oil | Foam adjuvant | Cutina HR | Cognis |
| Hydroxypropyl methylcellulose | Polymer | Methocel K100M | Dow |
| Hydroxypropylcellulose | Polymer | Klucel | Hercules |
| Isopropyl myristate | Solvent | Isopropyl Myristate Ph. | Cognis |
| Light Mineral Oil | Solvent | Pioner 2076P | Hansen & Rosenthal |
| Methylparaben, Ethylparaben, Propylparaben in Phenoxyethanol | Preservative | Sharomix 824 | Sharon Labs |
| Myristyl alcohol | Foam adjuvant | Speziol C14 | Cognis |
| PEG-40 Stearate | Surfactant | Myrj 52 S | Croda |
| Petrolatum White LMP | Carrier | White Petrolatum | Sofmetic |
| Polyethylene glycol-400 | Solvent | PEG 400 | Sigma-Aldrich |
| Polysorbate 80 | Surfactant | Tween 80 | Merck |
| PPG 15 stearyl ether | Solvent | Arlamol E | Uniqema |
| Propane/Isobutane/Butane (55:18:27) | Propellant | AP-70 | Aeropress |
| Propylene glycol | Solvent | Propylene glycol | Gadot |
| Silica, Surface modified | Dispersant | Aerosil R 972 PH | Evonik-Goldschmidt GmbH |
| Steareth-2 | Surfactant | Brij 72 | Spectrum |
| Stearic acid | Foam adjuvant | Edenol ST1M | Cognis |
| Stearyl Alcohol | Foam adjuvant | Speziol C18 | Cognis |
| Xanthan Gum | Polymer | Xantural 11K | CP Kelco |

Tests

Density

The foam product is dispensed into vessels (including dishes or tubes) of a known volume and weight. Replicate measurements of the mass of foam filling the vessels are made and the density is calculated. The canister and contents are allowed to reach room temperature. The canister is shaken to mix the contents and 5-10 mL are dispensed and discarded. Then the foam is dispensed into a pre-weighed tube, filling it until excess is extruded. Excess foam is immediately removed (leveled off) at both ends and the filled tube is weighed on the weighing balance.

Viscosity

Viscosity is measured with Brookfield LVDV-II+PRO with spindle SC4-25 at ambient temperature and 20, 10, 5 and 1 RPM. Viscosity is usually measured at 10 RPM or 20 RPM. However, at about the apparent upper limit for the spindle of ~>50,000 CP, the viscosity at 1 RPM may be measured, although the figures are of a higher magnitude.

Foam Quality

Foam quality can be graded as follows:

Grade E (excellent): very rich and creamy in appearance, does not show any bubble structure or shows a very fine (small) bubble structure; does not rapidly become dull; upon spreading on the skin, the foam retains the creaminess property and does not appear watery.

Grade G (good): rich and creamy in appearance, very small bubble size, "dulls" more rapidly than an excellent foam, retains creaminess upon spreading on the skin, and does not become watery.

Grade FG (fairly good): a moderate amount of creaminess noticeable, bubble structure is noticeable; upon spreading on the skin the product dulls rapidly and becomes somewhat lower in apparent viscosity.

Grade F (fair): very little creaminess noticeable, larger bubble structure than a "fairly good" foam, upon spreading on the skin it becomes thin in appearance and watery.

Grade P (poor): no creaminess noticeable, large bubble structure, and when spread on the skin it becomes very thin and watery in appearance.

Grade VP (very poor): dry foam, large very dull bubbles, difficult to spread on the skin.

Topically administrable foams are typically of quality grade E or G, when released from the aerosol container. Smaller bubbles are indicative of a more stable foam, which does not collapse spontaneously immediately upon discharge from the container. The finer foam structure looks and feels smoother, thus increasing its usability and appeal.

Example 1

Tested Formulations

| Emulsion Foam | |
|---|---|
| Ingredient | % w/w |
| Mineral oil | 5.60 |
| Isopropyl myristate | 5.60 |
| Glyceryl monostearate | 0.45 |
| PEG-40 Stearate | 2.60 |
| Stearyl alcohol | 0.85 |
| Xanthan gum | 0.26 |
| Methocel K100M | 0.26 |
| Polysorbate 80 | 0.90 |

-continued

| Emulsion Foam | |
|---|---|
| Ingredient | % w/w |
| Water purified | 74.88 |
| Sharomix 824 | 0.60 |
| Total | 100.00 |
| Propellant AP-70 | 8.00 |

Procedure

1. Heat oils, PEG-40 stearate, Glyceryl monostearate, Polysorbate 80, Stearyl alcohol to 60-70° C. until complete melting and homogeneity is obtained
2. Mix together water, Methocel and Xanthan gum until uniform dispersion is obtained. Heat to 70° C.
3. Add slowly the oil phase to the water phase at 60-70° C. in 3 portions with agitation. Continue mixing for at least 15 min.
4. Cool the emulsion to 40° C. and add Sharomix 824.
5. Cool to RT.
6. Fill the PFF into canisters, crimp with a suitable valve and pressurize with propellant.

| Ointment Foam | |
|---|---|
| Ingredient | % w/w |
| PPG-15 Stearyl ether | 7.0 |
| Capric/caprylic triglycerides | 6.0 |
| Mineral oil light | 25.0 |
| Petrolatum white (sofmetic) | 50.0 |
| Ceteth-20 | 4.0 |
| Steareth-2 | 3.0 |
| Cetostearyl alcohol | 4.0 |
| Behenyl alcohol | 1.0 |
| Total | 100.00 |
| Propellant AP-70 | 10.00 |

Procedure

1. Mix together all ingredients and heat up to 70-80° C. until complete melting and homogeneity is obtained.
2. Mix for at least 5 min. Cool down to RT while mixing using marine type impeller.
3. Fill the PFF into canisters, crimp with a suitable valve and pressurize with propellant.

| Oily Foam | |
|---|---|
| Ingredient | % w/w |
| Heavy mineral oil | 59.25 |
| Light mineral oil | 25.00 |
| Cyclomethicone | 5.00 |
| Stearyl alcohol | 1.50 |
| Beeswax | 2.00 |
| Stearic acid | 2.00 |
| hydrogenated castor oil | 1.50 |
| Behenyl alcohol | 1.00 |
| Cetostearyl alcohol | 2.50 |
| Silicon dioxide | 0.25 |
| Total | 100.00 |
| Propellant AP-70 | 8.00 |

Procedure

1. Heat oils to 60-70° C. except mineral oil
2. Add surfactants and alcohols and mix well 3. Heat mineral oil to 40-45° C. and add lecithin, mix well at clear solution
4. Cool rapidly step 2 using ice bath at 45 C, Add step 3
4. Mix vigorously
5. Allow to mix and reach RT
6. Fill the PFF into canisters, crimp with a suitable valve and pressurize with propellant.

| PEG-PG Foam | |
|---|---|
| Ingredient | % w/w |
| Propylene Glycol | 45.00 |
| PEG (polyethylene glycol) 400 | 45.00 |
| Ceteareth-20 | 3.00 |
| Steareth-2 | 0.50 |
| Honey | 5.00 |
| Hydroxypropyl cellulose (Klucel EF) | 1.50 |
| Total | 100.00 |
| Propellant AP-70 | 10.00 |

Procedure

1. Mix Propylene Glycol with PEG 400, add Klucel EF at room temperature and mix until homogeneity is obtained
2. Heat to 50-60° C., add steareth-2 and mix until homogeneity is obtained.
3. Cool to RT
4. Fill the PFF into canisters, crimp with a suitable valve and pressurize with propellant.

Example 2

Single Chamber Device—Reproducibility Tests

A single chamber device according to FIG. 3 was tested for dose reproducibility with various foam formulations, as described in Examples 1 above.

TABLE 2

Summary of the delivery results and formulation/foam properties.

| | Dose Weight (g) | | | |
|---|---|---|---|---|
| Dose No. | Emulsion Foam | Ointment Foam | Oily Foam | PEG Foam |
| 1 | 0.20 | 0.14 | 0.13 | 0.16 |
| 2 | 0.23 | 0.16 | 0.16 | 0.22 |
| 3 | 0.27 | 0.17 | 0.14 | 0.25 |
| 4 | 0.26 | 0.18 | 0.16 | 0.25 |
| 5 | 0.26 | 0.17 | 0.15 | 0.28 |
| 6 | 0.28 | 0.17 | 0.15 | 0.27 |
| 7 | 0.28 | 0.17 | 0.17 | 0.26 |
| 8 | 0.27 | 0.16 | 0.14 | 0.27 |
| 9 | 0.29 | 0.16 | 0.14 | 0.26 |
| 10 | 0.29 | 0.15 | 0.13 | 0.27 |
| 11 | 0.28 | 0.14 | 0.11 | 0.25 |
| 12 | 0.27 | 0.17 | 0.12 | 0.27 |
| 13 | 0.28 | 0.14 | 0.12 | 0.29 |
| 14 | 0.29 | 0.14 | 0.13 | 0.29 |
| 15 | 0.28 | 0.14 | 0.12 | 0.28 |
| Average | 0. 269 | 0.157 | 0.138 | 0.258 |
| St. Dev | 0. 024 | 0.014 | 0.017 | 0.033 |
| Foam Quality | Excellent | Excellent | Excellent | Excellent |
| Foam Density (g/mL) | 0.040 | 0.135 | 0.181 | 0.086 |
| Formulation Viscosity in cP at 10 rpm (prior to addition of propellant) | 1804 | 10033 | 14525 | 412 |

The prototype apparatus tested demonstrated good reliability and reproducibility, with a small standard variability of less than 10% with emulsion, ointment foams and of less than 13% for oily and PEG foams.

The lowest foam density produced the highest average weight of dispensed unit dose and vice versa. Similarly high viscosity formulations prior to addition of propellant produce smaller foam volumes than low viscosity formulations. Viscosity is a less direct indicator of weight released than density. This may be partly due to the fact viscosity is not measured with propellant present.

Example 3

Modified Single Chamber Device—Reproducibility Tests

A modified single chamber device according to FIG. 10A was tested for dose reproducibility with various foam formulations, as described in Examples 1 above.

TABLE 2

Summary of the delivery results and formulation/foam properties.

| | Dose Weight (g) | | |
|---|---|---|---|
| Dose No. | Emulsion Foam | Ointment Foam | Oily Foam |
| 1 | 0.17 | 1.09 | 0.54 |
| 2 | 0.17 | 1.12 | 0.53 |
| 3 | 0.16 | 0.98 | 0.49 |
| 4 | 0.17 | 0.93 | 0.52 |
| 5 | 0.18 | 0.98 | 0.47 |
| 6 | 0.19 | 1.00 | 0.47 |
| 7 | 0.16 | 0.93 | 0.41 |
| 8 | 0.17 | 0.94 | 0.45 |
| 9 | 0.17 | 0.92 | 0.42 |
| 10 | 0.18 | 0.85 | 0.48 |
| 11 | 0.16 | 0.72 | 0.47 |
| 12 | 0.17 | 0.75 | 0.46 |
| 13 | 0.16 | 0.73 | 0.43 |
| 14 | 0.16 | 0.77 | 0.42 |
| 15 | 0.15 | 0.72 | 0.42 |
| Average | 0.167 | 0.89 | 0.465 |
| St. Dev | 0.010 | 0.13 | 0.043 |
| Foam Quality | Excellent | Excellent | Excellent |
| Foam Density (g/mL) | 0.041 | 0.234 | 0.181 |
| Formulation Viscosity in cP at 10 rpm (prior to addition of propellant) | 1804 | 10033 | 14525 |

The prototype apparatus tested demonstrated good reliability and reproducibility with emulsion, and oily foams with a small standard variability of less than 10%. In the case of ointment and oily formulation, a decrease in the dose was observed in the last actuations. In the case of ointment, which was most affected by propellant levels the standard variability was less than 15%. This decrease may be due to a diminution of the concentration of propellant within the formulation, which causes a drop in the canister internal pressure. This may be solved by increasing the propellant concentration in the formulation.

Part B—Dual Chamber Device

A dual chamber device according to FIG. 12A was tested for dose reproducibility with various foam formulations, as described in Examples 5-7 below. In each of the examples below, two canisters were filled with the same exemplified formulation and were connected to the dual-chamber device.

Example 5

The formulations of Examples 1, 2 and 3 were tested with the dual chamber device. The results are as follows:

TABLE 3

Summary of the delivery results and formulation/foam properties.

| Dose No. | Dose Weight (g) Emulsion Foam | Ointment Foam | Oily Foam |
|---|---|---|---|
| 1 | 0.22 | 0.14 | 0.20 |
| 2 | 0.19 | 0.16 | 0.24 |
| 3 | 0.21 | 0.17 | 0.19 |
| 4 | 0.21 | 0.18 | 0.22 |
| 5 | 0.22 | 0.17 | 0.25 |
| 6 | 0.21 | 0.17 | 0.25 |
| 7 | 0.20 | 0.17 | 0.18 |
| 8 | 0.22 | 0.16 | 0.20 |
| 9 | 0.22 | 0.16 | 0.24 |
| 10 | 0.21 | 0.15 | 0.22 |
| 11 | 0.21 | 0.14 | 0.22 |
| 12 | 0.20 | 0.17 | 0.20 |
| 13 | 0.23 | 0.14 | 0.23 |
| 14 | 0.18 | 0.14 | 0.22 |
| 15 | 0.18 | 0.14 | 0.22 |
| Average | 0.376 | 0.206 | 0.218 |
| St. Dev | 0.014 | 0.015 | 0.021 |
| Foam Quality | Excellent | Excellent | Excellent |
| Foam Density (g/mL) | 0.041 | 0.234 | 0.181 |
| Formulation Viscosity in cP at 10 rpm (prior to addition of propellant) | 1804 | 10033 | 14525 |

Comments: The prototype apparatus tested demonstrated good reliability and reproducibility with emulsion, ointment and oily foams with a small standard variability of less than 10%.

Conclusions: The apparatus delivers a reliable and reproducible unit dose over a range of different foam formulations of distinctly different contents and properties. The variation in dose is low and is well acceptable for topical use and body cavity use. Such system is simple and effective to operate and is much more effective than current "guesstimates" of non standard doses where there is much variability between doses and patients and where patients apply a portion of what is expelled to the target area and significant wastage ensues. The apparatus and method is likely to lead to higher patient confidence satisfaction and compliance. In the examples shown above save one the first dose is the lowest dose. So if the first dose used is discarded the accuracy is even higher.

What is claimed is:

1. An apparatus for delivering a predetermined quantity of content from a pressurized container, comprising:

a dispensing assembly which connects to a valve assembly of the container, wherein the dispensing assembly comprises a) an actuator cap having a discharge passage, wherein the actuator cap acts as a metering chamber in combination with b) an adaptor which fits inside the cap and snugly engages an inner side wall of the cap and a valve stem of the valve assembly; wherein the adaptor comprises i) a hollow conduit; and ii) a sealer ring which slightly extends from an external circumference of the adaptor, wherein the diameter of the sealer ring correlates with the size of an inner tip of the discharge passage so that the larger the inner tip, the larger the diameter of the sealer ring, and wherein the diameter of the sealer ring is at least the size of the diameter of the discharge passage;

whereby the dispensing assembly in response to a downward pressure on the actuator cap allows a predetermined quantity of content to be released into the metering chamber, and wherein release of the downward pressure or closing of the valve assembly causes the dispensing assembly to resume a non-actuated position and the predetermined quantity of content to be discharged.

2. The apparatus of claim 1, wherein the dispensing assembly is an actuator assembly.

3. The apparatus of claim 2, wherein the dispensing assembly further comprises an enclosure unit and a dispensing unit, wherein the dispensing unit and the actuator assembly are movable elements; and wherein the actuator cap is integrated within the dispensing unit.

4. The apparatus of claim 3, wherein the dispensing unit comprises: an outer surface that covers the actuator cap; a dispensing conduit in the dispensing unit in fluid communication with the metering chamber of the actuator cap; and a discharge nozzle at an end of the dispensing conduit distal to the metering chamber.

5. The apparatus of claim 4, further comprising a tubular conduit extending from and in fluid communication with the discharge nozzle.

6. The apparatus of claim 4, wherein the dispensing unit further comprises an engagement mechanism for securing the dispensing unit to the enclosure unit; wherein the engagement mechanism comprises a raised or depressed feature complementary to an element on the enclosure unit for engagement and securing the dispensing unit to the enclosure unit; wherein the engagement mechanism comprises at least two substantially vertically aligned slots within an external peripheral wall of the dispensing unit; wherein the slots further comprise a notch for engaging with a rail of the enclosure unit; and wherein the engagement mechanism comprises an integral relationship between the dispensing unit and the enclosure unit.

7. The apparatus of claim 1, wherein the cap comprises:

a) a top wall which is pressed down during actuation; and b) a hollow defined by an inner side cylindrical wall dimensioned to closely approximate the diameter of an outer side cylindrical wall of the adaptor, said hollow functioning as the metering chamber; and wherein the discharge passage extends through a bottom peripheral side wall for releasing the predetermined quantity of content.

8. The apparatus of claim 1, wherein a) the hollow conduit is positioned at the center of a top wall of the adaptor, allowing discharge of the pressurized content there through into the metering chamber upon actuation of the dispensing assembly;

b) the sealer ring functions as a gas-tight sealer to reduce undesired leakage of the pressurized content between the adaptor and the cap upon actuation of the dispensing assembly;

c) the adaptor comprises a recess, which is an annular valve-stem-engaging recess defined by an inner cylindrical wall which is dimensioned to closely approximate the diameter of the valve stem, thereby permitting tight frictional engagement there between; and d) the adaptor comprises a ledge which is a thickened edge portion extending circumferentially from the bottom of the adaptor, wherein the adaptor provides resistance to downward pressure, wherein the resistance is relatively small as compared with an opposing action of an internal valve spring, thereby ensuring closure of the discharge passage by the adaptor prior to any downward movement of the valve stem.

9. The apparatus of claim 1, wherein the actuator assembly is disposed on the valve stem, wherein in the non-actuated position, the valve assembly is closed and the valve stem and the actuator assembly disposed thereon are raised, the sealer ring is below the discharge passage and the discharge passage is only partially obstructed by the adaptor, thereby in communication with the atmosphere, and wherein in the actuated position, the valve assembly is open to fluid flow, the valve stem and actuator assembly disposed thereon are depressed and the discharge passage is closed and obstructed by the adaptor and the sealer ring is positioned above the discharge passage.

10. The apparatus of claim 1, wherein the metering chamber is dynamically adjustable, comprising a topless cap and an adjusting device comprising an adjustable screw with a base comprising a washer having a sealer ring attached thereto, wherein the size of the metering chamber is varied according to the location of the base within the cap.

11. The apparatus of claim 1, wherein the discharge passage is conically shaped.

12. The apparatus of claim 1, wherein the radius of the discharge passage is about 0.025 mm to about 1 mm.

13. The apparatus of claim 1, wherein the sealer ring protrudes from the circumference of the adaptor by an amount selected from the group consisting of about 0.1 mm, about 0.12 mm, about 0.14 mm, about 0.16 mm, about 0.18 mm, about 0.2 mm, about 0.08 mm, about 0.06 mm, about 0.04 mm, about 0.02 mm, and about 0.01 mm.

14. The apparatus of claim 1, wherein the ratio between the diameter of the sealer ring and the diameter of the inner discharge passage is 1:1 or greater than 1:1.

15. A method for delivering a predetermined quantity of content from the apparatus of claim 1, comprising actuating the apparatus by applying a downward pressure on the dispensing assembly, and then releasing the pressure to allow the predetermined quantity of content to be discharged or actuating the dispensing assembly multiple times to allow multiple doses of the predetermined quantity of content to be discharged, wherein the actuating comprises:

a) applying downward pressure on the actuator cap causing the cap to shift downward on the adaptor such that the discharge passage of the cap is blocked by a top side wall of the adaptor and the sealer ring;

b) applying further downward pressure on the actuator cap such that a lower edge portion of the cap engages a ledge situated at the bottom of the adaptor causing the adaptor to shift downward on the valve stem, causing the valve assembly to open, thereby causing the pressurized contents to pass upward through the valve stem and through the hollow conduit in a top wall of the adaptor into the metering chamber which is obstructed by the sealer ring and the top side wall of the adaptor, the cap constituting in effect a slide valve element; and c) removing the downward pressure from the cap such that an internal return valve spring and the pressurized content return the parts of the actuator assembly to the non-actuated position where the metering chamber is in communication with the outside atmosphere because the adaptor, including the sealer ring, is positioned below the discharge passage, allowing the predetermined quantity of contents of the metering chamber to issue from the discharge passage.

16. The method of claim 15, further comprising a step of varying the size of the actuator cap while ensuring all components are sized and shaped to accommodate proper engagement and movement.

17. The method of claim 16, wherein one or more of the components are selected from the group consisting of a cap, an adaptor, a sealer ring, and a discharge passage.

18. The method of claim 16, wherein the ratio between the diameter of the discharge passage and the volume of the metering chamber is about 1:1 to about 1:500,000.

19. The apparatus of claim 5, wherein the dispensing unit further comprises an engagement mechanism for securing the dispensing unit to the enclosure unit; wherein the engagement mechanism comprises a raised or depressed feature complementary to an element on the enclosure unit for engagement and securing the dispensing unit to the enclosure unit; wherein the engagement mechanism comprises at least two substantially vertically aligned slots within an external peripheral wall of the dispensing unit; wherein the slots further comprise a notch for engaging with a rail of the enclosure unit; wherein the engagement mechanism comprises an integral relationship between the dispensing unit and the enclosure unit; wherein the cap comprises a top wall which is pressed down during actuation and a hollow defined by an inner side cylindrical wall dimensioned to closely approximate the diameter of an outer side cylindrical wall of the adaptor, said hollow functioning as the metering chamber; wherein the discharge passage extends through a bottom peripheral side wall for releasing the predetermined quantity of content; wherein the hollow conduit is positioned at the center of a top wall of the adaptor, allowing discharge of the pressurized content there through into the metering chamber upon actuation of the dispensing assembly; wherein the sealer ring functions as a gas-tight sealer to reduce undesired leakage of the pressurized content between the adaptor and the cap upon actuation of the dispensing assembly; wherein the adaptor comprises a recess, which is an annular valve-stem-engaging recess defined by an inner cylindrical wall which is dimensioned to closely approximate the diameter of the valve stem, thereby permitting tight frictional engagement there between; wherein the adaptor comprises a ledge which is a thickened edge portion extending circumferentially from the bottom of the adaptor, and wherein the adaptor provides resistance to downward pressure, and the resistance is relatively small as compared with an opposing action of an internal valve spring, thereby ensuring closure of the discharge passage by the adaptor prior to any downward movement of the valve stem.

20. The apparatus of claim 19, wherein the adaptor and the actuator cap resume a non-actuated position mainly due to liquid or propellant pressure, thereby obviating the need for a diaphragm or a spring.

21. The apparatus of claim 1, wherein delivery of the predetermined quantity of content from at least two pressurized containers comprises a multiple dispensing assembly comprising: a) at least two actuator assemblies, b) a multiple chamber dispensing unit, and c) a multiple chamber enclosure.

22. A dispensing assembly which sits on a pressurized container, the dispensing assembly comprising:

a) an actuator cap that acts as a metering chamber; and b) an adaptor having a sealer ring, wherein the adaptor is positioned within the actuator cap, wherein the sealer ring slightly extends from an external circumference of the adaptor and snugly engages an inner side wall of the actuator cap;

wherein said sealer ring, upon application of a downward pressure on the actuator cap, blocks a discharge passage positioned at a peripheral side wall of the actuator cap;

wherein said sealer ring has a diameter compatible with the size of an inner tip of the discharge passage, thereby reducing unwanted leakage and/or continuous release of a pressurized content from the container;

wherein application of a downward pressure on the actuator cap opens an internal valve in the container, thereby causing the pressurized content to pass upward into the metering chamber, wherein the sealer ring is positioned above the discharge passage, and the discharge passage is obstructed by the sealer ring and a side wall of the adaptor;

wherein release of the downward pressure results in the adaptor, including the sealer ring, being positioned below the discharge passage thereby allowing a predetermined quantity of pressurized content to be discharged from the metering chamber through the discharge passage; and wherein the adaptor and the actuator cap resume a non-actuated position mainly due to the liquid or propellant pressure, thereby obviating the need for a diaphragm or a spring.

23. The dispensing assembly of claim 22, wherein the actuator cap comprises:

a) a top wall which is pressed down during actuation; and b) a hollow defined by an inner side cylindrical wall dimensioned to closely approximate the diameter of an outer side cylindrical wall of the adaptor, said hollow functioning as the metering chamber; and wherein the discharge passage extends through a bottom peripheral side wall for releasing the predetermined quantity of content.

24. The dispensing assembly of claim 22, wherein a) a hollow conduit is positioned at the center of a top wall of the adaptor, allowing discharge of the pressurized content there through into the metering chamber upon actuation of the dispensing assembly;

b) the sealer ring functions as a gas-tight sealer to reduce undesired leakage of the pressurized content between the adaptor and the cap upon actuation of the dispensing assembly;

c) the adaptor comprises a recess, which is an annular valve-stem-engaging recess defined by an inner cylindrical wall which is dimensioned to closely approximate the diameter of a valve stem, thereby permitting tight frictional engagement there between; and d) the adaptor comprises a ledge which is a thickened edge portion extending circumferentially from the bottom of the adaptor, wherein the adaptor provides resistance to downward pressure, wherein the resistance is relatively small as compared with an opposing action of an internal valve spring, thereby ensuring closure of the discharge passage by the adaptor prior to any downward movement of the valve stem.

25. The dispensing assembly of claim 22, wherein the dispensing assembly is an actuator assembly and further comprises an enclosure unit and a dispensing unit, wherein the dispensing unit and the actuator assembly are movable elements; and wherein the actuator cap is integrated within the dispensing unit;

wherein the dispensing unit comprises an outer surface that covers the actuator cap; a dispensing conduit in the dispensing unit in fluid communication with the metering chamber of the actuator cap; and a discharge nozzle at an end of the dispensing conduit distal to the metering chamber;

wherein a tubular conduit extends from and in fluid communication with the discharge nozzle;

wherein the dispensing unit further comprises an engagement mechanism for securing the dispensing unit to the enclosure unit; wherein the engagement mechanism comprises a raised or depressed feature complementary to an element on the enclosure unit for engagement and securing the dispensing unit to the enclosure unit; wherein the engagement mechanism comprises at least two substantially vertically aligned slots within an external peripheral wall of the dispensing unit; wherein the slots further comprise a notch for engaging with a rail of the enclosure unit; and wherein the engagement mechanism comprises an integral relationship between the dispensing unit and the enclosure unit.

26. The apparatus of claim 22, wherein delivery of the predetermined quantity of content from at least two pressurized containers comprises a multiple dispensing assembly comprising: a) at least two actuator assemblies, b) a multiple chamber dispensing unit, and c) a multiple chamber enclosure.

* * * * *